US005610636A

United States Patent [19]

Hanabusa et al.

[11] Patent Number: 5,610,636

[45] Date of Patent: Mar. 11, 1997

[54] GAP ADJUSTING METHOD AND INK JET RECORDING APPARATUS HAVING GAP ADJUSTING MECHANISM

[75] Inventors: Tadashi Hanabusa; Masanori Kaneko, both of Kawasaki; Koh Hasegawa, Yokohama, all of Japan

[73] Assignee: Canon Kabushiki Kaisha, Tokyo, Japan

[21] Appl. No.: 430,305

[22] Filed: Apr. 28, 1995

Related U.S. Application Data

[63] Continuation of Ser. No. 634,767, Dec. 27, 1990, abandoned.

[30] Foreign Application Priority Data

| | | | |
|---|---|---|---|
| Dec. 29, 1989 | [JP] | Japan | 1-344907 |
| Dec. 29, 1989 | [JP] | Japan | 1-344908 |
| Dec. 29, 1989 | [JP] | Japan | 1-344909 |

[51] Int. Cl.[6] ..... B41J 25/308; B41J 11/20

[52] U.S. Cl. ..... 347/8; 400/56; 400/59

[58] Field of Search ..... 347/8, 14, 37, 347/12, 29, 33, 22; 346/139 R; 400/55, 56, 57, 58, 59

[56] References Cited

U.S. PATENT DOCUMENTS

| | | | |
|---|---|---|---|
| 3,817,365 | 6/1974 | Zimmermann | 400/59 |
| 4,024,940 | 5/1977 | Hendrischk et al. | 400/56 |
| 4,174,908 | 11/1979 | Wehler | 400/56 |
| 4,227,219 | 10/1980 | Takemoto | 347/37 X |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,500,895 | 2/1985 | Buck et al. | 347/86 X |
| 4,558,333 | 12/1985 | Sugitani et al. | 347/65 |
| 4,723,129 | 2/1988 | Endo et al. | 347/56 |
| 4,739,847 | 4/1988 | Terasawa | 177/140 |
| 4,740,796 | 4/1988 | Endo et al. | 347/56 |
| 4,775,871 | 10/1988 | Abe et al. | 346/140 R |
| 5,065,169 | 11/1991 | Vincent et al. | 346/140 R |
| 5,193,918 | 3/1993 | Lohrmann et al. | 400/56 |

FOREIGN PATENT DOCUMENTS

| | | | |
|---|---|---|---|
| 0216394 | 4/1987 | European Pat. Off. . | |
| 0336734 | 10/1989 | European Pat. Off. . | |
| 54-56847 | 5/1979 | Japan . | |
| 58-004683 | 1/1983 | Japan . | |
| 59-123670 | 7/1984 | Japan . | |
| 59-138461 | 8/1984 | Japan . | |
| 60-71260 | 4/1985 | Japan . | |
| 0125871 | 6/1986 | Japan | B41J 25/28 |
| 62-74676 | 4/1987 | Japan . | |

OTHER PUBLICATIONS

IBM Technical Disclosure Bulletin, Bernard et al, vol. 20, No. 2, Jul. 1977, "Carrier Support Device".

*Primary Examiner*—Benjamin R. Fuller
*Assistant Examiner*—David Yockey
*Attorney, Agent, or Firm*—Fitzpatrick, Cella, Harper & Scinto

[57] ABSTRACT

An ink jet recording apparatus having a recording head for ejecting ink, a carriage for carrying the recording head, and a mechanism for adjusting a gap between a recording medium disposed on a platen and the recording head, and a gap adjusting method for adjusting a gap between a recording medium disposed on a platen and a recording head. Bearings attached to the carriage and mounted on a guide shaft are displaceable with respect to the carriage, and the bores of the bearings are eccentric with respect to the guide shaft. This enables the carriage to be displaced in a horizontal plane in accordance with the thickness of recording paper, and to consequently incline the ejection-outlet-array line of the recording head on the carriage. Further, the carriage is pivoted about one of the bearings in a plane including the bearings in accordance with the thickness of the paper.

20 Claims, 41 Drawing Sheets

GAP ADJUSTING METHOD AND INK JET RECORDING APPARATUS HAVING GAP ADJUSTING MECHANISM

This application is a continuation of application Ser. No. 07/634,767, filed Dec. 27, 1990, now abandoned.

BACKGROUND OF THE INVENTION

1. Field of the Invention

The present invention relates to an ink jet recording apparatus which performs recording by ejecting ink.

2. Description of the Related Art

Recording apparatuses which perform recording on recording medium such as paper, transparent films for over head projectors, or the like (these are called "recording paper", or simply "paper" hereinafter) are proposed in a number of forms that mount various types of recording heads. For example, recording heads such as wire dot heads, thermal heads, ink jet heads, are used in serial printers. In particular, ink jet printers attract attention owing to their low running cost and low operation noise resulting from the fact that they eject ink directly on the recording paper.

Today, ink jet recording apparatuses, and in particular, recording heads are fabricated by the film-forming technique or micro-processing technique used for manufacturing semiconductor devices. As a result, fabrication of small-sized and inexpensive recording heads are being implemented, and removable type recording heads, which include an ink reservoir as their integral part, are proposed. This also makes it possible to produce recording apparatuses of small-sized, simple construction.

The ink jet recording apparatuses having these various advantages are being widely used as recording devices of such apparatuses as electronic typewriters, word processors, facsimiles, copying machines, or the like. The ink jet recording apparatuses are provided with arrangements suitable for functions and operation types of each of these apparatuses.

Furthermore, there has been recent trend that small-sized, light, portable electronic typewriters or word processors are becoming more and more popular. In view of these points, demand for small-sized, simple construction ink jet recording apparatuses is increasing.

In the ink jet recording apparatuses, sizes of ink dots formed on recording paper are a major factor for determining the density of images. The quality of images also depends on the accuracy of the position of dots. From these points of view, control of the projectile length of drops of ink ejected from the recording head, namely, the distance between the recording head and the recording paper (called "gap" below) is a major issue.

In addition, a variety of recording media are used because of the wide range of machines that use the ink jet recording apparatuses, and of the attribute that it performs recording by adhering drops of ink on the media. As a result, the ink jet apparatuses must adjust the gap in response to the kind of media, particularly to the thickness thereof.

As a gap adjusting mechanism, is known an arrangement which adjusts the gap by letting a transport roller escape backward by pressing it with rollers mounted on a carriage on which a recording head is loaded, when rather thick recording paper is used. In this arrangement, however, the rollers must press the transport roller with large force so as to let the transport roller escape backward, thus, the moving resistance of the carriage increases because of the roller so that the torque of the motor for driving the carriage must be increased.

On the other hand, when the recording paper of common thickness is used, the following arrangements can be used: first, an arrangement that a transport roller is pressed to a paper pressure plate so as to escape for thick paper; second, an arrangement that the paper pressure plate is pressed by a carriage. These arrangements, however, pose problems that the arrangements become complicated, or that insertion of the recording paper between the paper pressure plate and the transport roller may become difficult in the case where the pressure between the paper pressure plate and the transport roller is not appropriate, or the pressure on the paper is not suitable because of the kind of materials of the paper, or of its thickness.

Alternatively, there is arrangement for adjusting the gap by rotating a carriage about a guide shaft thereof, or by shifting a recording head with regard to a carriage. The arrangement, however, has a disadvantage that the construction and operation for adjustment become complicated.

Generally, the ink jet recording apparatuses are provided with a system for ejection recovery processing for the recording head. More specifically, the recording head of the ink jet system may suffer from a ejection failure of ink because of increase in viscosity of ink, of clogging of the ejection outlets or the like. To prevent the failure, the ejection-outlet-disposed surface of the recording head is capped so as to prevent the water in the ink from vaporizing, or to remove the clogging by forcefully sucking the ink with the recording head being capped.

The capping operation is generally performed as follows: first, the carriage on which the recording head is mounted is moved to a predetermined position such as the home position; second, the cap, which is provided so that it can move back and forth, is pressed to the recording head; and the ink is sucked by the cap that covers with the recording head.

This arrangement poses a problem that when the carriage or the recording head is moved so that the recording head is covered by the cap, the recording head may escape from the cap, which hinders reliable capping. Such a problem occurs in other cases: for example, an apparatus having such construction in which a flexible blade wipes the ejection-outlet-disposed surface of a recording head while the recording head is moving so that drops of ink sticking to the ejection-outlet-disposed surface are removed, may suffer from a problem similar to the above problem when the blade makes contact with the ejection-outlet-disposed surface.

Furthermore, the ink jet recording apparatus may have such arrangement in which ejection outlets of a recording head are divided into several blocks so that the blocks are sequentially driven on time sharing basis. A serial type apparatus of this kind, which performs recording with the movement of the recording head, has a problem that a line to be recorded normal to the moving direction (the scanning direction) of the recording head, that is, a line in the vertical direction (the subscanning direction) is obliquely recorded without taking any additional steps.

To correct such an oblique line to a vertical line, is used such an arrangement that a part of a carriage bearing a recording head is inclined so that an ejection-outlet-array line consisting of a plurality of ejection outlets is inclined.

This arrangement, however, poses a problem that it is difficult to achieve the accuracy of the inclination. Furthermore, there are other problems: when the inclination must be altered in accordance with the ejection timing or carriage velocity, one form of carriage may be insufficient to deal with this alteration; a variety types of carriage must be prepared so that one of them is installed in the apparatus. Even if one form of carriage can deal with the alteration, configuration of the carriage for changing the inclination will become too complicated.

SUMMARY OF THE INVENTION

An object of the present invention is to provide an ink jet recording apparatus that can raise a quality of recorded image by maintaining the positional relation (a gap, an inclination, or the like) between the recording medium and the ejection outlet of the recording head.

A further object of the present invention is to provide an ink jet recording apparatus that can automatically adjust the gap between the recording paper and the ejection outlets of the recording head in response to the thickness of the recording paper, with a simple arrangement.

A still further object of the present invention is to provide an ink jet recording apparatus that can positively perform the capping without escape of the recording head or the carriage involved in the capping or wiping operation by fitting the carriage to a member fixed to the apparatus at the capping position.

A still further object of the present invention is to provide an ink jet recording apparatus that can precisely correct the inclination of the carriage by a simple arrangement, and that can easily deal with the alteration of the inclination.

In a first aspect of the present invention, there is provided an ink jet recording apparatus for performing recording by ejecting ink to a record medium, the ink jet recording apparatus comprising:

a recording head for ejecting the ink to the record medium to perform the recording, the recording head being displaceable with regard to a transfer path of the record medium;

transport means for transferring the record medium;

a pressure member displaceable in response to the thickness of the record medium; and contact means for displacing the recording head in response to the displacement of the pressure member by making contact with the pressure member.

According to the arrangement above, the pressure member displaces in response to the thickness of the recording medium transferred between the paper pressure member and the transport means. Pressing force which is caused by the displacement, acts on the contact means so that the recording head is deviated in accordance with the pressing force.

As a result, the gap is automatically adjusted by a linear or rotative movement of the recording head corresponding to the thickness of the recording medium. Consequently, good recording can be performed independently of the thickness of the recording medium with a rather simple structure. Thus, the gap adjustment operation depending on the thickness of the recording medium can be obviated.

In a second aspect of the present invention, there is provided an ink jet recording apparatus for performing recording by ejecting ink to a record medium, the ink jet recording apparatus comprising:

a recording head for ejecting the ink to the record medium to perform the recording, the recording head being able to move to and fro along a transfer path of the record medium;

a support means for supporting the recording head so as to be displaceable with regard to the transfer path; and a regulation means provided in the course of the moving path of the recording head, regulating the displacement of the recording head with regard to the transfer path.

According to the above arrangement, when the recording head is located, for example, at the capping position, the displacement of the recording head to and from the cap member is prevented by the regulation means.

Thus, the capping operation is positively carried out. The effect can be achieved with a simple arrangement which uses, for example, the shaft of the pulley carrying the carriage conveying belt as the regulation means, and provides a notch that fits to the shaft at the corresponding portion of the recording head.

In a third aspect of the present invention, there is provided an ink jet recording apparatus for performing recording by ejecting ink to a record medium, the ink jet recording apparatus comprising:

a recording head for ejecting the ink to the record medium to perform the recording;

a carriage capable of moving in the direction perpendicular to a transfer path of the record medium;

a shaft for supporting the carriage; and bearing members which are attached to the carriage and are movably mounted on the shaft so as to incline an ejection outlet line of the recording head with regard to the movement direction of the recording head.

According to the above arrangement, the carriage is supported by the bearing member which is attached to the carriage in such a manner that the carriage is inclined with regard to the guide shaft. Thus, the ejection-outlet-array line of the recording head loaded on the carriage has a certain inclination with regard to the direction normal to the moving direction of the carriage.

As a result, the inclination can be achieved with high accuracy with a simple arrangement in which bearing members are provided at both sides of the carriage. This makes it possible, for example, for the inclination to be implemented by attaching the same two eccentric bearings in such a manner that the eccentric directions of the two bearings take opposite directions each other. Thus, a simple, inexpensive arrangement is achieved. Furthermore, the arrangement can deal with the change in timing of the time sharing drive by only replacing the bearings with other bearings the eccentric amount of which is different from that of the replaced bearings, without changing the form of the carriage.

DETAILED DESCRIPTION OF PREFERRED EMBODIMENTS

The invention will now be described with reference to the accompanying drawings.

APPEARANCE OF AN ELECTRONIC TYPEWRITER

Figure 1A:
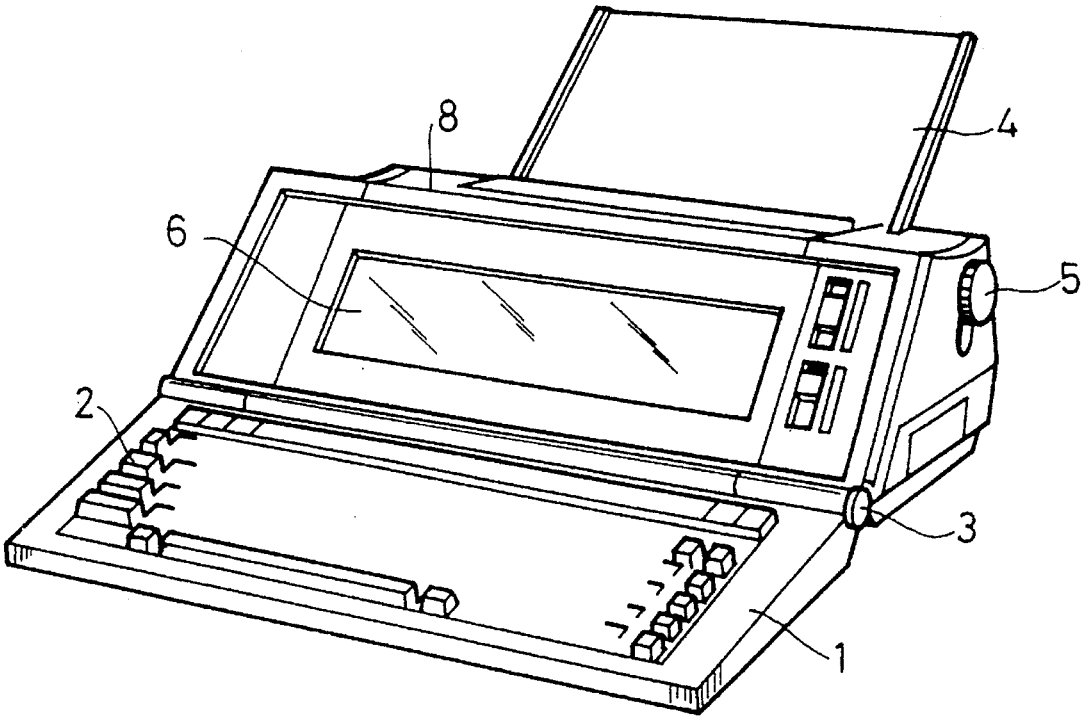
FIGS. 1A and 1B are perspective views showing an appearance when used and an appearance when closed, respectively, of an electronic printer to which the present invention is applied.
Figure 1B:
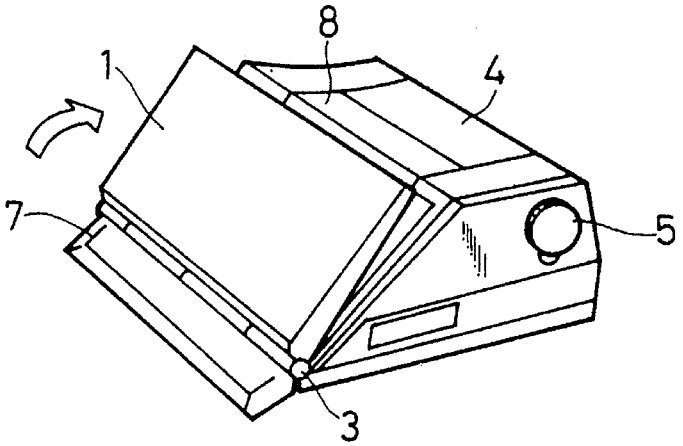

FIGS. 1A and 1B are external views of an electronic typewriter to which the present invention can be applied.

In these figures, reference numeral 1 designates a keyboard on which are disposed keys 2 for entering characters, numerals, control signals or the like. The keyboard 1 can be folded as shown in FIG. 1B by turning it about a hinge 3 when the typewriter is unused. Reference numeral 4 denotes a feed tray for feeding a sheet-like recording medium to a print portion in the apparatus. The feed tray 4 can also be folded to cover the print portion as shown in FIG. 1B when the typewriter is unused. Reference numeral 5 designates a feed knob for manually setting or feeding out the recording medium; 6, a display for showing entered sentences or the like; and 7, a handle for carrying the apparatus.

Reference numeral 8 designates a cover provided at the top of the electronic typewriter of the embodiment, adjoining the display 6. When the cover 8 is made of a transparent plastics or the like, the print portion and recording medium that are installed in the typewriter can be seen through the cover 8.

PRINTER UNIT

Figure 2:
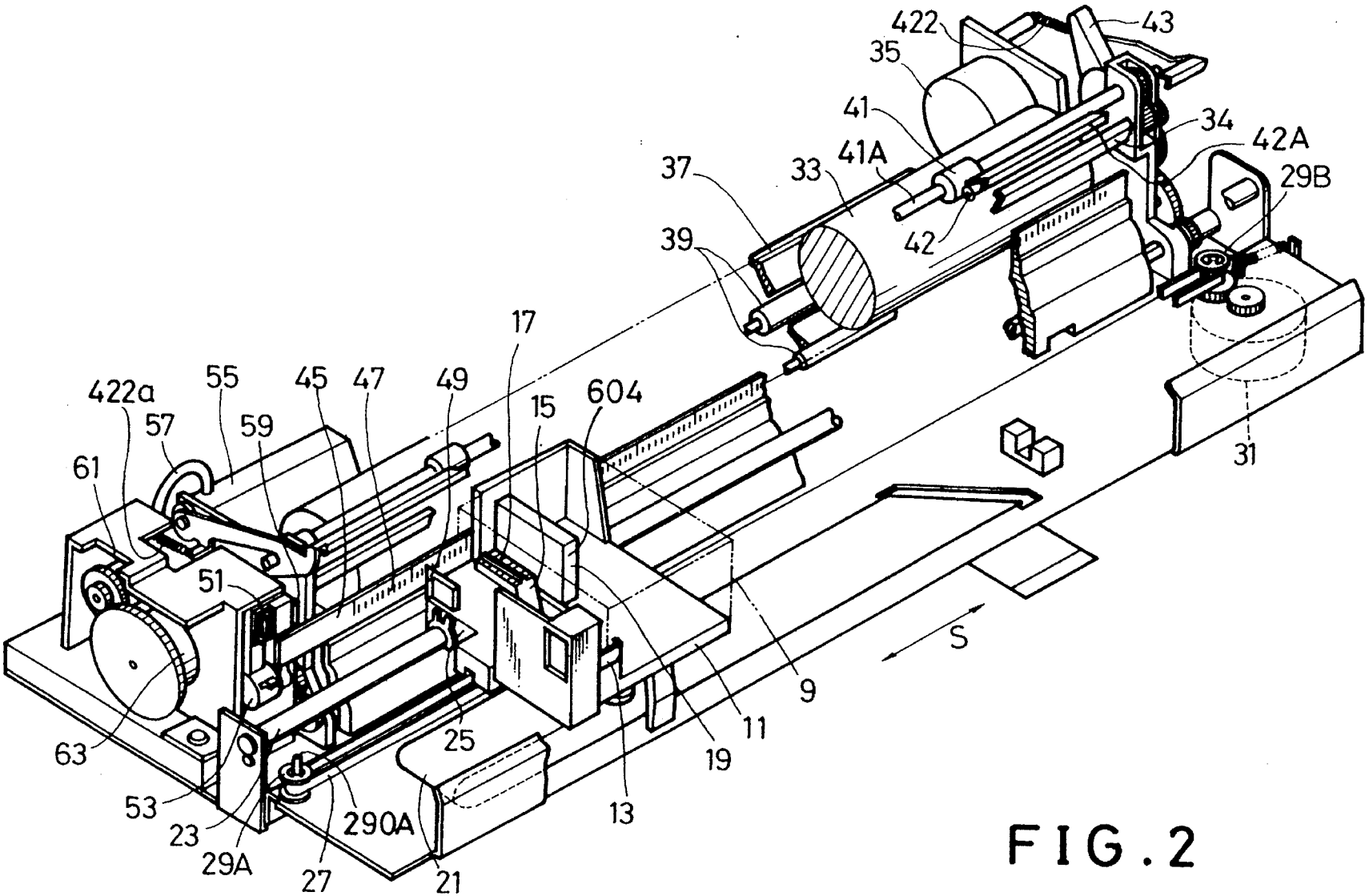
FIG. 2 is a perspective view showing an example of a printer to which the present invention can be applied.

FIG. 2 shows an example of the arrangement of the printer unit.

Reference numeral 9 denotes a head cartridge including an ink jet print head, which will be described in detail later with reference to FIGS. 3 and 4. Reference numeral 11 designates a carriage on which the head cartridge 9 is mounted, and which scans in the direction S of FIG. 2. Reference numeral 13 denotes a hook for attaching the head cartridge 9 to the carriage 11, and 15, a lever for manipulating the hook 13. To the lever 15, is attached a marker 17 that indicates a scale provided on a cover which will be described later, thus making it possible to read the printing position or the setting position of the print head in the head cartridge 9. Reference numeral 19 designates a support plate for supporting an electric connecting portion 604 to the head cartridge 9. The electric connecting portion 604 is connected to the control portion (recording head drive means) of the apparatus by a flexible cable 21.

The carriage 11 is guided in the direction S along a guide shaft 23 which is inserted through bearings 25 and 25' attached at either side of the carriage 11. The carriage 11 is attached to a timing belt 27. The timing belt 27 is stretched around about two pulleys 29A and 29B which are provided at the both sides of the apparatus, and transmits force to the cartridge 11 to move it in the longitudinal directions S. The driving force is transmitted from a carriage motor 31 to the pulley 29B via a transmission mechanism such as gears.

Reference numeral 33 designates a transport roller that is driven by a transport motor 35 to feed the recording medium such as paper, transparent films for over head projectors, or the like. The recording medium is guided by a paper pan 37 from the feed tray 4 to the printing position. When the recording medium is carried, it is pressed to the transport roller 33 by feed rollers 39 which are provided on the passage of the recording medium. In addition, its record surface is restricted by a platen 34 which is provided opposite the ejection-outlet-disposed surface 1400*a* of the head cartridge 9. In the passage of the recording medium, feed-out rollers 41 for feeding the recording medium into a feed-out aperture (not shown) are provided at positions that are located at a downstream portion of the paper feeding passage with regard to the printing position. Opposite each feed-out roller 41, a spur wheel 42 is provided to press the roller 41 to produce force for transporting the recording medium by the roller 41. The pressures of the feed rollers 39, a pressure plate 45, and the spur wheels 42 are released by a release lever 43.

The recording medium is pressed by a pressure plate 45 so as to closely bear on the transport roller 33, thus preventing the fluctuation of the recording medium in the vicinity of the printing position. In the embodiment, an ink jet recording head that records by ejecting ink is adopted as the recording head. This requires that the gap formed between the surface of the recording head on which ink ejection outlets are disposed and the recording surface of the recording medium be rather narrow (for example, about 0.9–1.3 mm), and that the gap must be strictly controlled to prevent the contact between the two. The pressure plate 45 serves to prevent the contact. On the pressure plate 45, a scale 47 is formed which is indicated by a marker 49 provided on the carriage 11. This makes it possible to read from the scale 47 the printing position or the setting position of the recording head.

At the home position of the recording head, the ink ejection-outlet-disposed surface of the recording head faces a cap 51 which is made of an elastic material such as rubber. The cap 51 is supported in such a manner that it is touchable to and separable from the recording head so that the cap 51 can protect the recording head when it is unused, or is used for ejection recovery operation of the recording head. The ejection recovery operation means the following:

(a) removing processing of impeding factors of the ejection by preliminary ejection; the cap 51 is faced with the ejection-outlet-disposed surface 1400*a* of the recording head, and an energy generating device for ejecting the ink is driven so that the ink is ejected from all the ejection outlets; and/or (b) forced ink discharge from the ejection outlets; it is carried out with the cap 51 covering the ejection-outlet-disposed surface 1400*a* so that the ejection impeding factors can be removed.

Here, as the impeding factors of the ejection, there are such factors as bubbles or dust which mixes with ink, or ink which becomes unsuitable for ejection because of increase in viscosity.

The suction pressure for the forced discharge is produced by a pump 53: the pump 53 is driven to suck the ink received by the cap 51 during the ejection recovery operation which is performed in the form of forced discharge or preliminary ejection. The waste ink thus sucked by the pump 53 is stored in a waste ink reservoir 55 which is communicated with the pump 53 through a tube 57.

The ejection-outlet-disposed surface 1400*a* of the recording head can be wiped by a blade 59 which is slidably supported between a wiping position and a recessed position: at the wiping position the blade 59 is projected until it is capable of touching the ejection-outlet-disposed surface 1400*a* so that the head can be wiped in the course of moving; and at the recessed position, the blade 59 is pulled so that it cannot touch the ejection-outlet-disposed surface 1400*a*. The pump 53 is driven by a motor 61 through a cam device 63. The motor 53 also drives the cap 51 and blade 59 through the cam device 63.

CARTRIDGE

Next, the head cartridge 9 will be described in detail.

Figure 3:
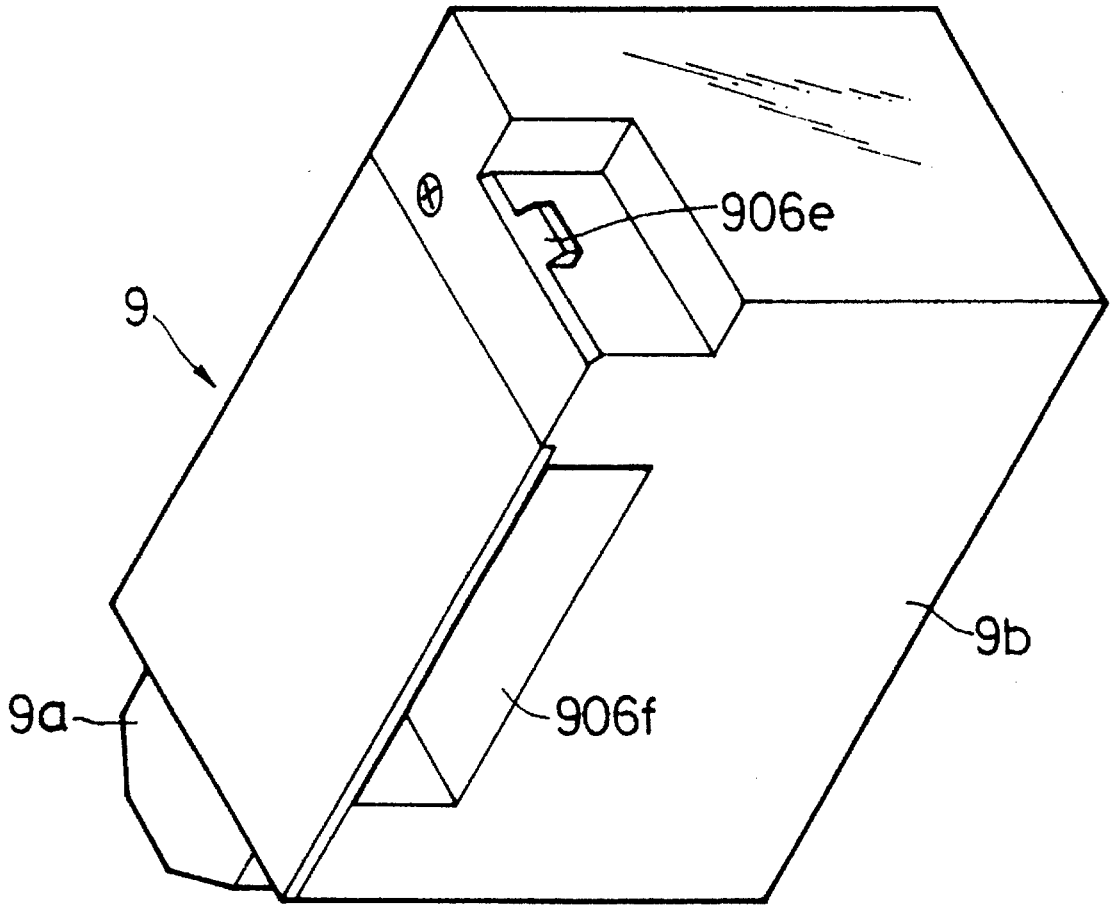
FIG. 3 is a perspective view showing an appearance of the head cartridge 9 shown in FIG. 2.

FIG. 3 is a perspective illustration showing the appearance of the cartridge 9, a unit including a ejection unit 9*a* and an ink reservoir 9*b* which constitute the main portion of the ink jet recording head. The cartridge 9 is installed on the carriage of the printer unit 11 with the hook 13 catching a hook 906*e* provided on the cartridge 9. As clearly seen from FIG. 3, the hook 906*e* is disposed on the back of the cartridge 9. In the vicinity of the ejection unit 9*a* installed at the front of the head cartridge 9, a cartridge stop (not shown) for adjusting the position of the cartridge 9 are provided. The cartridge 9 is further provided with a recess 906*f* into which the support plate 19 is inserted. The support plate 19 supports a flexible printed board as the electric connecting portion 604 of the flexible cable 21 and a rubber pad 605 (see FIG. 5A).

Figure 4A:
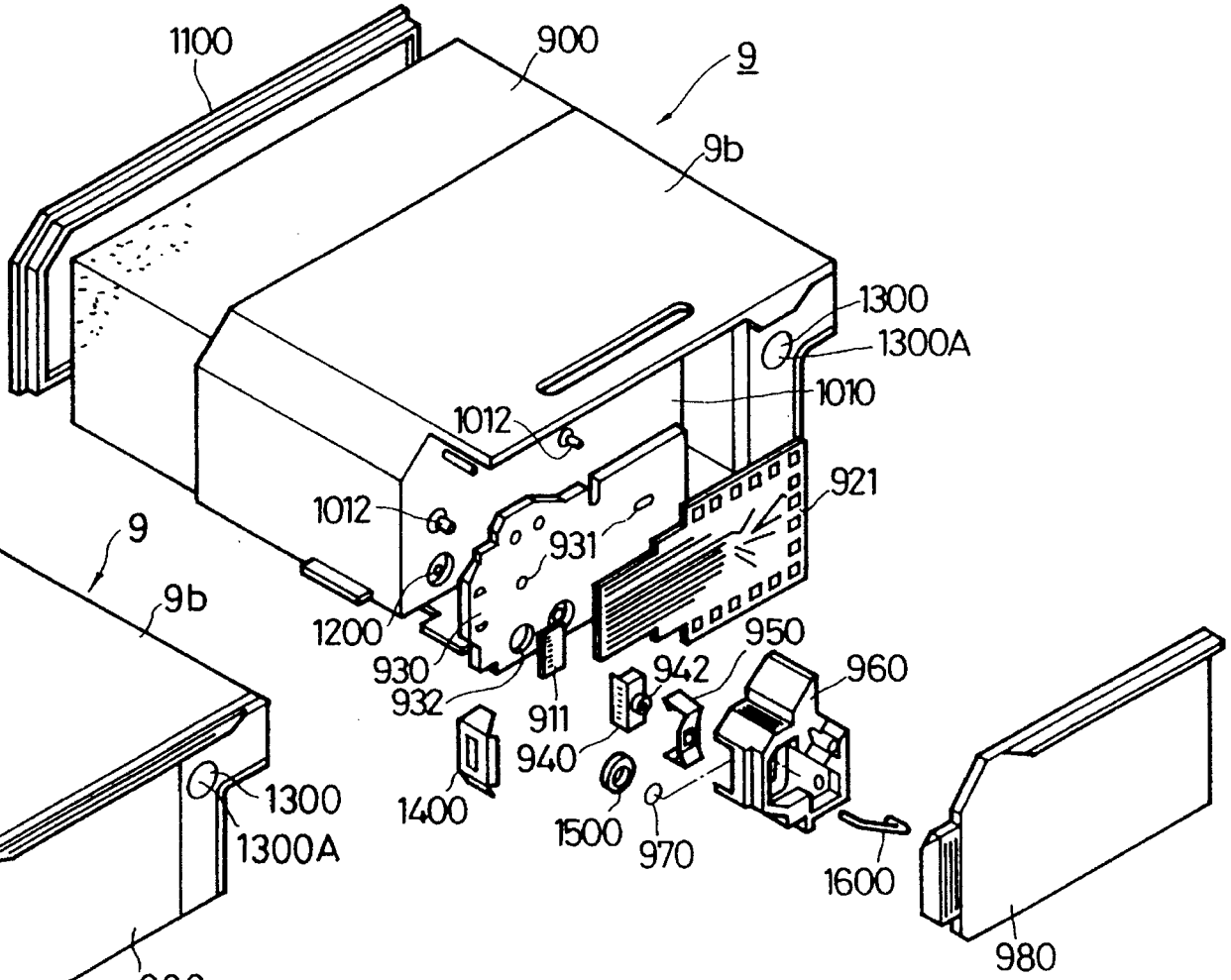
FIG. 4A is an exploded perspective view showing the arrangement of the head cartridge 9 shown in FIG. 3.
Figure 4B:
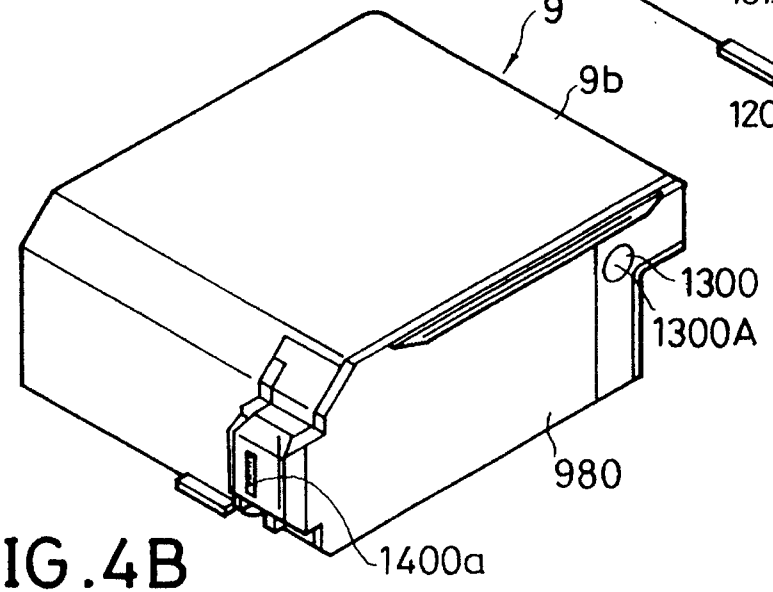
FIG. 4B is a perspective view showing an appearance of the head cartridge 9.

FIGS. 4A and 4B are exploded views of the head cartridge 9 shown in FIG. 3. The head cartridge 9 has the ink reservoir or the ink source as its integral part as mentioned before.

In FIG. 4A, reference numeral 911 designates a heater board having an electrothermal transducer (a ejection heater) that generates thermal energy used for ejecting the ink, and wiring patterns of aluminum or the like for supplying power to the ejection heater. The ejection heater and the wiring patterns are formed on an Si substrate by a film technique. The heater board 911 is joined to a wiring board 921 with the corresponding wires being connected by wire bonding.

Reference numeral 940 designates a top plate on which separation walls for defining liquid passages, and a common ink chamber are formed. In this example, the top plate is made of a resin material on which a member having the ejection-outlet-disposed surface is integrally formed.

The heater board 911 and the top plate 940 are pressure fastened to a supporting plate 930 made of metal, for example: the heater board 911 and the top plate 940 are coupled and put between the supporting plate 930 and a pressure bar flat spring 950, and are fastened by the pressure of the spring 950. The supporting plate 930 has the following functions: first, it supports the printed board 921 attached thereto by adhesion or the like; second, it can be provided with a positional reference for loading the head cartridge 9 to the carriage 11; and third, it functions as a heat dissipating member for radiating heat produced by the drive of the heater board 911.

A supply reservoir 960, being supplied with ink from the ink reservoir 9*b* which is the ink source, guides the ink into the common ink chamber formed by joining the heater board 911 and the top plate 940, thus functioning as a subreservoir. The supply reservoir 960 includes a filter 970 near the ink inlet of the common ink chamber, and has a lid member 980.

An absorber 900 is disposed in the ink reservoir 9*b* to be impregnated with the ink. The above elements 911–980 constitute the ejection unit 9*a* to which the ink is supplied through a feed aperture 1200. The absorber 900 can be impregnated with ink injected through the feed aperture 1200 before the ejection unit 9*a* is attached to a portion 1010 of the ink reservoir 9*b*.

On one side of the cartridge 9, a lid member 1100 is provided. On the other side of the cartridge 9, a vent 1300 as an inlet for serving air is provided. Inside the vent 1300, an ink repellent member 1300A is disposed, thus preventing the waste ink from leaking out of the vent 1300. Reference numeral 1400 denotes a front plate for protecting the ejection-outlet-disposed surface.

When the ink filling to the ink reservoir 9*b* from the feed aperture 1200 has been completed, the ejection unit 9*a* which is constituted by the elements 911–980 is positioned and fastened to the portion 1010. The positioning can be carried out by fitting protrusions 1012 on the ink reservoir 9*b* into corresponding holes 931 provided on the supporting plate 930. Thus, the head cartridge 9 as shown in FIG. 3 is obtained.

The ink is fed from the ink reservoir 9*b* to the supply reservoir 960 through the feed aperture 1200, a hole 932 in the supporting plate 930, and an inlet of the supply reservoir 960. After passing the inside of the supply reservoir 960, the ink pours into the common chamber through the outlet of the supply reservoir 960, a feed tube, and an ink inlet 942 of the top plate 940. At the joint portions of the ink passage, packings made of silicone rubber or butyl rubber are disposed so that the ink passages are tightly sealed.

CARRIAGE

Figure 5A:
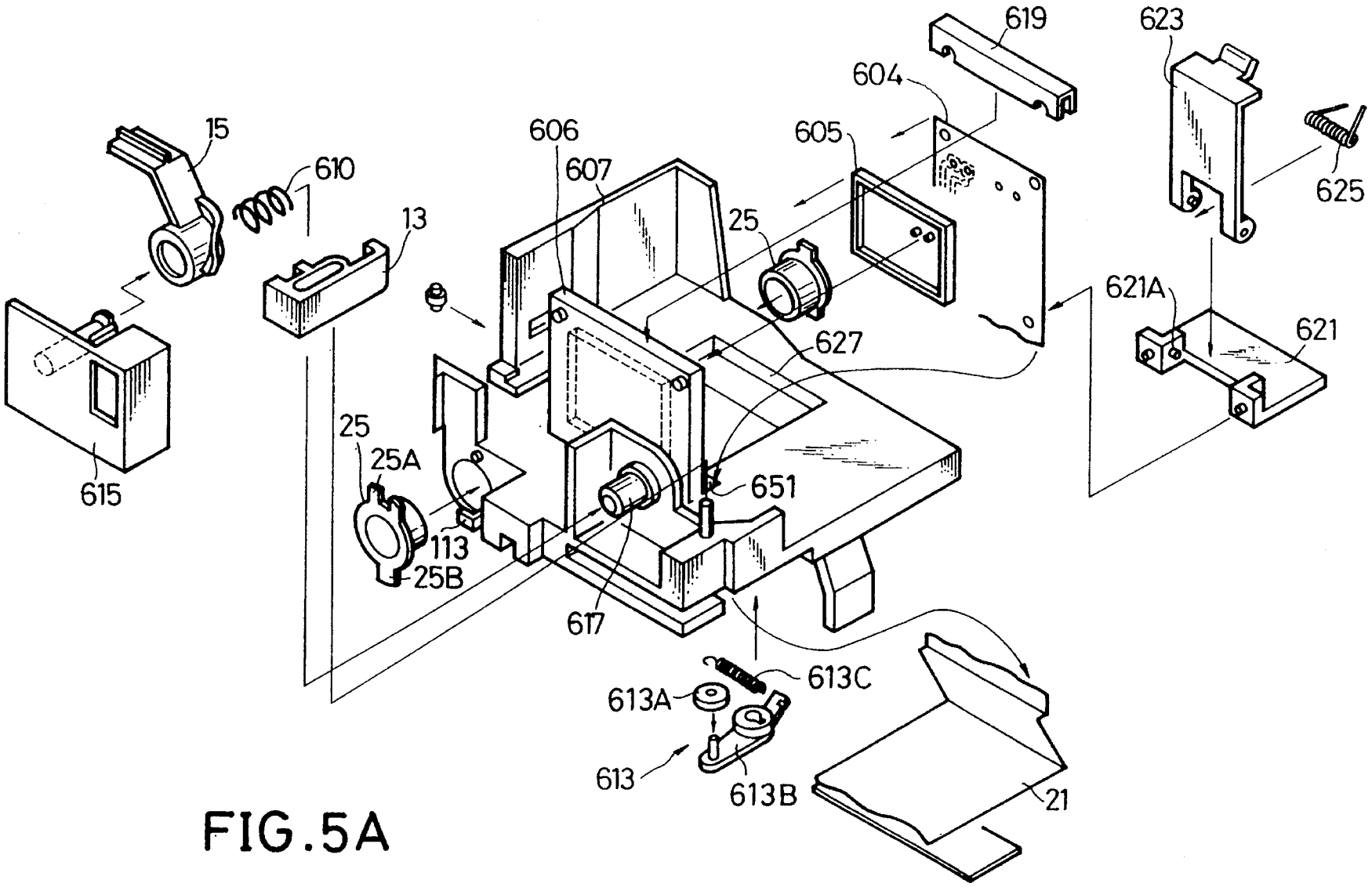
FIGS. 5A, 5B and 5C are an exploded perspective view, a plan view, and a side view showing an arrangement of the carriage 11 shown in FIG. 2, respectively.
Figure 5B:
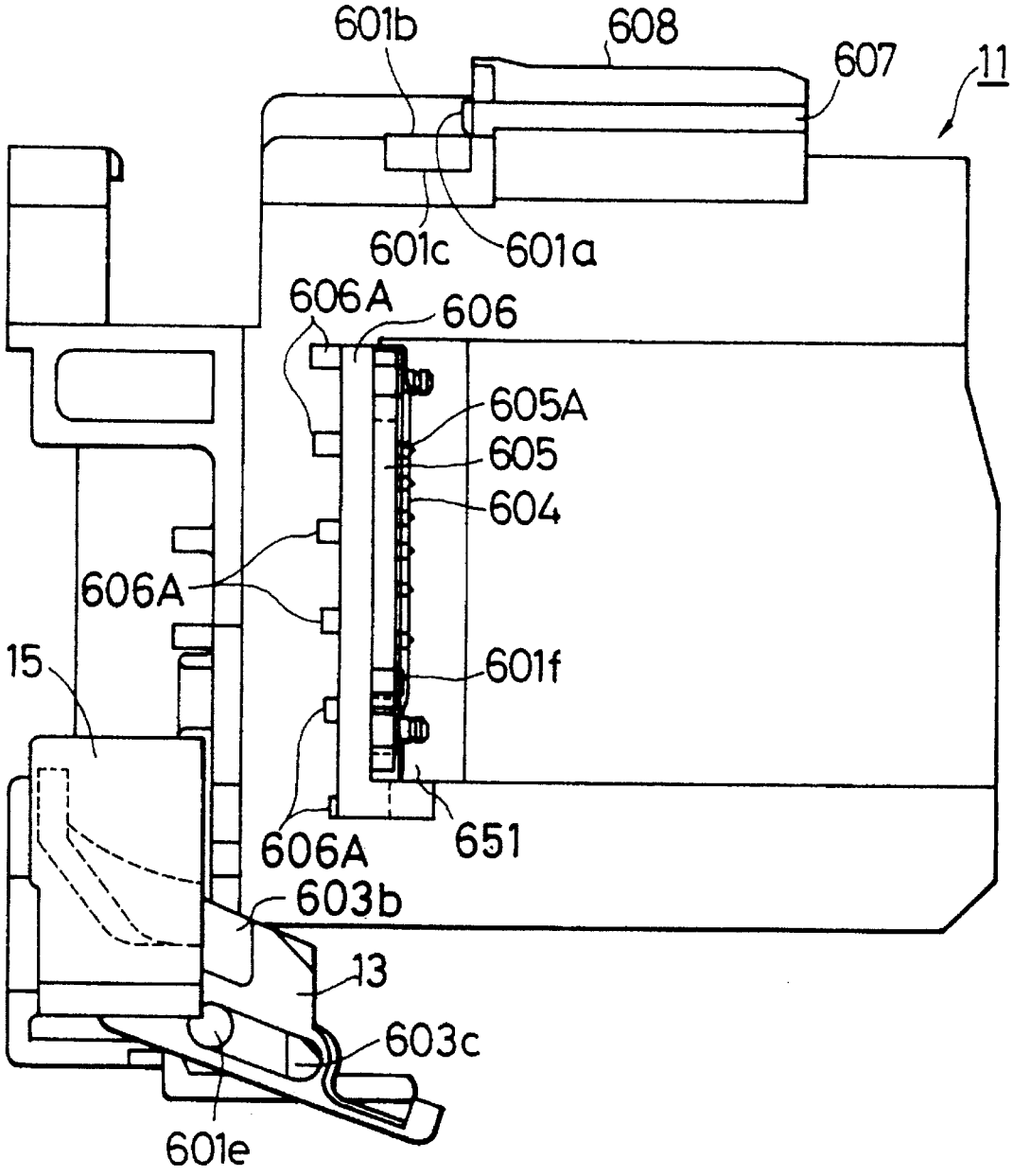
Figure 5C:
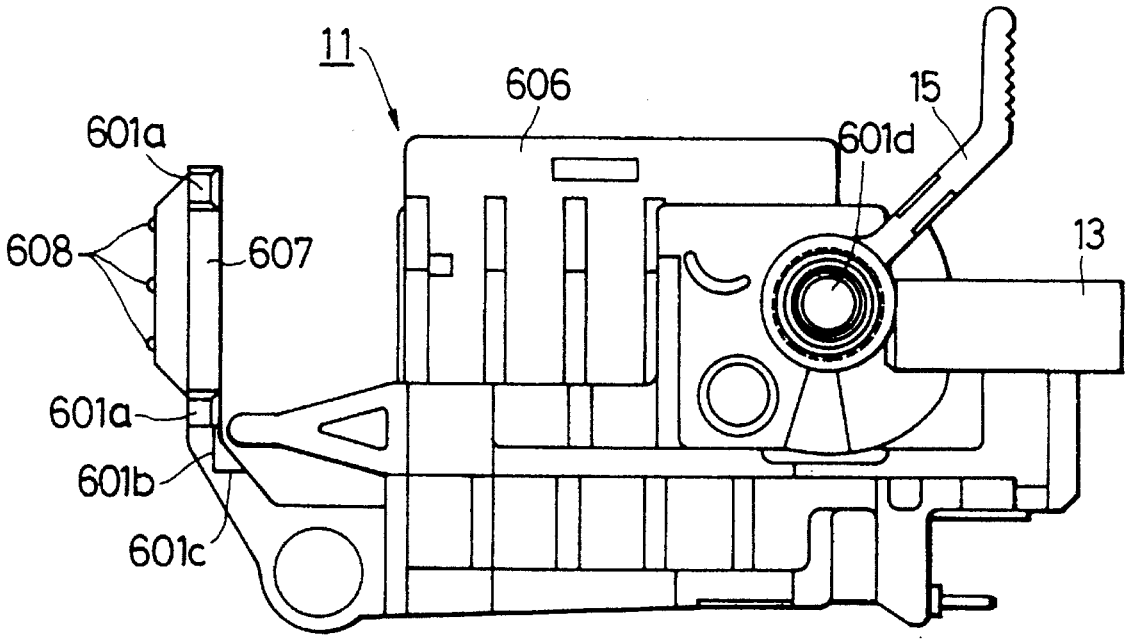

FIGS. 5A, 5B and 5C are an exploded perspective view, a plan view, and a left side view of the carriage 11, respectively.

In these figures, a supporting plate 606 is set upright on the bottom of the carriage 11. The supporting plate 606 supports a rubber pad 605, and a flexible printed board 604 placed on the rubber pad 605. The rubber pad 605 has protrusions 605A corresponding to terminal pads formed on the printed board 604. On the back of the supporting plate 606, a plurality of ribs 606*a* for strengthening the plate 606 are provided in a manner that they project less as their positions go backward (from the platen to the hook 13 or from the top to the bottom in FIG. 5B).

At the front of the carriage 11, a stop member 607 for positioning the head cartridge 9 is set upright on the bottom of the carriage. The stop member 607 is made thin so that the space for the ink reservoir 9*b* is made as large as possible in a limited range by the head cartridge 9 and the carriage 11. For this reason, the stop member 607 is strengthened by three ribs 608 which extend in the direction of the movement of the carriage 11. The direction corresponds to the turning direction of the head cartridge 9 when it is attached to or removed from the carriage 11. The ribs 608 are formed in such a manner that the ribs 608 protrudes forwards from the ejection-outlet-disposed surface 1400*a* by about 0.1 mm when the head cartridge 9 is attached to the carriage 11. This prevents the ejection-outlet-disposed surface from being scratched by record paper even if the record paper curves into the passage of the recording head by some reasons.

The operation lever 15 used for manually installing and removing the head cartridge 9 is rotatably supported about an axis 601*d* provided on the carriage 11. The hook 13, which moves with the operation lever 15, catches the hook 906*e* on the head cartridge 9 so that head cartridge 9 is installed on the carriage 11: the hook 13 has a slot 603*c* into which a guide shaft 601*e* provided on the carriage 11 is inserted so that the hook 13 is guided along the slot 603*c* in the installation and removal of the head cartridge 9.

The installation and removal manipulation mechanism composed of the operation lever 15, hook 13 and the like is provided not at the front or rear but at a side of the carriage 11, or in the moving direction of the carriage 11. This prevents the dead space that would be caused by the manipulating mechanism which is provided at the front or rear of the carriage 11 when the carriage 11 moves.

Next, stop portions for positioning the head cartridge 9 are explained.

Stop portions 601*a* are provided at two locations on the side of the stop member 607 for adjusting longitudinal position (right-to-left or left-to-right position in FIG. 5B) of the head cartridge 9. The longitudinal position of the head cartridge 9 is also restricted by a stop portion 601*f* provided on the supporting plate 606 other than the stop portions 601*a*.

A stop portion 601*b* is formed at a side bottom of the stop member 607 for adjusting the lateral position (top-to-bottom or bottom-to-top position in FIG. 5B) of the head cartridge 9.

Stop portions 601*c* are formed on two locations, that is, at a side bottom of the stop member 607 and a side bottom of the supporting plate 606 for adjusting the top-to-bottom position of the head cartridge 9.

FIG. 5A is an exploded view of the carriage 11.

In this figure, reference numeral 613 designates a roller spring which will be described later, and 615 denotes a lever stopper that stops the operation lever 15 which is rotatably fixed to the mounting portion 617. A mounting member 619 fastens the top edge of the rubber pad 605 and that of the flexible printed board 604 which is integrally formed with the flexible cable 21 at its one end in this embodiment. On the other hand, the bottom edge of the rubber pad 605 and that of the flexible printed board 604 are fixed by a mounting member 621. In the bottom plate of the carriage 11, is provided an opening 651 for feeding through the flexible cable 21.

The flexible printed board 604 is covered by a printed board cover (a lid) 623 for protecting the board 604 and circuits connected thereto when the head cartridge 9 is not installed to the carriage 11. More specifically, the printed board 604 or the circuits connected thereto may be subjected to a touch by a hand of an operator, to the damage by the touch or the like, or to the effect of an electrostatic force, and the lid 623 will protect them from these dangers. The lid 623 is rotatably supported by pins 621A provided on the mounting member 621 which fastens the bottom edge of the printed board 604, and is pressed by a spring 625 so as to cover the flexible printed board 604. When the head cartridge 9 is installed to the carriage 11, the lid 623 is accommodated within a recessed portion 627.

LOADING OF THE CARTRIDGE

Figure 6A:
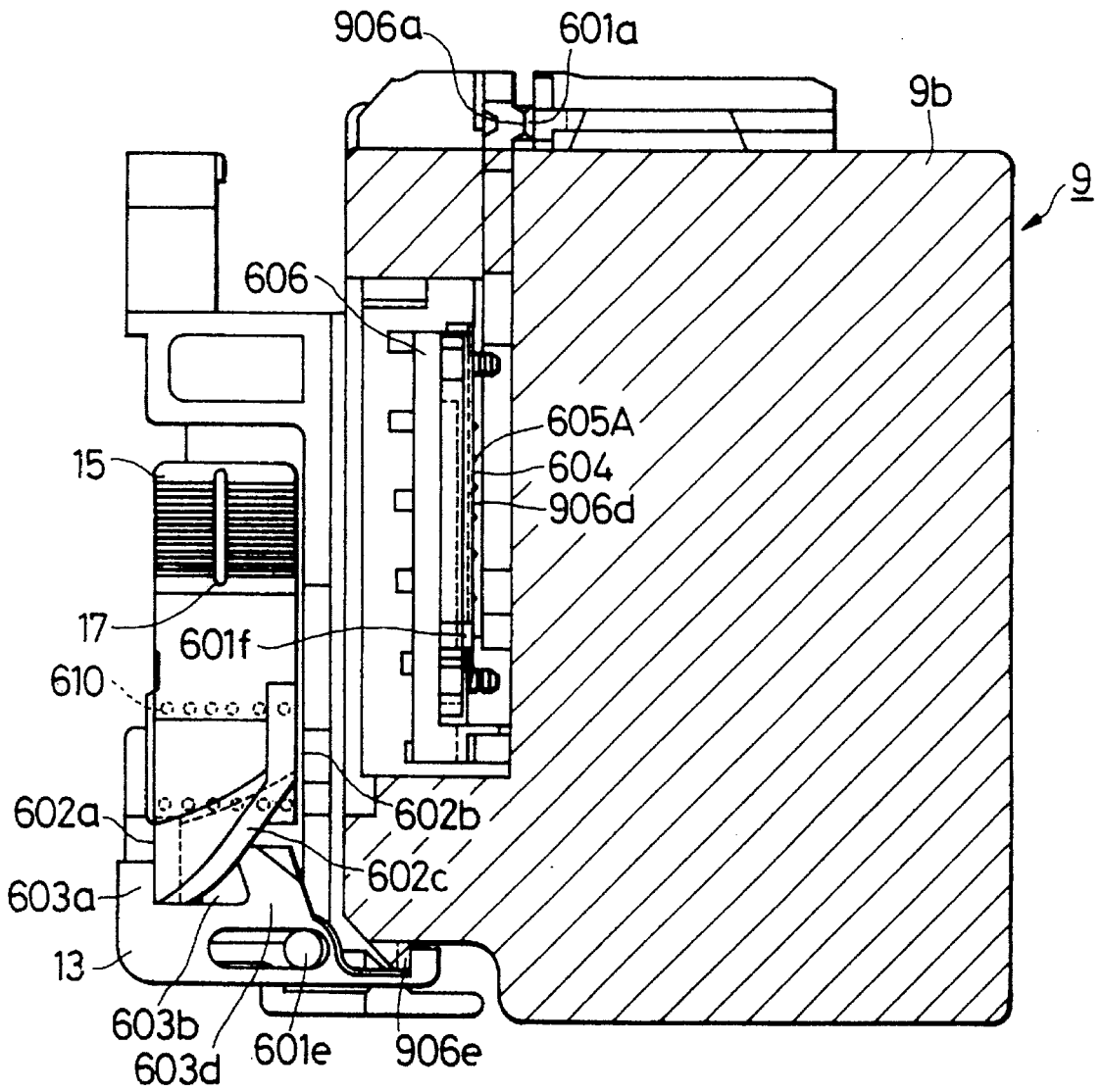
FIGS. 6A and 6B are a plan view and a side view showing the state when the head cartridge 9 is mounted on the carriage 11, respectively.
Figure 6B:
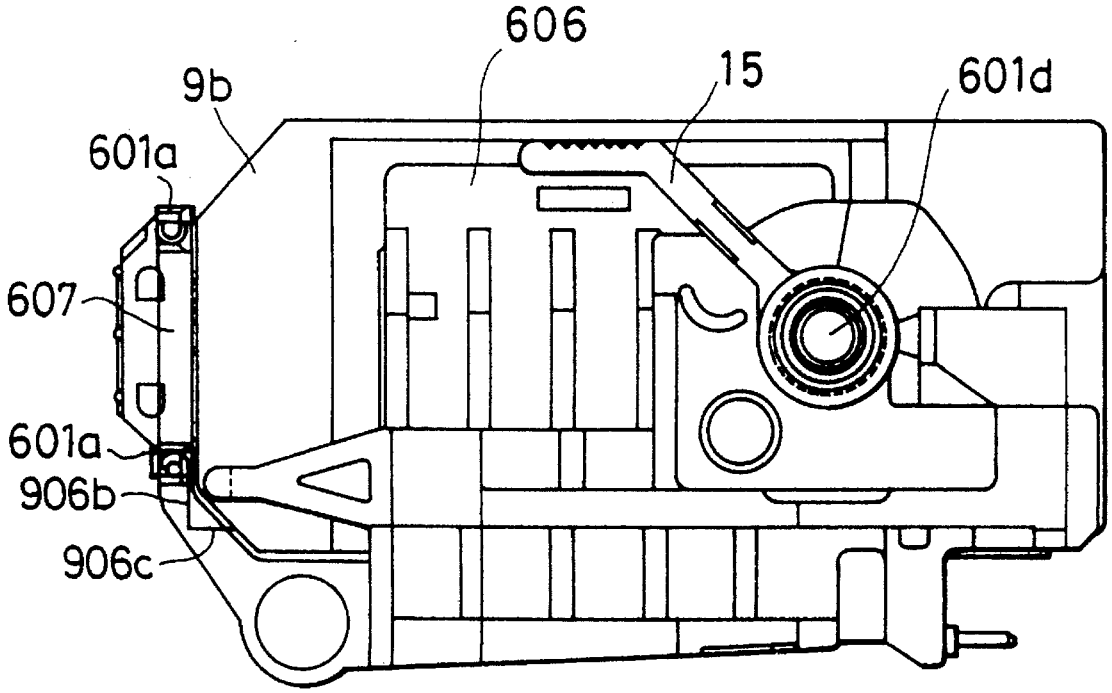

FIGS. 6A and 6B are a plan view and a left side view showing the appearance when the head cartridge 9 is installed to the carriage 11, respectively.

In these figures, contact portions 906*a* are provided on the head cartridge 9 so that they can make contact with the stop portions 601*a* of the carriage 11 when the head cartridge 11 is installed to the carriage 11. Likewise, contact portions 906*b* and 906*c* are provided on the head cartridge 9 to make contact with the stop portions 601*b* and 601*c* of the carriage 11.

First, the relationship of various portions when the cartridge 9 is loaded on the carriage 11 will be described with reference to FIG. 6A.

The contact portions 906*a* of the head cartridge 9 make contact with the stop portions 601*a* of the carriage 11. At the same time, the hook 906*e* on the head cartridge 9 is pressed to the left of FIG. 6A by a helical spring 610 via the hook 13. Thus, the head cartridge 9 is subjected to the moment of force the axis of which is the contact portions 906*a*, and a printed board 906*d* provided in the head cartridge 9 makes contact with the stop portion 601*f*. As a result, the longitudinal position (right-to-left or left-to-right position in FIG. 6A) of the head cartridge 9 is determined, and the cartridge 9 is maintained at that position.

The protrusions 605A of the rubber pad 605 make contact with the printed board 906*d*, thereby to be compressed and deformed. The deformity exerts pressure on the flexible printed board 604 so that the terminal pads of the flexible printed board 604 and the terminals of the printed board 906*d* make contact. In this case, since the printed board 906*d* makes contact with the stop portion 601*f*, the deformity of the protrusions 605A is restricted by the stop portion 601*f*, which makes the pressure nearly constant. Incidentally, the deformity of the protrusions 605A is not depicted in FIG. 6A. The lateral and vertical positioning of the head cartridge 9 is performed during the installation of the cartridge.

Figure 7A:
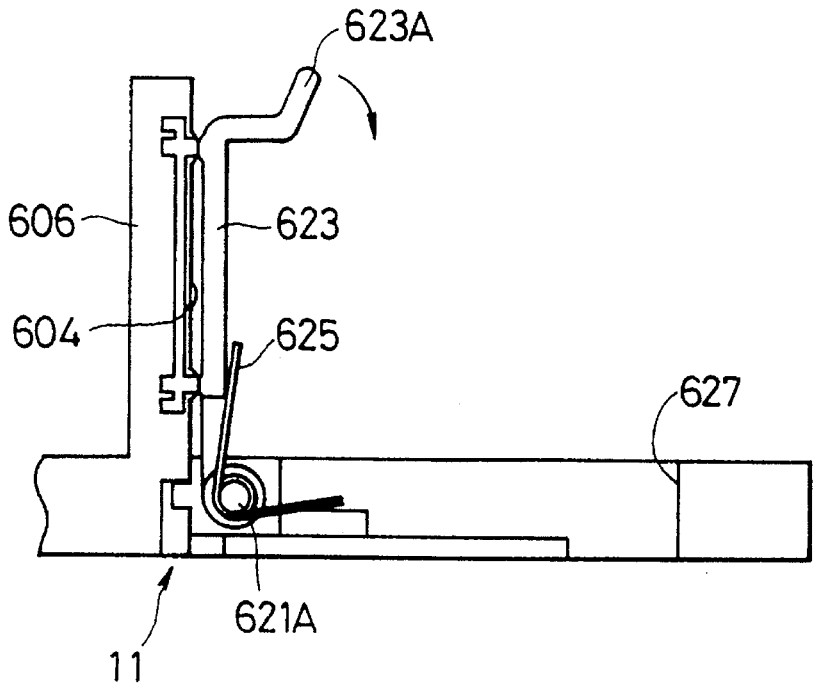
FIGS. 7A and 7B are side views showing the state of the printed board cover 623 before and after the head cartridge 9 is mounted on the head carriage.
Figure 7B:
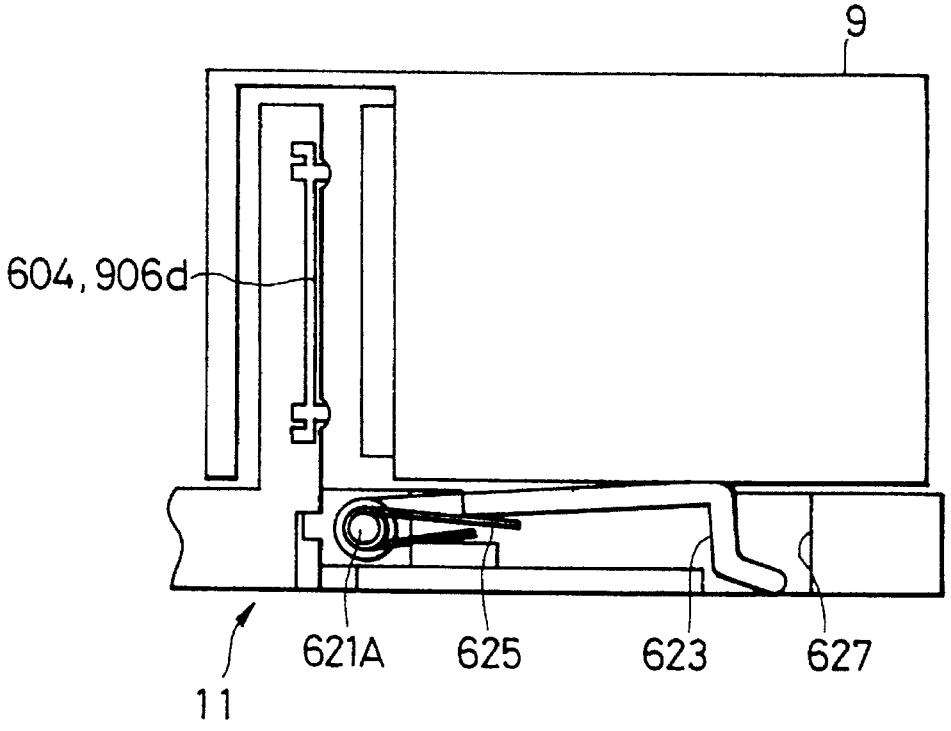

Next, the movement of the lid 623 will be described with reference to FIGS. 7A and 7B. When the head cartridge 9 is not loaded on the carriage 11, the lid 623 covers contacts of the flexible printed board 604 by means of the pressure of the spring 625 as shown in FIG. 7A. With this state of the lid 623, when the head cartridge 9 is introduced from the top of the carriage 11, in such a manner that the supporting plate 606 is inserted into the recess 906*f* of the head cartridge 9, the bottom of the head cartridge 9 or a hand of an operator pushes a lid manipulation portion 623A. This enables the lid 623 to rotate clockwise about the pins 621A against the pressure of the spring 625 as shown in FIG. 7A, thereby enabling the head cartridge 9 to be mounted. This is because the manipulation portion 623A is made slightly inclined outward, and hence such a force that separates lid 623 from the electric connecting portion acts on the manipulation portion 623A, when the head cartridge 9 is introduced from the top of the cartridge 11. Thus rotating the lid 623 clockwise about the pins 621A against the pressure of the spring 625 as shown in FIG. 7A. When the head cartridge 9 is completely installed on the carriage 11, the printed board 604 makes contact with the printed board 906*d* of the head cartridge 9, and the lid 623 is pressed by the bottom of the head cartridge 6 so as to be accommodated in the recessed portion 627 as shown in FIG. 7B. Conversely, when the head cartridge 9 is removed, the lid 623 returns to its original position by the pressure of the spring 625 as shown in FIG. 7A, and protects the printed board 604.

Thus, in this embodiment, the carriage 11 which works as a supporting member is provided with the lid 623 which interlocks with the attaching or detaching of the head cartridge 9, and covers the electric connecting portion to be connected to the recording head. This prevents the electric connecting portion from damages caused by electrostatic action, dust, external shock or the like, even when the head cartridge is separated from the carriage 11.

It is clear that the protection power against electrostatic action can be further improved by performing a special insulation processing on the interface between the lid 62 and the printed board. In addition, the carriage 11 may be provided with a damper that absorbs the shock produced when the lid 623 returns to its original position.

Incidentally, in this embodiment, the electric connecting portion is formed at an end of the flexible cable 21 in the form of the flexible printed board 604 which is unitarily formed with the flexible cable 21. The electric connecting portion, however, is not restricted to this form: for example, the electric connecting portion may consist of a flexible or rigid printed board which is separately provided from the flexible cable 21, and to which the flexible cable 21 is directly or indirectly connected.

Furthermore, the direction and operation of escape of the lid 623 can be determined arbitrarily as long as the lid 623 can escape from the space which it has occupied before the cartridge 11 is loaded. In addition, the manipulation portion 623*a*, which serves to escape the lid 623 when the cartridge 11 makes contact therewith, can take any shape.

Moreover, it is effective in this embodiment to mount the supporting plate 606 in the direction perpendicular to the scan direction of the carriage 11, and to guide the flexible printed board 609 from the bottom of the carriage 11 to the supporting plate 606. This is because the electric connecting portion consists of the flexible printed board 604 which is unitarily formed with the flat type flexible cable 21, and hence the above arrangement makes it possible for the flexible cable 21 to smoothly follow the movement of the carriage 11 without forming a folding portion in the flexible cable 21. The direction of the supporting plate 606 and/or the direction of guiding the flexible cable 21 to the supporting plate 606 can be arbitrary determined if a folding portion can be formed in the flexible cable 21 and/or if the flexible cable 21 can be connected, via another connecting member, to the electric connecting portion which is separately formed from the flexible cable 21.

Figure 7C:
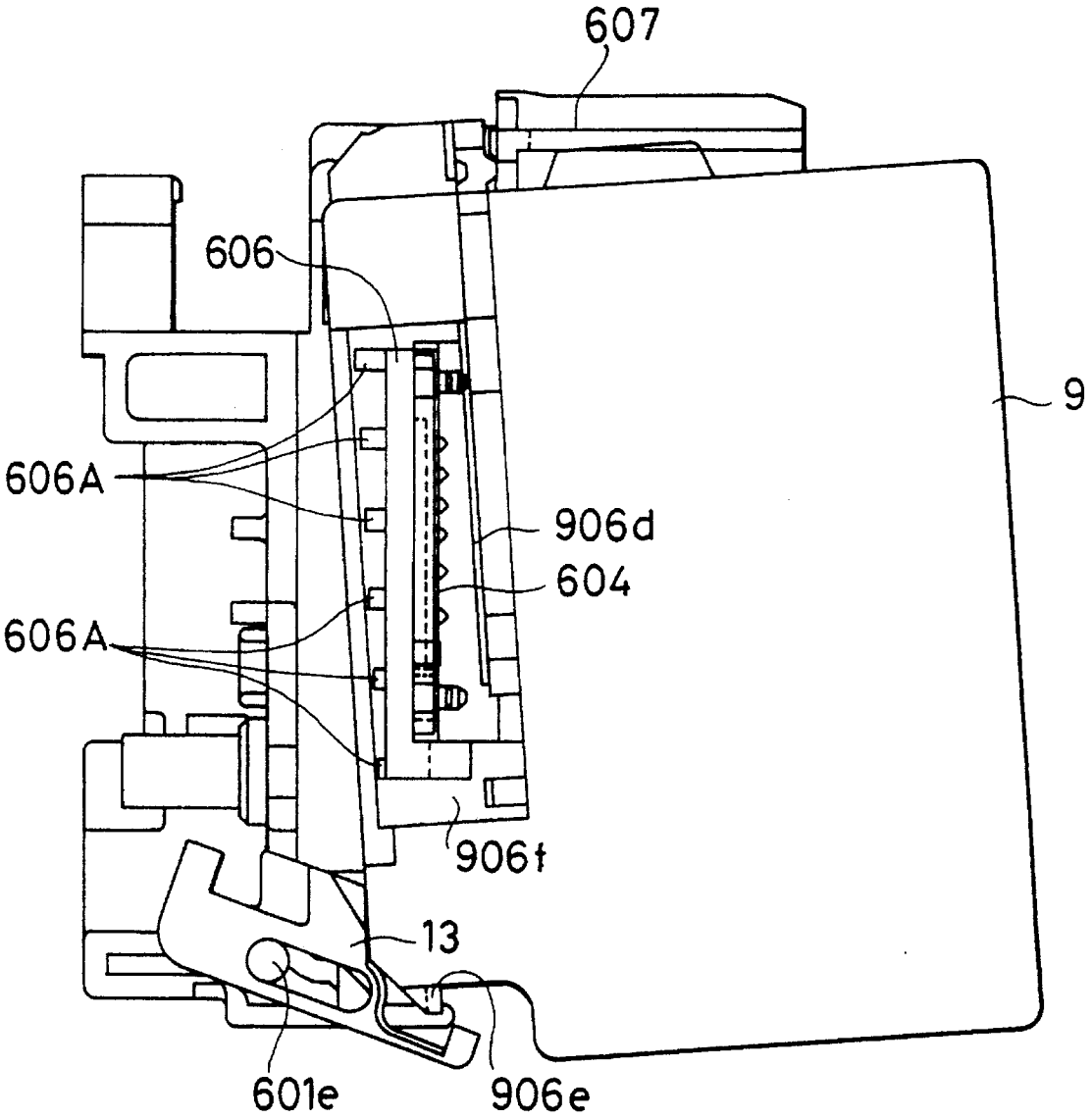
FIGS. 7C, 7D and 7E are plan views showing the state of the head cartridge 9 when it is mounted on the head carriage 11.
Figure 7D:
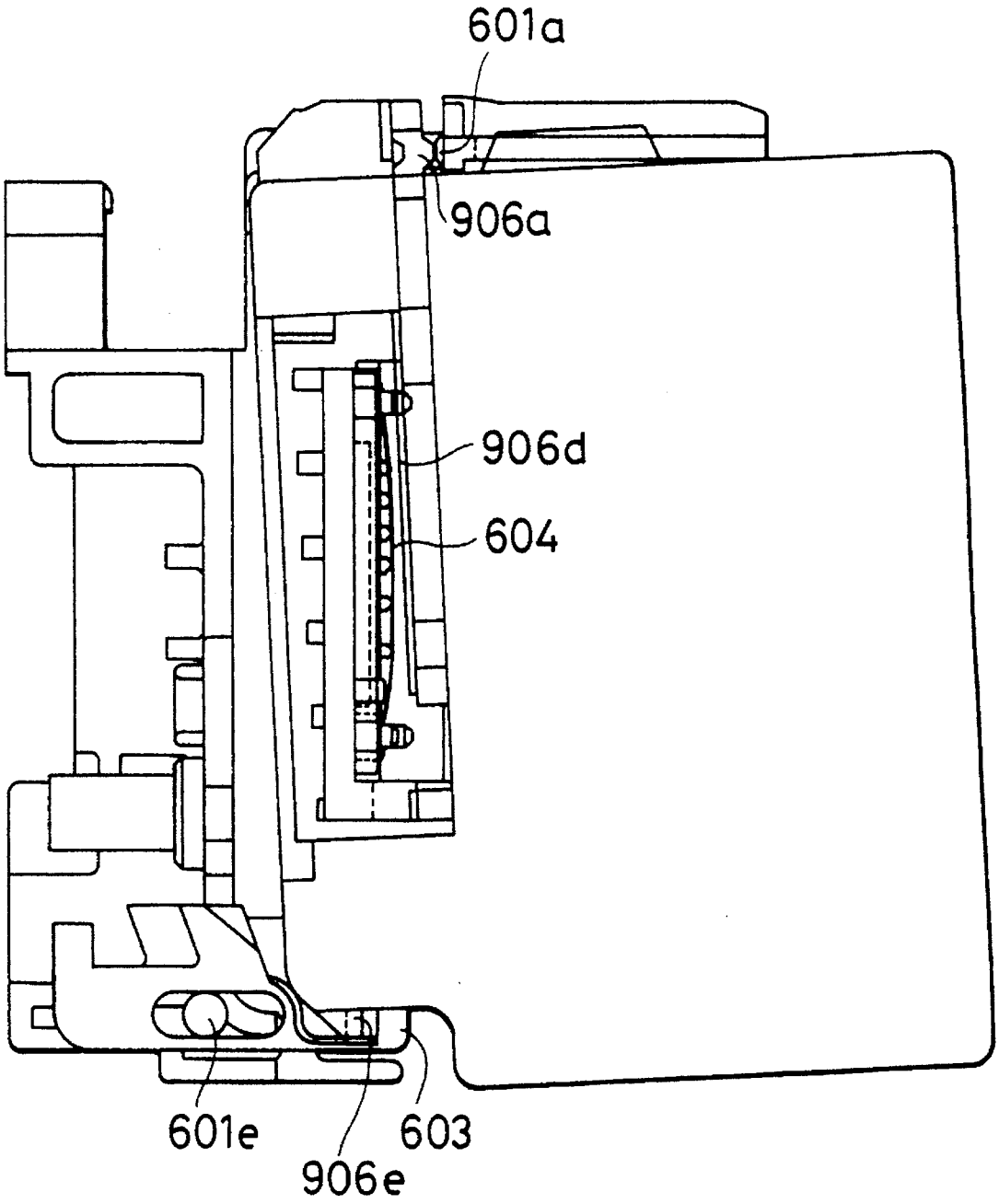
Figure 7E:
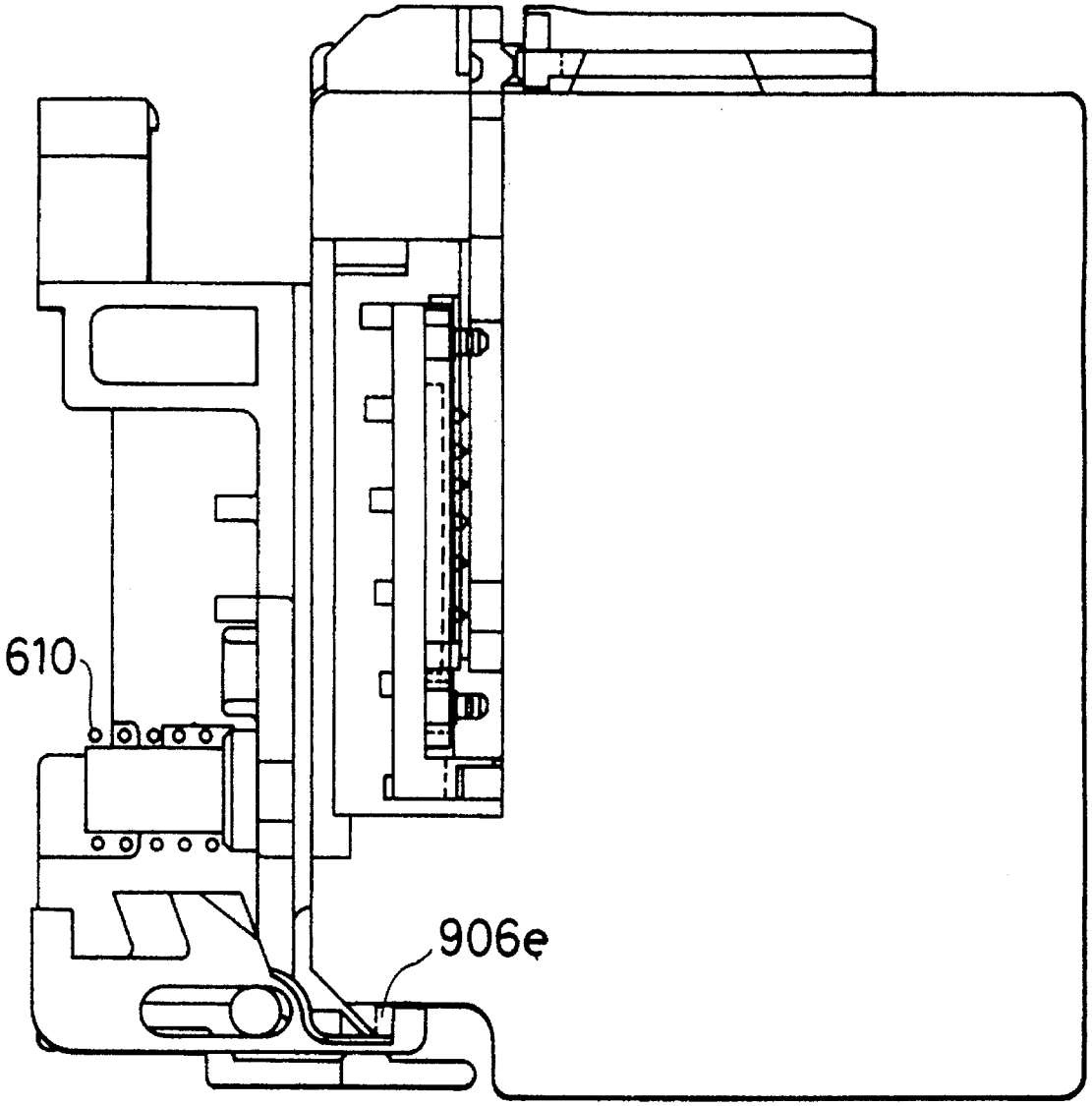

FIGS. 7C–7E are plan views showing the process of loading the head cartridge 9 on the carriage 11.

The head cartridge 9 is loaded on the carriage 11 from above so that the supporting plate 606 is inserted to the opening 906*f* of the head cartridge 9. In this process, the head cartridge 9 is placed on the carriage 11 in an oblique posture as shown in FIG. 7C because of the positional relationship among the stop member 607, supporting plate 606, ribs 606*a* and the hook 13, and the relationship between the total length of the head cartridge 9 and the opening 906*f*. In this case, the ribs 606*a* restrict the posture of the head cartridge 9.

Next, when the operation lever 15 is rotated counterclockwise in FIG. 5C, the hook 13 rotates counterclockwise about the guide shaft 601*e* in FIG. 7C, shifts to the left after it directs to the horizontal direction in FIG. 7C, and then takes a posture shown in FIG. 7D.

With the movement of the hook 13, the head cartridge 9 is pressed toward the upper left of FIG. 7D owing to the contact with the hook 13. Thus, the contact portions 906*a* of the head cartridge 9 moves onto the stop portions 601*a* of the carriage 11 until the contact portions 906*a* make contact with the stop portions 601*a*. So far, the printed board 906*d* and the flexible printed board 604 have not yet made contact.

When the operation lever 15 is further rotated counterclockwise in FIG. 5C, the hook 13 further moves to the left. In this process, the head cartridge 9 rotates clockwise about the contact portions 906*a* and 906*b* to take a posture shown in FIG. 7E because the hook 906*e* on the head cartridge 9 is being fixed to the hook 13 during the movement. Thus, the position of the head cartridge 9 on the carriage 11 is finally decided.

The lateral and vertical positions of the head cartridge 9 on the carriage 11 are simultaneously decided in the course of the loading process of the cartridge 9.

In the state as shown in FIG. 7E, the operation lever 15 is pressed to the left by the helical spring 610 provided in its rotating shaft as mentioned before. The pressure fastens the head cartridge 9 on the carriage 11 via the hook 13.

As will be clear from the above description, the loading of the recording head is based on the composition of the linear and rotational movement of the head cartridge 9, and the angle of rotation thereof is about 5 degrees. Such a small amount of the rotation angle makes it unnecessary to provide special space for loading the head cartridge 9.

Next, the relationship between the operation lever 15 and the hook 13 will be described with reference to FIGS. 5B and 6A.

As shown in these figures, the operation lever 15 is provided with a cam surface (slope portion) 602*c*, and two flat portions 602*a* and 602*b* at either end of the slope portion 602*c*. When the head cartridge 9 is fastened to the carriage 11 as shown in FIG. 7E, the flat portion 602*a* of the operation lever 15 engages a portion 603*a* of the hook 13 so as to transmit force to the hook 13.

The relationship between the lever 15 and the hook 13 is described referring to the process for removing the head cartridge 9 from the carriage 11. When the lever 15 is rotated from the state shown in FIG. 6A in the direction opposite to the direction in the loading process, the cam surface 602*c* of the lever 15 rotates making contact with the cam surface 603*b* of the hook 13. In the course of this, the hook 13 shifts to the right until the left-hand end of the slot 603*c* strikes the guide shaft 601*e* of the carriage 11, and then rotates clockwise about the shaft 601*e* until the flat portion 602*b* of the lever 15 makes contact with the surface 603*b* of the hook 13. Thus, the hook 13 takes a posture as shown in FIG. 5B when the flat portion 602*b* of the lever 15 strikes the cam surface 603*b* of the hook 13.

In the process from FIG. 6A to FIG. 5B, the head cartridge 9 is ejected by a portion 603*d* of the hook 13.

RECORDING PAPER TRANSMISSION MECHANISM

Figure 8A:
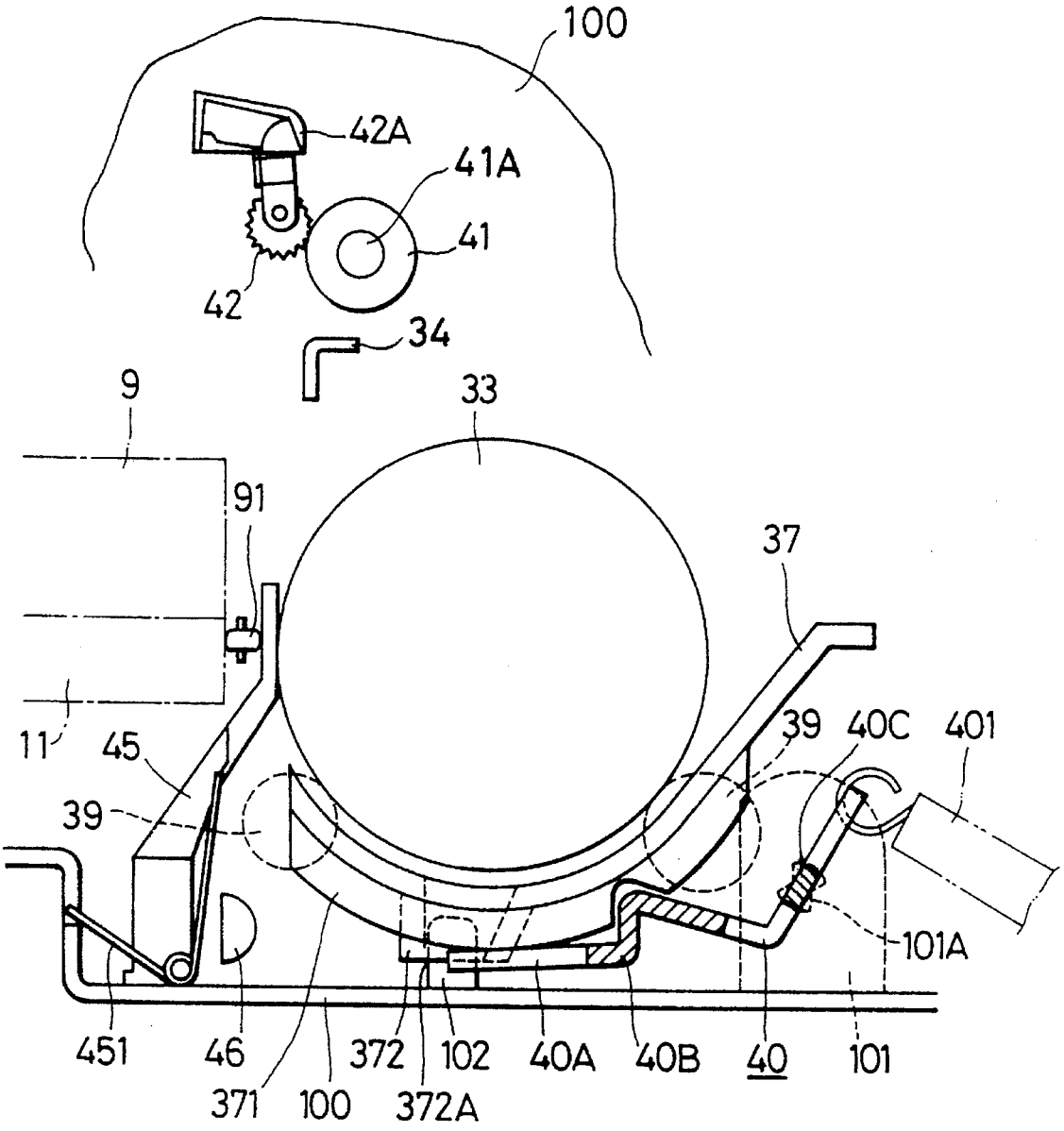
FIGS. 8A and 8B are a sectional side view and an exploded plan view showing an arrangement of a recording medium transport system of the printer shown in FIG. 2, respectively.

FIG. 8A is a schematic side view of recording paper transport system of the apparatus shown in FIG. 2 and so forth. It illustrates the arrangement of the various elements of the recording paper transport system in the normal operation thereof. The recording paper is fed from the paper tray not shown, and is introduced to the conveying path which is formed between the transport roller 33 and the paper pan 37. When the transport roller 33 rotates clockwise, the recording paper is passed thereto and is transmitted through the conveying path by the friction between the transport roller 33 and the recording paper. Then the recording paper is introduced between the transport roller 33 and the paper pressure plate 45, and is transmitted by the rotation of the transport roller 33 and the friction between the transport roller 33 and the recording paper, the paper pressure plate 45 pressing the recording paper to the transport roller 33 so that the friction is produced. Subsequently, the recording paper is transmitted along the platen 34 with its transmission direction being controlled by the pressure plate 45, and is introduced between the feed-out rollers 41 and the spur wheels 42. During this process, the recording paper undergoes recording by ink ejected from the head cartridge 9.

Figure 8B:
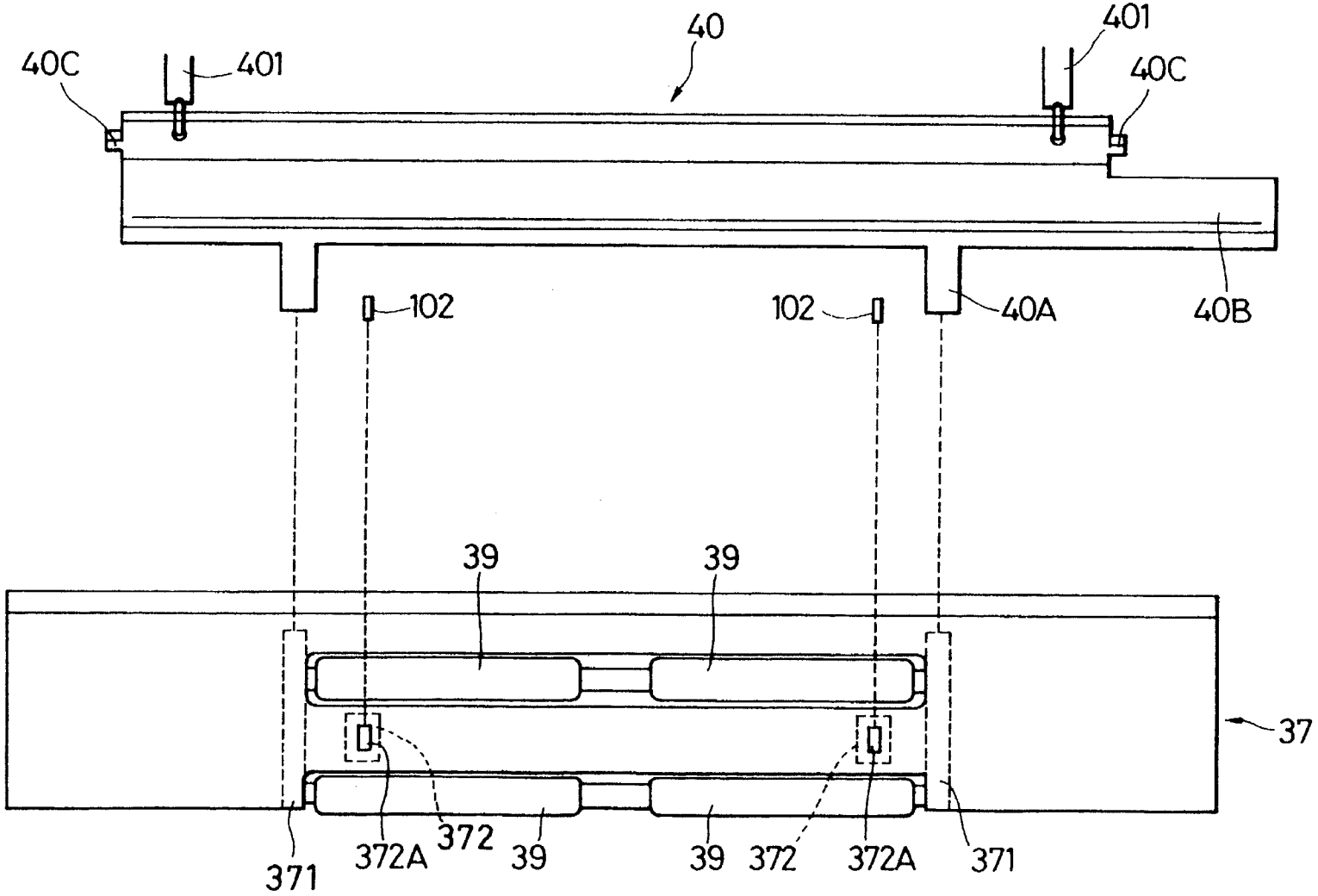

FIG. 8B is a plan view showing the paper pan 37 and a release plate 40 for pressing the paper pan 37 towards the transport roller 33, which are shown separately for the convenience of description.

The recording paper transport system will be described with reference to FIGS. 8A and 8B. In these figures, the release plate 40 is provided for pressing the feed rollers 39 provided on the paper pan 37 on the transport roller 33 via the paper pan 37, or reversely, releasing the pressure. More specifically, the release plate 40 is rotatably mounted to a release plate pivot member 101 erected on the bottom plate 100 of the apparatus: on the two edges of the release plate 40, are formed pivot portions 40C each of which is inserted freely into a pivot hole 101A formed in the release plate pivot member 101. In addition, the release plate 40 is drawn to the right and downward as shown FIG. 8A by springs 401 each of which is attached to the end portion of the release plate 40. Thus, the release plate 40 rotates clockwise in FIG. 8A about the pivot portions 40C. Beneath the paper pan 37, are provided two ribs 371 that make contact with pressure portions 40A of the release plate 40 when the release plate 40 rotates. Thus, the feed rollers 39 the ends of which are supported by the two ribs 371 are pressed on the transport roller 33.

As will be described later with reference to FIG. 10B, the pressure by the release plate 40 is released by depressing a shoulder portion 40B of the release plate 40 downward in FIG. 8A against the force exerted by the spring 401, the shoulder portion 40B longitudinally extending in the release plate 40. When the pressure is released, the paper pan 37 together with the feed roller 39 move downward by their own weight, thus forming a gap of a predetermined width between the feed rollers 39 and the transport roller 33.

On the paper pan 37, are provided two rectangular projections 372 that protrude downward. In each of the projections 372, a rectangular slot 372A is formed. To each slot 372A, a protrusion 102 erected on the bottom plate 100 corresponding to the slot 372A is fitted with a certain looseness. Thus, the positioning of the paper pan 37, or the positioning of the feed roller 39 with regard to the transport roller 33 is performed.

The loose fit can eliminate the adverse effect by a "kick" of recording paper, which occurs when the rear edge of the recording paper escapes from the pressure produced by the feed rollers 39 and the transport roller 33. This will be described in more detail with reference to FIGS. 9A and 9B.

Figures 9A, 9B:
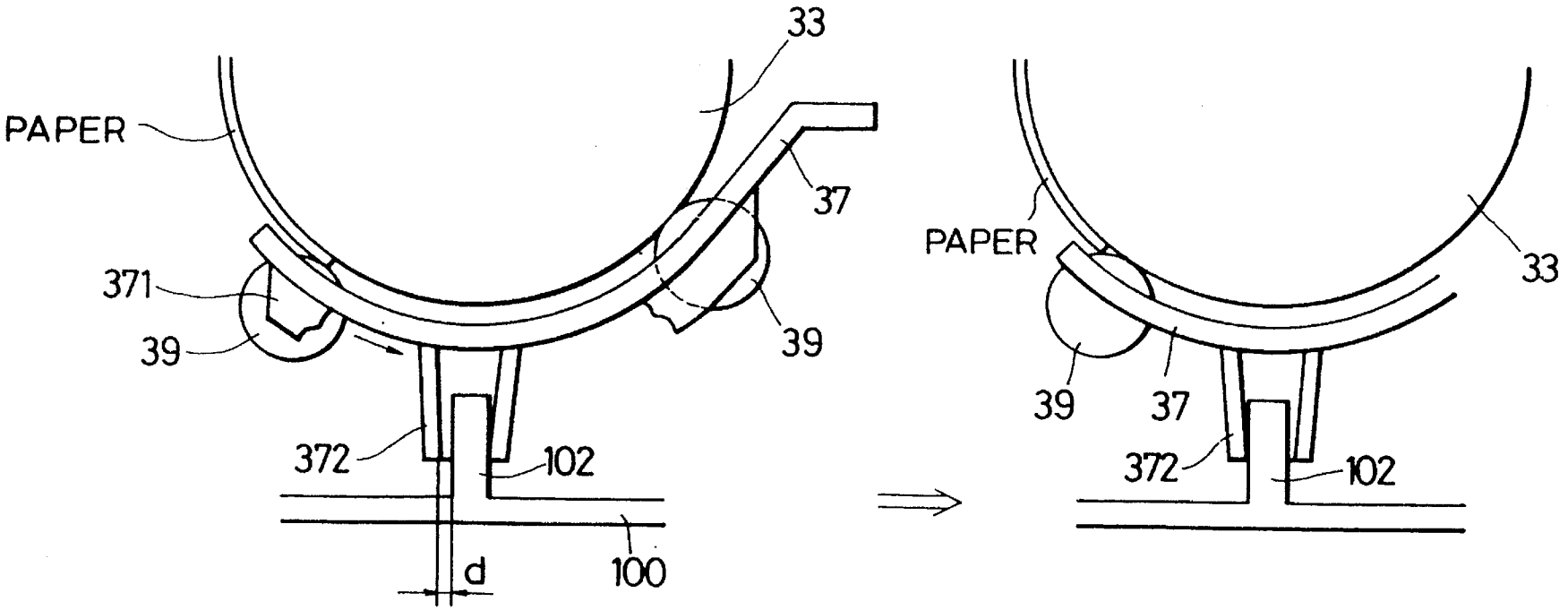
FIGS. 9A and 9B are schematic side views showing the mechanism for escaping the feed rollers in the recording medium transport system.

FIG. 9A illustrates the state in which the rear end of the recording paper is pressed on the transport roller 33 by the feed rollers 39, and FIG. 9B illustrates the state in which the recording paper escapes from the rollers and in which the feed rollers 39 make contact with the transport roller 33. During this process, the recording paper is pushed out of the gap between the feed rollers 39 and the transport roller 33. In conventional apparatuses, the so called "kick" phenomenon may occur when a thick recording paper such as an envelope or thick paper is pushed out, thereby exerting interactive force between the recording paper and the feed rollers 39.

Figure 9C:
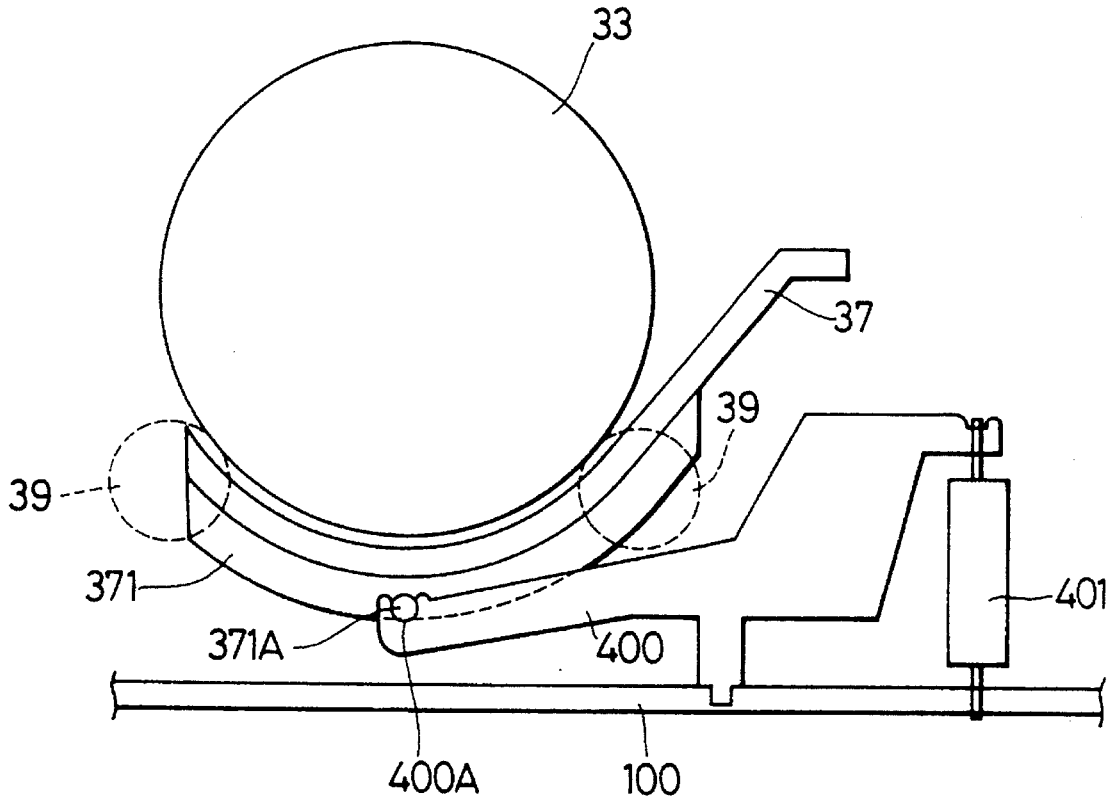
FIG. 9C (PRIOR ART)
FIG. 9C is a schematic side view showing a conventional mechanism for pressing the feed rollers.

FIG. 9C shows a conventional arrangement for supporting the paper pan 37. The paper pan 37 is supported by engage portions 400A of the pressure member 400 so that bosses 371A on the paper pan 37 cannot escape in the lateral direction (in the left-to-right direction in FIG. 9C). As a result, the feed rollers 39 cannot escape in the direction opposite to the push out direction of the recording paper being pushed out, which gives the transport roller 33 extra rotation when the recording paper is pushed out. This may present a problem that the recording position on the recording paper deviates from the correct position.

In contrast with this, in the present embodiment shown in FIGS. 8A and 9A, each of the protrusions 102 fits loosely to the slot 372A of each of the projection 372 so that the paper pan 37 can escape to the right in FIG. 9A by the length d caused when the rear edge of the recording paper is pushed out. Thus, the forces produced by the push out are not exerted on the recording paper or the transport roller 33, obviating the above mentioned problem. As a result, the recording position on the recording paper does not deviate.

Referring to FIG. 8A again, the paper pressure plate 45 is pressed towards the transport roller 33 by two helical torsion springs 451, which are provided in the vicinity of the ends of the paper pressure plate 45. One end of each spring 451, which directly extends from the helical portion of the spring 451, presses a part of the paper pressure plate 45, and the other end is attached to a part of the bottom plate 100. The helical portion of the spring 451 is pivoted on a part of the bottom plate 100. The paper pressure plate 45 is also depressed by the carriage 11 via a roller 91 which is mounted on the forward end of the carriage 11 as will be described later. The distance between the ejection outlets of the head cartridge 9 and the recorded surface on the recording paper is maintained at a correct length by the pressure of the spring 451 and the roller 91.

The pressure by the paper pressure plate 45 also acts on the transport roller 33 via the recording paper, which causes friction between the recording paper and the transport roller 33, the friction being used to convey the recording paper.

To achieve a smooth transportation for various types of recording paper, the friction between the paper pressure plate 45 and the recording paper, and the friction between the transport roller 33 and the recording paper must be adjusted to an appropriate magnitude, respectively, regardless of a kind of recording paper used: it is preferable that the former be made as small as possible and the latter be made as large as possible.

In addition, it is preferable that the friction between the paper pressure plate 45 and the transport roller 33 be made as small as possible. This is because the increase in the friction force increases the load on the motor 53 when "nonfeeding" of paper is performed in which the transport roller 33 is rotated without carrying recording paper in proportion to the amount of rotation. Furthermore, if a gap is provided between the paper pressure plate 45 and the transport roller 33 to avoid this, the precision control with regard to the pressure of the recording paper on the transport roller 33 becomes difficult.

Therefore, in this embodiment, the paper pressure plate 45 is made of POM (polyacetal), and the transport roller 33 is made of CR (chloroprene rubber, hardness 60°/A scale) that contains 5–10 wt % of nylon resin single fiber. The paper pressure plate may be made of fluorine resin.

Incidentally, the hardness of the chloroprene rubber is not restricted to 60°: it can be determined at any value from 50° to 70° without hindering the transmission of the recording paper. Furthermore, it is not necessary that the entire transport roller 33 or the paper pressure plate 45 is made of the above-mentioned materials: Only the surface of the transport roller 33 or the contact portion of the paper pressure plate 45 may be made of the above-mentioned materials, for example, the transport roller 33 or the paper pressure plate 45 can be formed by sticking the sheets made of the above-mentioned materials on a roller or a plate.

The paper pressure plate 45 and the transport roller 33 made of the above-mentioned materials can reduce the friction between the paper pressure plate 45 and the recording paper. This enables the paper pressure plate 45 to exert pressure on the transport roller 33. As a result, the gap size between the recording paper and the head cartridge 9 can be more easily controlled than in the conventional apparatus which cannot adopt the arrangement in which the paper pressure plate 45 presses the transport roller 33 via the recording paper for handling recording paper of various thickness. In addition, since the friction coefficient between the recording paper and the transport roller 33 is large, the transmission of the recording paper can be carried out smoothly without a slip therebetween.

In FIG. 8A, reference numeral 46 designates a shaft which has a D-like section and extends in parallel with the paper pressure plate 45, and the ends of which are supported by the frame 100 of the apparatus. The shaft 46 rotates so that the spring 451 engages or disengages the paper pressure plate 45: when the recording paper is conveyed, the shaft 46 is turned so that the flat portion thereof becomes vertical as shown in FIG. 8A in order to engage the spring 451 with the paper pressure plate 45; on the other hand, when the pressure on the transport roller 33 by the paper pressure plate 45 should be released, the shaft 46 is turned so that the flat portion thereof becomes horizontal as shown in FIGS. 10B and 11B in order to press and deform the spring 451 and disengage the spring 451 from the paper pressure plate 45. Thus, the pressure acting on the paper pressure plate 45 is released without changing its position.

As a result of releasing the pressure only, even if the carriage 11 operates in this state for inserting the recording paper or for other purposes, damage of the head cartridge 9, the carriage 11, or the like, which otherwise would be caused by the interference between the head cartridge 9, the carriage 11, and the paper pressure plate 45, can be prevented. In other words, various operations involving the shift of the carriage 11 are possible when the pressure on the paper pressure plate 45 is released. Incidentally, although the pressure of the roller 91 on the paper pressure plate 45 is not released in this case, the pressure does not hinder the insertion of the recording paper because the pressure acts on only one point on the paper pressure plate 45 facing the carriage 11.

The feed-out rollers in FIG. 8A are mounted on a shaft 41A at fixed intervals as shown in FIG. 2: the total of six feed-out rollers are mounted on the shaft 41A which extends longitudinally in parallel with the platen 34. The feed-out rollers 41 engage the corresponding spur wheels 42 which are supported by a supporting member 42A extending in parallel with the shaft 41A. Each spur wheel 42 is pressed on the feed-out roller 41 by a pressure means as shown in FIGS. 10A–11B. Thus, the recording paper is conveyed by the friction established between the recording paper and the feed-out roller 41 by the pressure. The spur wheels 42 are pressed on the feed-out rollers 41 via supporting member 42A as mentioned above, or on the contrary, the spur wheels 42 to be disengaged from the feed-out rollers 41. Incidentally, the shaft 41A is rotatably supported by the frame 100 of the apparatus.

Figure 8C:
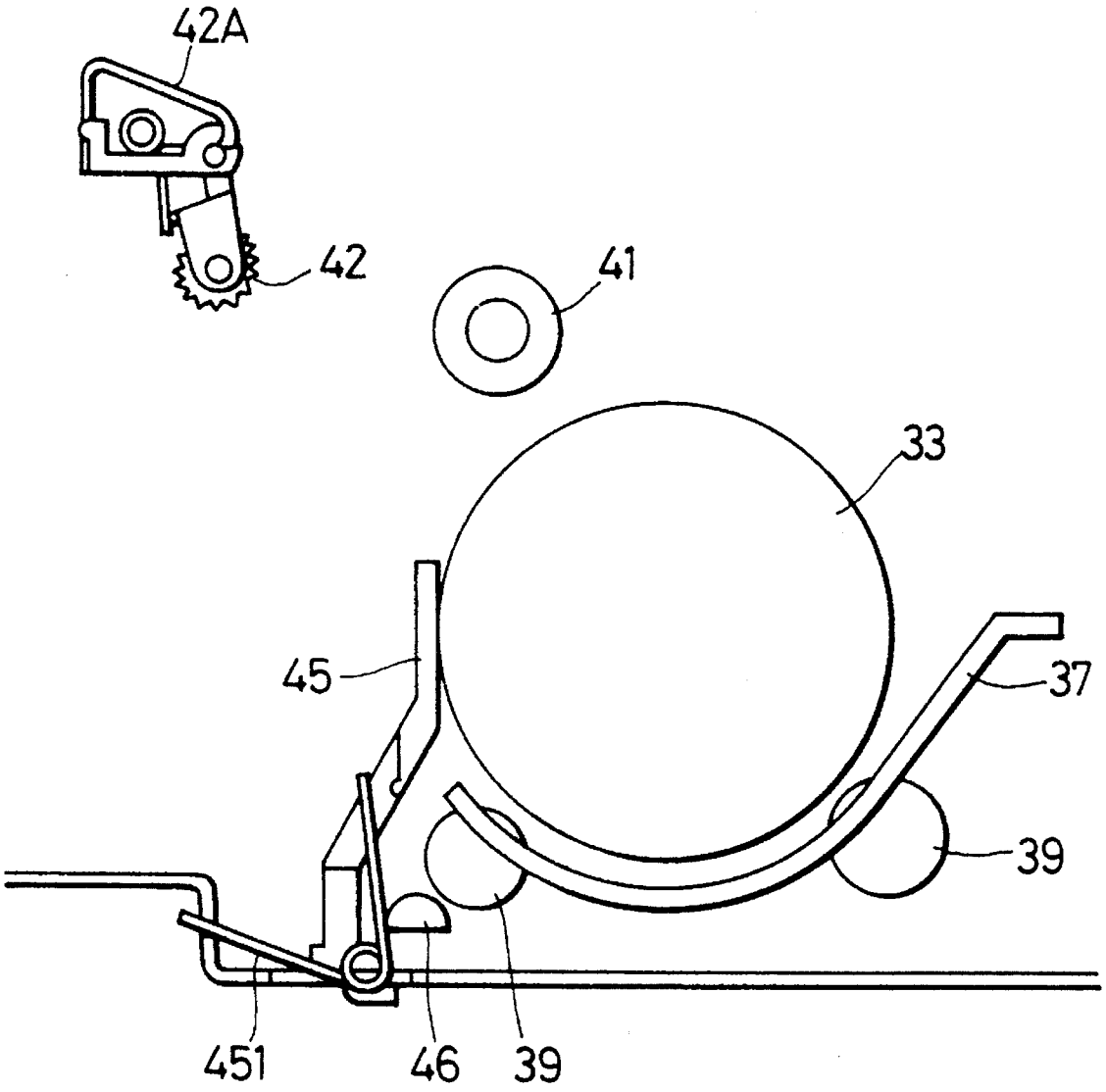
FIG. 8C is a sectional side view showing an arrangement of the recording medium transport system when various forces acting thereon are released.

The paper pan 37 (together with the feed rollers 39), paper pressure plate 45, and the spur wheels 42 are released from the pressure state in their different manner. The releases of these elements, however, are carried out simultaneously by the operation of the release lever 43 shown in FIG. 2, thus resulting in the state as shown in FIG. 8C.

Figure 10A:
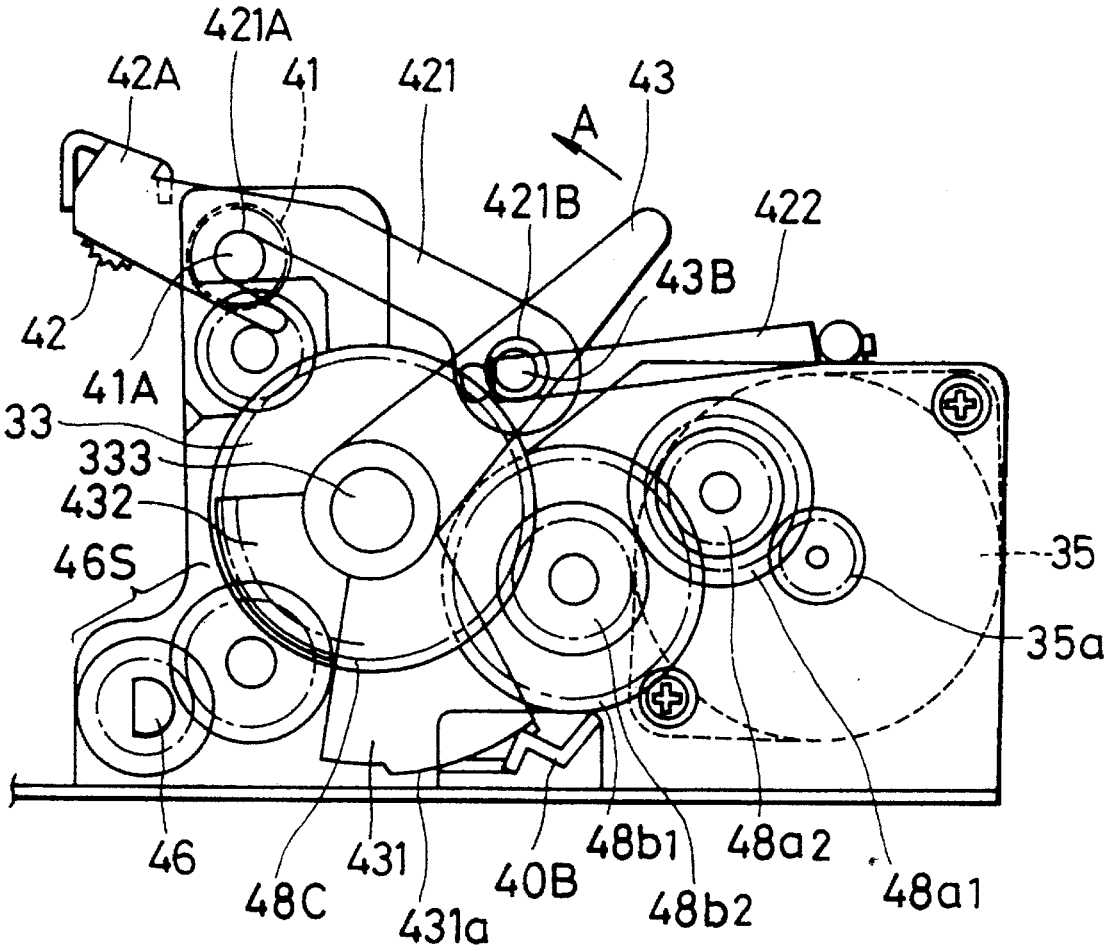
FIGS. 10A and 10B are side views showing the right hand side portion of the mechanism for releasing the forces acting on the feed rollers, the paper pressure plate and spur wheels in the transport system before and after the release.
Figure 10B:
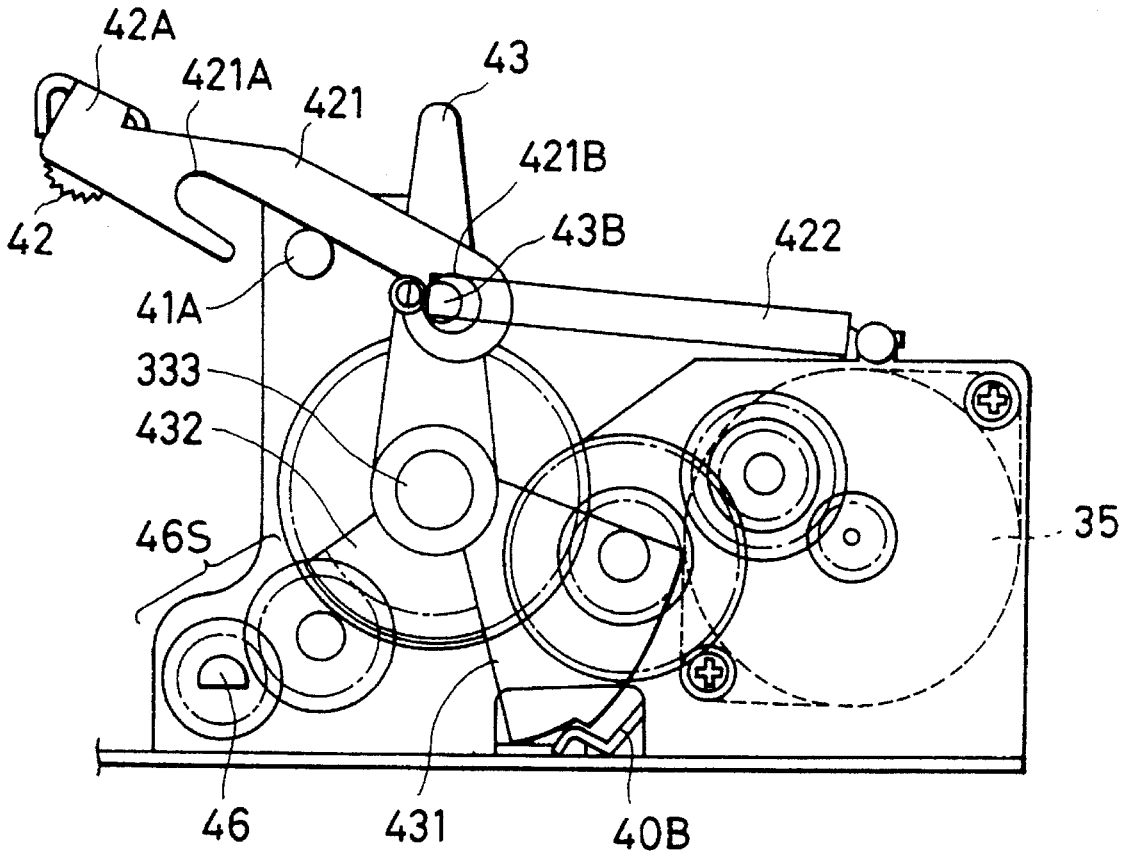
Figure 11A:
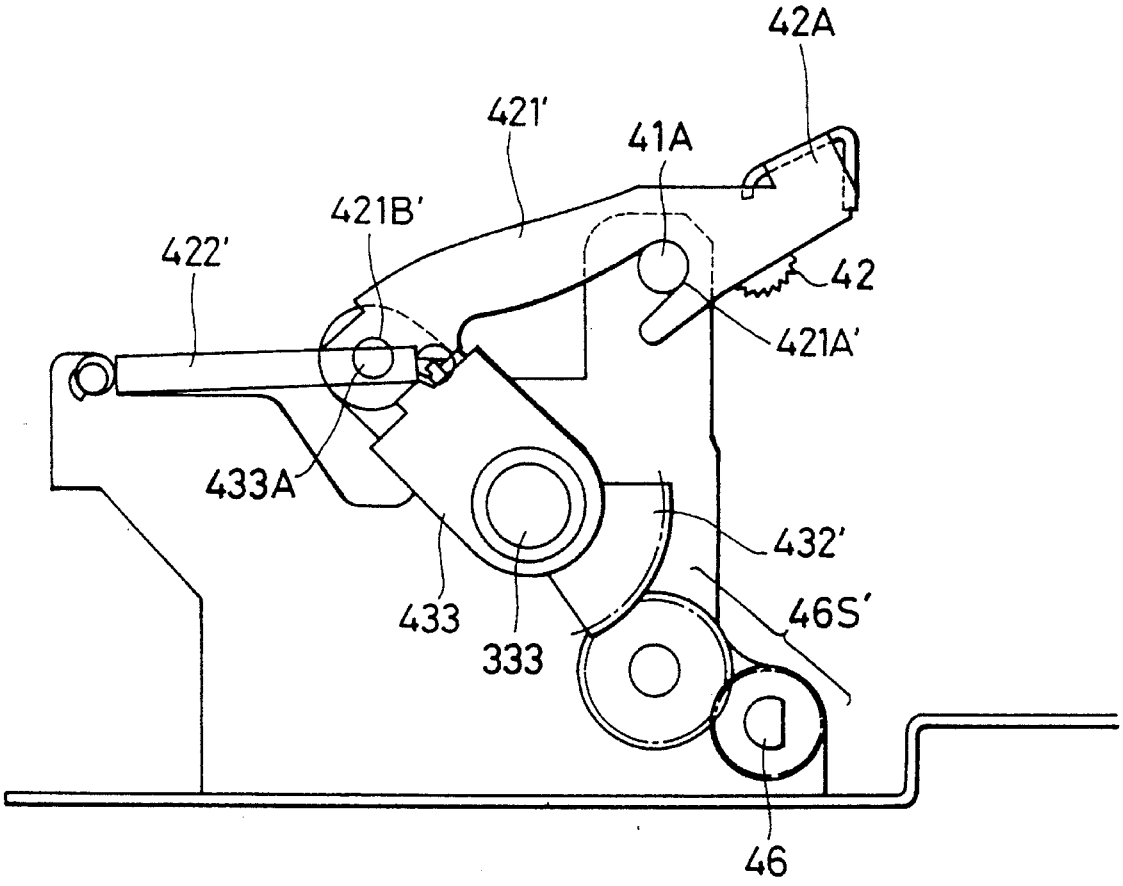
FIGS. 11A and 11B are side views showing the left hand side portion of the mechanism for releasing before and after the release.
Figure 11B:
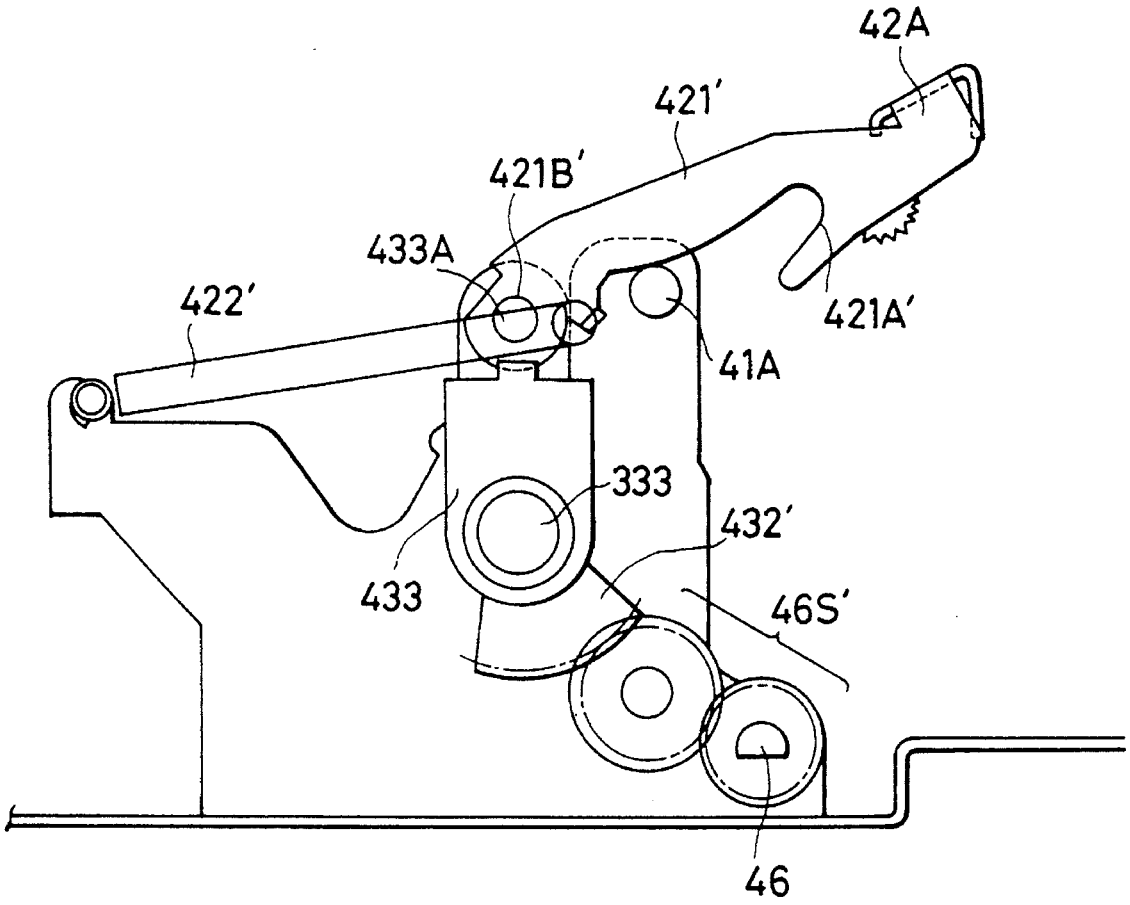

FIGS. 10A, 10B, 11A and 11B show a mechanism for releasing the above-mentioned pressure states. FIGS. 10A and 10B are side views looking towards the right of the record apparatus, while FIGS. 11A and 11B are side views looking towards the left thereof.

FIGS. 10A and 11A show the normal state in which the pressures are not released as when the recording paper is conveyed. In FIG. 10A, which illustrates the right-hand side of the apparatus in this state, the release lever 43 is rotatably mounted on the axis 333 of the transport roller 33, and is obliquely drawn by the force of a spring described below. To the lever 43, are attached a cam 431 and a gear 432. The gear 432 engages a gear train 46*s* consisting of two gears: one of the two gears engages the gear 432; and the other gear is mounted on a shaft 46. A part of the cam 431 attached to the level 43 engages the shoulder portion 40B of the release plate 40. In addition, a spur wheel arm 421 extending from the spur wheel supporting member 42A is rotatably attached to the lever 43 via a fitting hole 421B that fits to a fitting projection 43B of the level 43, and is pulled towards the back of the apparatus (to the right hand side in FIG. 10A) by a spring 422 which is attached to the lever 43 to pull it clockwise. In this state, a fitting groove 421A formed in the spur wheel arm 421 engages a shaft 41A of the feed-out rollers 41. This enables the spur wheels 42 and the feed-out rollers 41 to make contact with exerting appropriate pressure each other.

FIG. 11A, on the other hand, shows the left side of the apparatus in the normal state. At this side, a link plate 433 is rotatably mounted on the end portion of the axis 333 of the transport roller 33, and a fitting projection 433A at an end of the link plate 433 engages a fitting hole 421B' of the spur wheel arm 421'. The link plate 433 is pulled counterclockwise by a spring 422' connected to a part of the link plate 433. Accordingly, the spur wheel arm 421' is pulled toward the back of the apparatus (to the left in FIG. 11A). In this state, a fitting groove 421A' formed in the spur wheel arm 421' engages a shaft 41A of the feed-out rollers 41. This makes it possible to attain appropriate positional relationship and pressure between the spur wheels 42 and the feed-out rollers 41 as described with reference to FIG. 10A. A gear 432' attached to the other end of the link plate 433 engages one of the two gears constituting a gear train 46S' which is a counterpart of the gear train 46S in FIG. 10A.

In FIG. 10A, a connecting hole 421B has a larger diameter than that of the connecting projection 43B, therefore the spur wheel arm 421 and the release lever 43 are fixed with a predetermined looseness. As a result, appropriate engagements of the spur wheels 42 and the feed-out rollers 41 can be achieved without requiring a high level accuracy of the shape or the like of the spur wheel arm 421.

The rotation of the release lever 43 is transmitted to the shaft 46 through the gear 432 and the gear train 46*s*. The rotation of the release lever 43 is further transmitted, at the left-hand end of the apparatus (see FIG. 11A), from the shaft 46 to the link member 433 through the gear train 46*s*' and the gear 432', and then moves the spur wheel arm 421'. The backlash between gears is absorbed by the connecting portions 421B having the looseness.

The members that are released in the above arrangement are not necessarily spur wheels: any roller-like member that fits the recording paper can be used regardless of its form.

FIGS. 10B and 11B show the state in which the pressures caused by the spur wheel 42, paper pressure plate 45 and the paper pan 37 are released. The releases are carried out by rotating the release lever 43 forward against the drawing force of the spring 422.

More specifically, the counterclockwise (the direction of arrow A in FIG. 10A) rotation of the release lever 43 caused by hand operation of a operator rotates the gear 432. At the same time, the shaft 46 is also rotated through the gear train 46*s* as described above so that the flat portion of the shaft 46 turns downward. In this state, the shaft 46 presses the spring 451 to be compressed as described above with reference to FIG. 8A, thereby to release the engagement between the spring 451 and the paper pressure plate 45. Thus, the pressure on the transport roller 33 by the paper pressure plate 45 is released.

The counterclockwise rotation of the release lever 43 as described above further rotates the cam 431. The cam surface 431*a* of the cam 431 keeps contact with the shoulder portion 40B of the release plate 40 as described before with reference to FIG. 8A, and hence the release plate 40 lowers its position as the cam 431 rotates. Thus the pressure portion 40A no longer presses the ribs 371. As a result, the force that pressed the paper pan 37 (or the feed rollers 39) on the transport roller 33 is released so that the paper pan 37 goes down by its own weight. And finally, as shown in FIG. 10B, the shoulder portion 40B engages the notch of the cam 431 as the release lever 43 further rotates. Thus, the position of the engagement and that of the release lever 43 are fixed.

During this process, the spur wheel arm 421 moves forward of the-apparatus as the release lever 43 rotates. More specifically, the spur wheel arm 421' at the left end of the apparatus (FIG. 11A) is moved forward by the transmission of the rotation through the shaft 46. Thus, the spur wheel supporting member 42A which is linked with the spur wheel arms 421 and 421' shifts forward of the apparatus, and hence the engagement between the spur wheels 42 and the feed-out rollers 41 is released.

As described above, one rotation of the release lever 43 enables the pressures of the paper pan 37, paper pressure plate 45, and the spur wheels 42 to release with a simple arrangement.

Incidentally, the paper pan 37 is supported by the contact with the release plate 40, and the fit between the protrusions 102 on the bottom plate (frame) 100 of the apparatus and the slots 372A in the paper pan 37 in this embodiment. However, the paper pan 37 can be supported by other arrangements. For example, the arrangement as shown in FIG. 9C can be used with a minor change: the engage portions 400A are modified to slots so that the paper pan 37 can escape in the longitudinal direction of the slots. In FIG. 10A, a reference numeral 35*a* designates a rotational shaft of the motor 35, the rotation of the shaft 35*a* is transmitted to the transport roller 33 via gears 48*a*1, 48*b*1, 48*b*2 and 48*c*.

Figure 12:
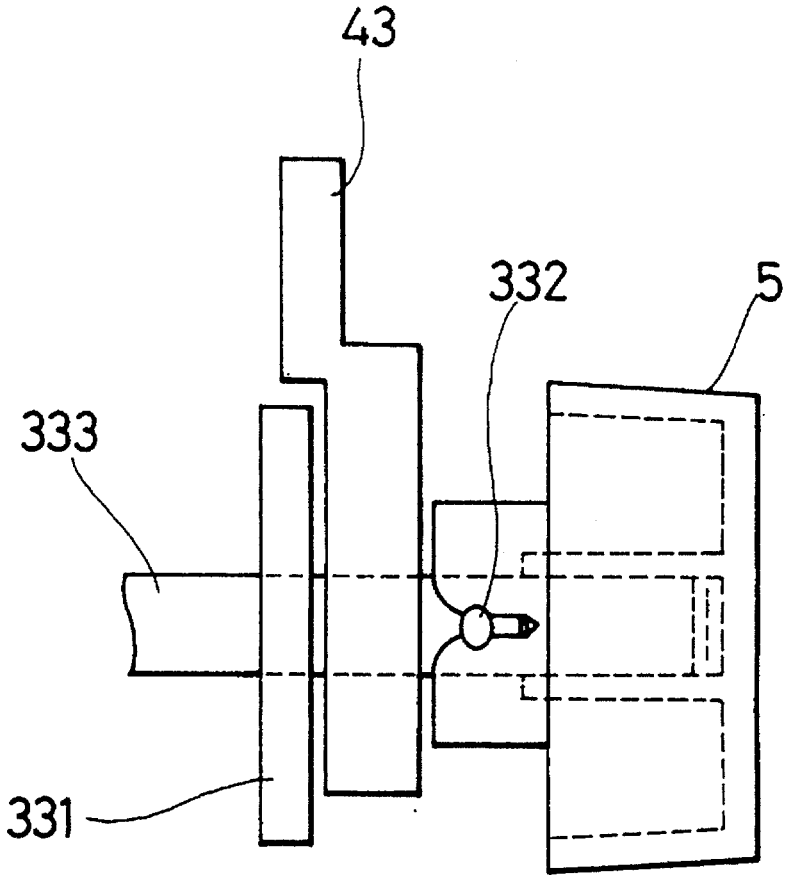
FIG. 12 is a schematic front view showing the engagement of the lever 43 and the knob 5 for releasing the mechanism.
Figure 13:
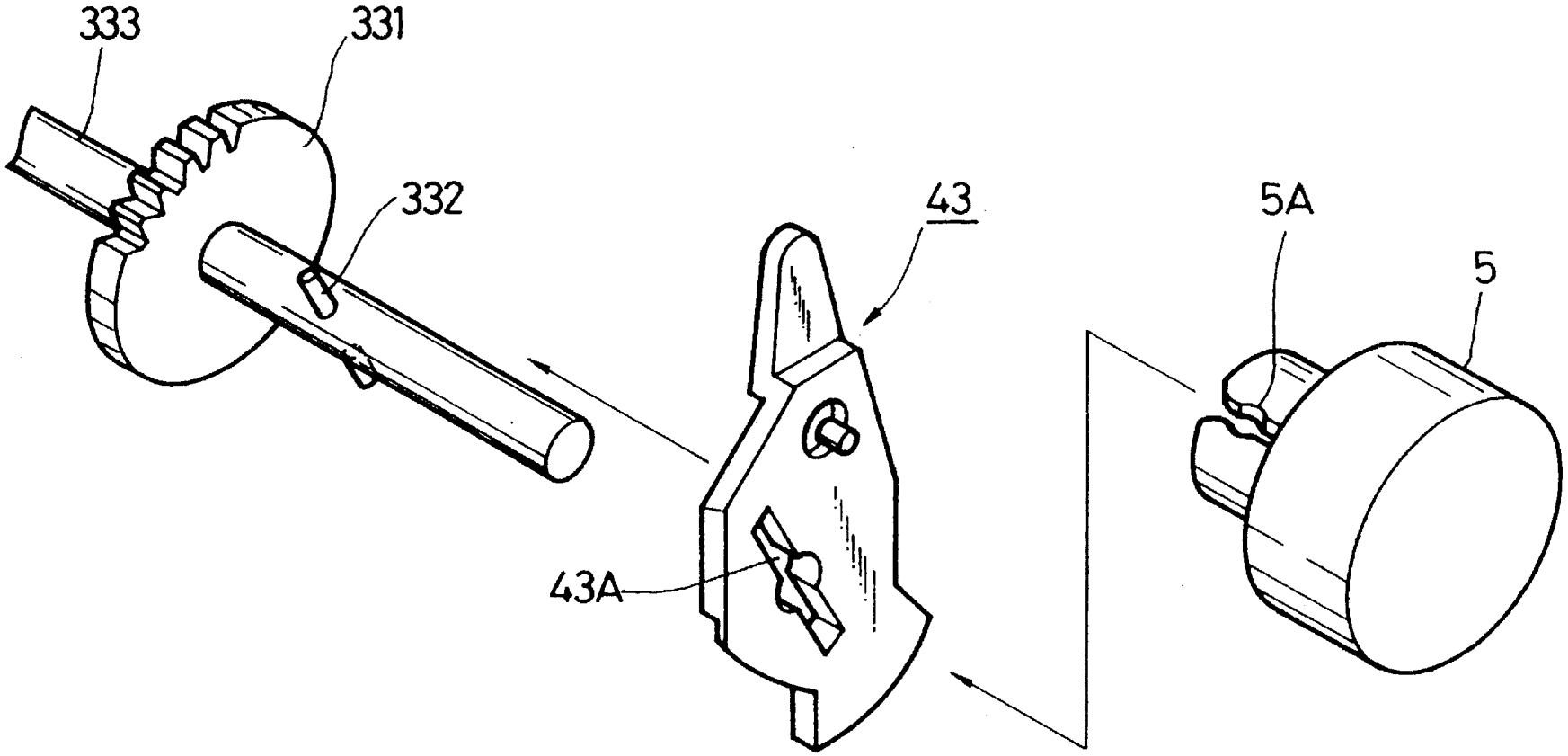
FIG. 13 is an exploded perspective view of the mechanism shown in FIG. 12.

FIG. 12 is a schematic front view showing the assembled state of the knob 5 attached to the axis of transport roller 33, and the release lever 43, and FIG. 13 is a schematic exploded perspective view thereof. The knob 5 is provided at the right hand end of the apparatus like the release lever 43 to enable an operator to rotate it for driving the transport roller 33 and to transmit the recording paper.

In FIG. 12, a driven gear 331 for driving the transport roller 33 is mounted on the shaft 333 of the transport roller 33. The knob 5 is attached to the shaft 333 by a spring pin 332 driven into the shaft 333. The release lever 43 is rotatably mounted on the shaft 333 between the driven gear 331 and the knob 5, but the rotation is restricted by the above-mentioned springs or the like.

FIG. 13 is a view for explaining the assembly sequence of the construction shown in FIG. 12. As shown in this figure, the spring pin 332 is driven into the shaft 333 beforehand, and the gear 331 is mounted on the shaft 333. Then, the release lever 43 is mounted on the shaft 333 through an opening 43A. The opening 43A has such a shape that can pass the shaft 333 and the spring pin 332 as shown in FIG. 13. Thus, the release lever 43 can shift toward the gear 331 beyond the spring pin 332. Subsequently, the shaft 333 is inserted into the knob 5, which is fastened to the shaft 333 by fitting the spring pin to the hole 5A.

According to this arrangement, the axial movement of the release lever 43 is restricted by the gear 331 and the knob 5, and the knob 5 is fixed by the pin spring 332. Furthermore, driving the spring pin 332 into the shaft 333 beforehand makes the assembly easier than assembling it in the reverse sequence, that is, first mounting the release lever on the shaft 333, and then driving the spring pin into the shaft 333.

Figure 14:
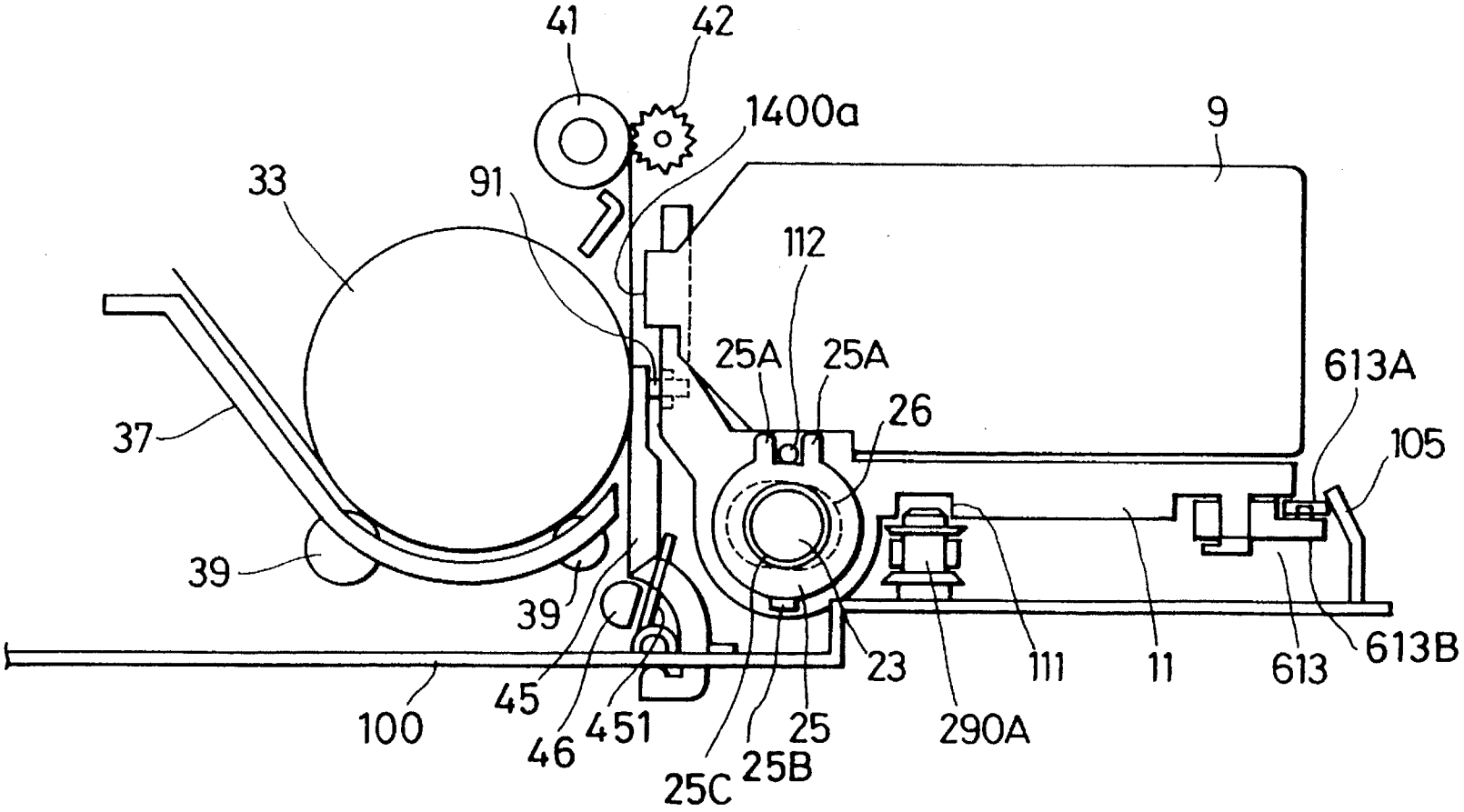
FIGS. 14 and 15 are a side view and a plan view for explaining the engagement between the head cartridge 9 and various elements of the carriage 11 as shown in FIG. 2.
Figure 15:
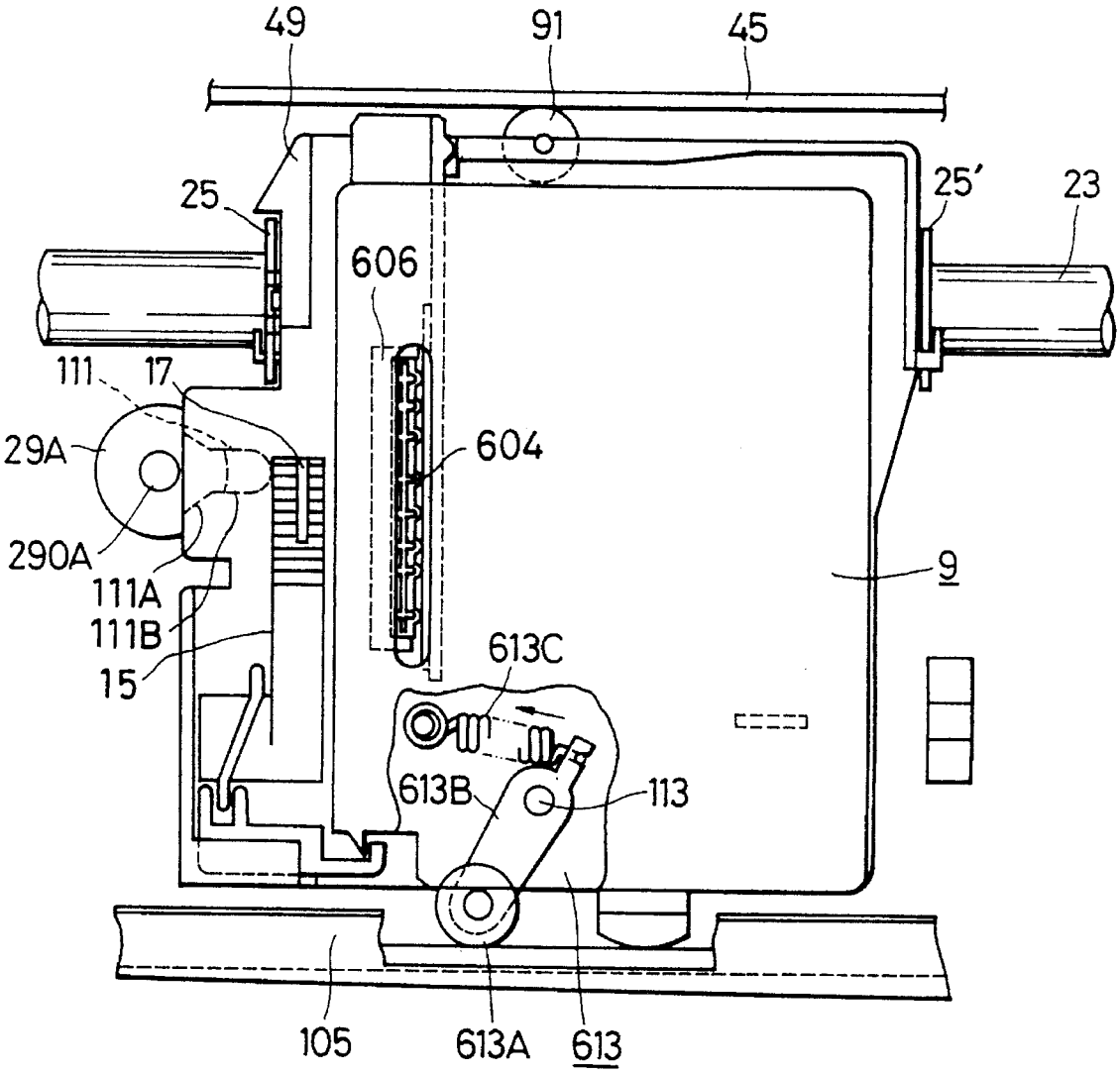

FIGS. 14 and 15 are a side view and a plan view showing the head cartridge 9 and its peripheral mechanism shown in FIG. 2, respectively.

In these figures, at the front of the carriage 11, the roller 91 is pivoted freely. The roller 91 is mounted so as to protrude forward out of the plane defined by the ejection-outlet-disposed surface 1400*a* of the head cartridge 9, and rolls on the paper pressure plate 45 making contact therewith. At the rear of the carriage 11 is provided a roller spring 613 which is composed of a roller 613A, link member 613B that supports the roller 613A, and a spring 613C that draws the link member 613B counterclockwise in FIG. 15. The roller 613A makes contact with a front plate 105 that extends in parallel with the guide shaft 23 (see FIG. 2) at the front portion of the bottom plate 100 of the apparatus, and rolls on the front plate 105. The link member 613B is rotatably supported by an axis 113 provided on the carriage 11. The spring 613C exerts force on the link member 613B so as to rotate it counterclockwise. The roller spring 613 and the front plate 105 thus arranged exert pressure on the carriage 11 in the direction of the paper pressure plate 45.

The bearings 25 and 25', which are slidably engaged to the guide shaft 23, are mounted on the holes 26 at the both sides of the carriage 11 as shown in FIG. 7. Here, the bearings 25 and 25' have eccentric bearing bores 25C and 25C' with regard to the center of the cases thereof, and the two bearing bores 25C and 25C' are eccentric in opposite vertical directions when they are mounted. More specifically, the bearings 25 and 25' have an identical shape, and, the center of the inner diameter of the bearing 25 and that of the outer diameter of the bearing 25 have different axes (see FIG. 17). Furthermore, the bearing 25 on this side shown in FIG. 14 is oscillatably engaged with boss 112 which is provided on the carriage 11. More specifically, the cross section of the hole 26 on this side shown in FIG. 14 is an elongated circle, and the bearing 25 on this side is fitted to the hole 26. In addition, the bearing 25 is restricted in its lateral (left-to-right or right-to-left in FIG. 14) movement by the boss 112 that is placed between two projections 25A on the bearing 25. As a result, the bearing 25 shown in FIG. 14 oscillates relative to the carriage 11 in accordance with the movement of the carriage 11. Here, movement of the bearings 25 in the direction of the axis of the guide shaft 23 is restricted by projections 25B which are provided on the bearings 25, and engage with portions 133 (see FIG. 5A also) of the carriage 11. The bearing 25' on the other side of carriage 11 is fixedly fitted to the hole 26.

The arrangement of the roller 91, the roller spring 613 and the bearings 25 and 25' enables the gap between the recording paper and the ejection-outlet-disposed surface 1400*a* of the head cartridge 9 to be automatically adjusted. This will be described with reference to FIGS. 16 and 17.

The automatic adjustment of the gap is carried out according to the thickness of the recording paper inserted between the paper pressure plate 45 and the transport roller 33. When a rather thin common recording paper p is used, the left side bearing 25 is positioned near the center of the elongated hole 26. This will be described in more detail. The carriage 11 is pressed toward the paper pressure plate 45 by the reaction force of the front plate 105, which is produced when the roller spring 613 presses the front plate 105. Thus, the roller 91 presses the paper pressure plate 45. This produces the reaction force of the paper pressure plate 45. Each of these two reaction forces constitutes a moment of force the axis of which is the right side bearing 25' in FIG. 16A. The position of the bearing 25 in the hole 26 is determined as the position at which the two moments of forces balance. In other words, the position of the head cartridge 11 is determined with regard to the bearings 25, and so to the guide shaft 23 attached to the apparatus. Thus the gap d between the ejection outlets of the head cartridge 9 and the recording paper is determined.

Figure 16B:
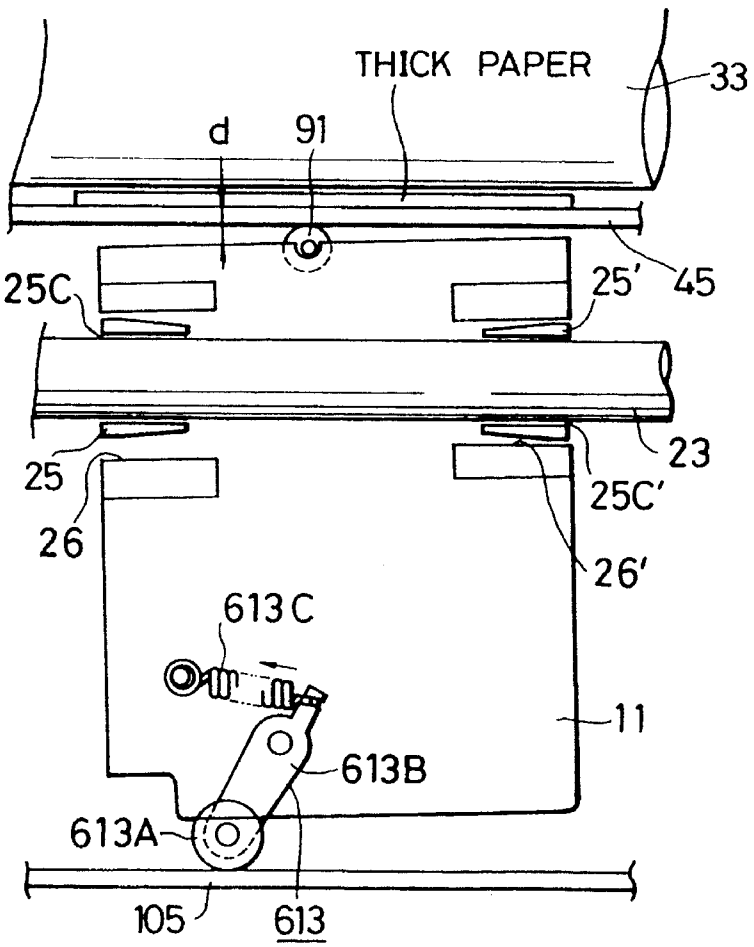
FIGS. 16A and 16B are schematic plan views illustrating the position change of the carriage 11 in response to the thickness of the recording medium.

In contrast with this, FIG. 16B shows the position of the carriage 11 when a rather thick recording paper p, such as an envelope, is used. In this case, the position of the paper pressure plate 45, the roller 91 and the carriage 11 shifts backward from that of FIG. 16A owing to the thickness of the recording paper. Accordingly, the reaction forces of the front plate 105 caused by the roller spring 613 changes, resulting in the shift of the equilibrium position of the moments of forces. As a result, the relative position of the bearing 25 and the carriage 11 changes: the carriage 11 rotates about the bearing 25', and the position of the left front of the carriage 11 shifts slightly backward from that of FIG. 16A. This enables the gap d, which is formed between the ejection outlets on the surface 1400*a* and the recording paper p, to maintain the width nearly equal to that in FIG. 16A. In this case, the bearing 25 changes its relative position in the hole 26 by swinging as indicated by the arrow in FIG. 17.

This arrangement can handle a thicker recording paper than a common cardboard by adjusting the position of the roller 91: shifting the position of the roller 91 makes it possible to escape the paper pressure plate 45 by a considerable amount depending on the thickness of the recording paper, thus maintaining the width of the gap.

According to the arrangement described above, the roller 613A of the roller spring 613 makes contact with the oblique portion of the front plate 105. As a result, the roller 613A is pressed downward, and so the carriage 11 in its entirety is pressed downward. This prevents the carriage 11 from swinging upward, which stabilizes the direction of ink ejection by the head cartridge 9 mounted on the carriage 11.

Figure 16A:
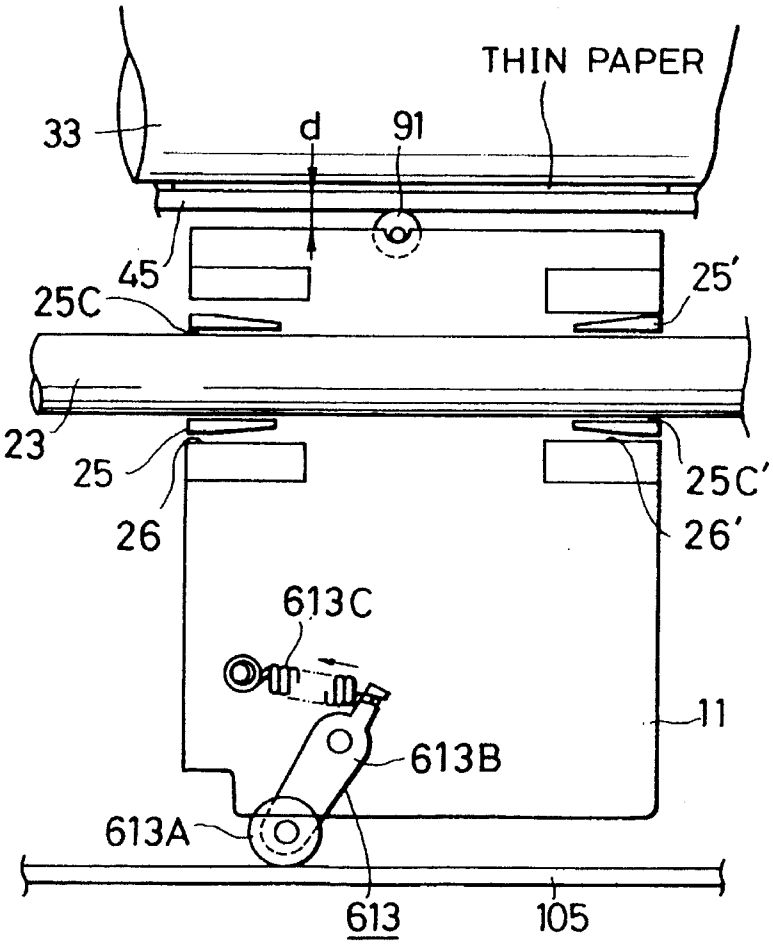

Incidentally, the mechanism for adjusting the gap between the recording paper and the ejection outlets on surface 1400*a* as shown in FIGS. 16A and 16B, is not restricted to that described above. For example, although in the embodiment above, only one hole 26 is made elongated and only one roller spring 613 is provided, both holes 26 and 26' in FIGS. 16A and 16B may be made elongated holes, and two roller springs may be provided. Thus, if the positions of the roller 91 are appropriately selected, the carriage 11 can linearly move in the lateral direction in FIGS. 16A and 16B in response to the thickness of the recording paper so that the gap is maintained nearly constant.

Furthermore, the mechanism for adjusting the gap of the present invention is not limited to the mechanism for maintaining the gap. For example, the gap can be varied according to the thickness of the recording paper if the spring 613*c* of the roller spring 613 changes its elastic force in response to its displacement. This makes it possible to improve the recording according to the ink absorption coefficient of the recording paper: when the thickness and the ink absorption coefficient are different depending on the recording paper, the gap can be adjusted in accordance with these factors so that appropriate recording can be achieved.

Moreover, the number of the bearings need not be restricted to two as in the above embodiment: For example, bearings at both ends of the carriage 11 can be integrally formed into one bearing; and one end of the bearing is made free to displace; or alternatively, both ends thereof can be made free to displace.

Referring again to FIG. 15, at the bottom of the left side of the carriage 11 (at the bottom of the home position side of the carriage 11), is provided a notch 111. The notch 111 fits a pulley shaft 290A of the pulley 29A provided in the vicinity of the home position (see FIG. 2), when the carriage is placed at the home position. This fit is carried out as the carriage 11 moves to the position of the cap 51 (see FIG. 2) for covering the ejection outlets of the head cartridge 9. At the fit position, the cap 51 performs the capping of the ejection-outlet-disposed surface 1400*a*.

The fit described above hinders the carriage 11 from shifting in the lateral direction even if the cap 51 presses the head cartridge 9 during the capping, or external vibration is applied to the apparatus. This prevents the cap 51 from separating from the ejection-outlet-disposed surface 1400*a* of the head cartridge 9, thereby ensuring the capping.

Furthermore, since the pulley shaft 290A also serves as the fit member that fits into the notch 111 of the carriage 11, no additional member for the fit is needed. This makes it possible to simplify the construction and lower the cost and decrease the size.

In addition, the entrance portion 111A of the notch 111 is chamfered so that the pulley shaft 290A can easily fit into the notch 111, and the deep portion 111B of the notch 111 has nearly the same diameter as that of the shaft 290A. This makes it possible for the notch 111 to fit the shaft 290A even if the carriage 11 is displaced in response to the thickness of the recording paper.

Incidentally, although in the above embodiment, the mechanism for restricting the lateral shift of the carriage 11 is placed at the capping position of the recording head, it can be placed at the position in front of the blade 59 (see FIG. 2) at which the ejection-outlet-disposed surface 1400*a* of the head cartridge 9 is wiped. With this arrangement, the backward shift of the carriage 11 is restricted by the pressure of the blade 59 when the ejection-outlet-disposed surface 1400*a* of the head cartridge 9 is wiped with the movement of the head cartridge, thereby performing an intended wiping.

Figure 18:
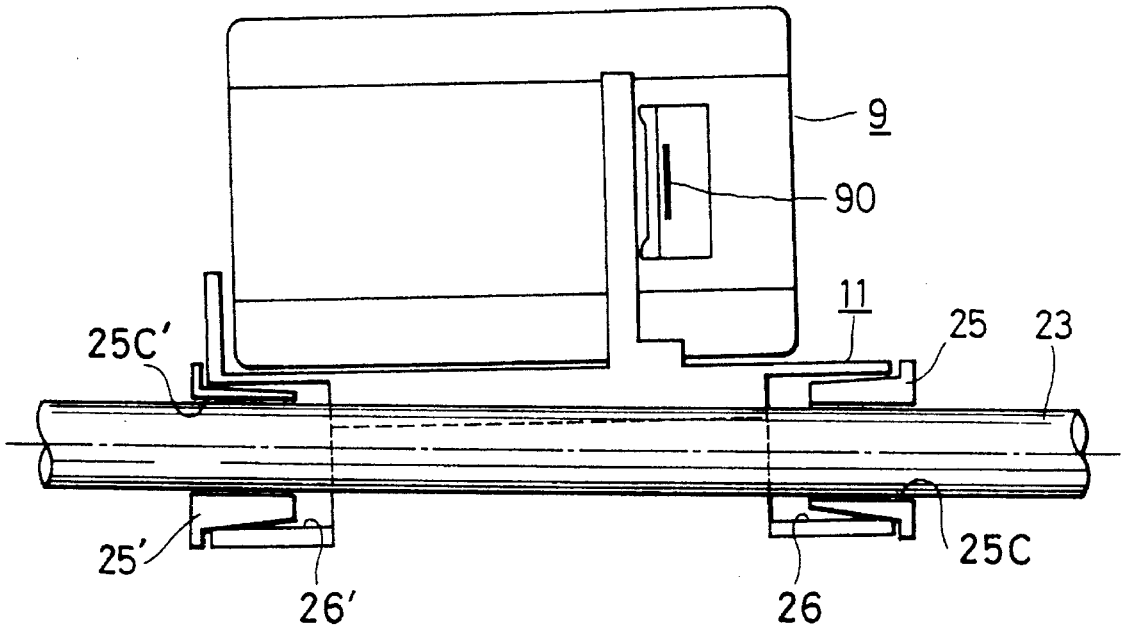
FIG. 18 is a schematic front view illustrating the mechanism for inclining the ejection outlet line with regard to the moving direction of the carriage 11 shown in FIG. 2.

FIG. 18 is a schematic elevation showing the head cartridge 9 and the carriage 11 viewed from the recording paper.

As clearly seen from this figure, the carriage 11 and the head cartridge 9 mounted on the carriage incline with regard to the guide shaft 23, or the moving direction of the carriage 11. Thus, the direction of the ejection-outlet line 90 also inclines.

This inclination is achieved by using the two bearings 25 and 25' whose bearing bores 25C and 25C' are eccentric. More specifically, the bearing 25 (which is shown at the right hand in FIG. 18) has the bearing bore 25C whose center deviates downward as shown in FIG. 18. In contrast, the bearing 25' (which is shown at the left hand in FIG. 18) has the bearing bore 25C' whose center deviates upward as shown in FIG. 18. In practice, the two bearings 25 and 25' are identical, but are attached to the carriage 11 in the opposite direction as shown in FIG. 5A.

The inclined arrangement of the ejection-outlet line 90 is adopted in the case where the ink ejection from the outlets are carried out on a time division basis by dividing the outlets into a plurality of blocks (In this embodiment, 64 outlets are divided into 8 blocks). The time division drive has been generally used for ink ejection drive of ink jet-recording heads because the recording rate or the drive power of the recording heads cannot increase beyond a certain limit. For example, let us assume that the recording head has 64 ejection outlets, and that they are divided into 8 blocks, each of which is used to eject ink successively on a time division basis. In this case, if the ejection-outlet line 90 is not inclined, recording as exaggeratedly shown in FIG. 19A is performed because the carriage continuously moves. The record will appear as an oblique line if it is seen macroscopically (In FIG. 19A, the lines designated by the references A1, A2, A3, A4, A5 are recorded by 8 ejection outlets respectively) .

Figure 19B:
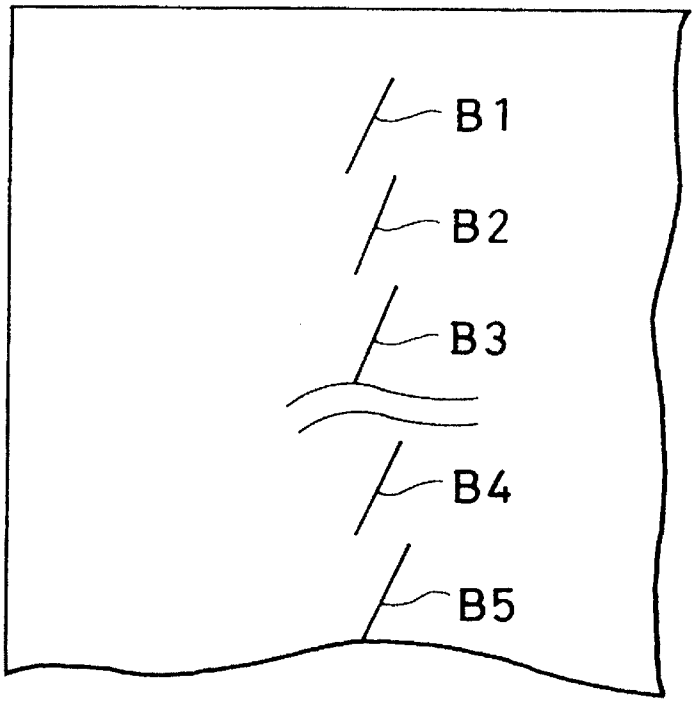
FIGS. 19A and 19B are schematic plan views showing examples of recording when the mechanism for inclination is not provided and is provided, respectively.
Figure 19A:
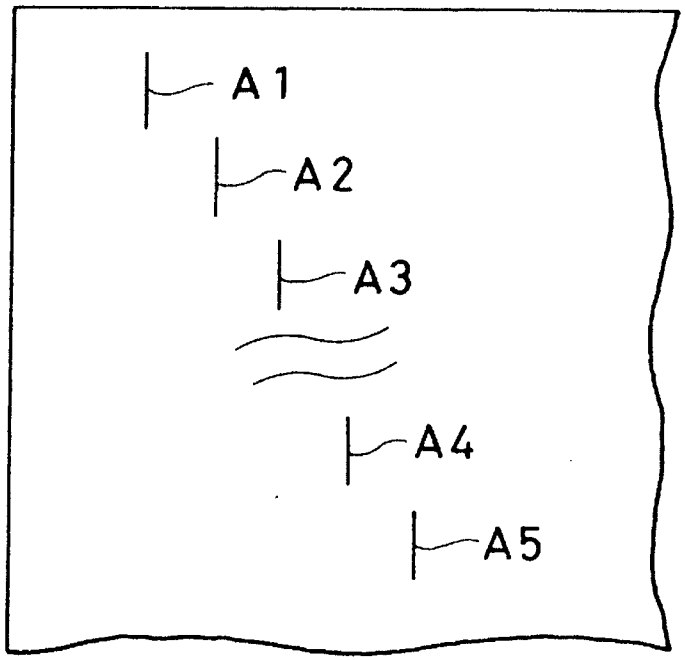

In contrast with this, if the ejection-outlet line 90 is inclined as shown in FIG. 18, recording as shown in FIG. 19B is performed. The record will appear as a vertical line when seen macroscopically (In FIG. 19B, the lines designated by the references B1, B2, B3, B4, B5 are recorded by 8 ejection outlets respectively).

It is obvious that the inclined arrangement can be effectively applied not only to the time division on the block basis, but also to the time division carried out on the outlet basis.

The inclination precision of the carriage 11 can be easily heightened because the inclination is defined by the two bearings 25 and 25' at each side of the carriage 11, and the distance between the two bearings is considerably long. In addition, the inclination is formed by mounting the identical two bearings in the opposite direction of its eccentricity, which simplifies the arrangement. Furthermore, the inclination can be easily changed by only replacing the bearings with other bearings of different eccentricity without changing other elements such as the carriage and the recording head. This makes it possible to deal with the change in the timing of the time division driving owing to the change in shift speed of the carriage 11 or the like. Thus, one type of carriage can be shared by various type of apparatuses.

Incidentally, although in the embodiment above, two eccentric bearings of the same type, one of which is mounted upside-down, are used, the arrangement which uses only one eccentric bearing is possible in the present invention. In addition, the eccentric directions of the two bearings need not be vertical when they are mounted. Furthermore, bearings mounted on both ends of the carriage 11 can be integrally formed into one body, and the bearing bore fitting to the guide shaft 23 is made inclined.

Furthermore, the ejection-outlet line 90 is inclined such that the bottom of the line 90 is nearer to the home position than the top of the line 90. In this arrangement, when the carriage 11 moves from home position side to the other side to perform the recording, the 8 blocks of the line 90 are driven from the top to the bottom blocks. In contrast with this, when the carriage 11 move from the other side to the home position side to perform the recording the 8 blocks are driven from the bottom to the top blocks.

Figure 20A:
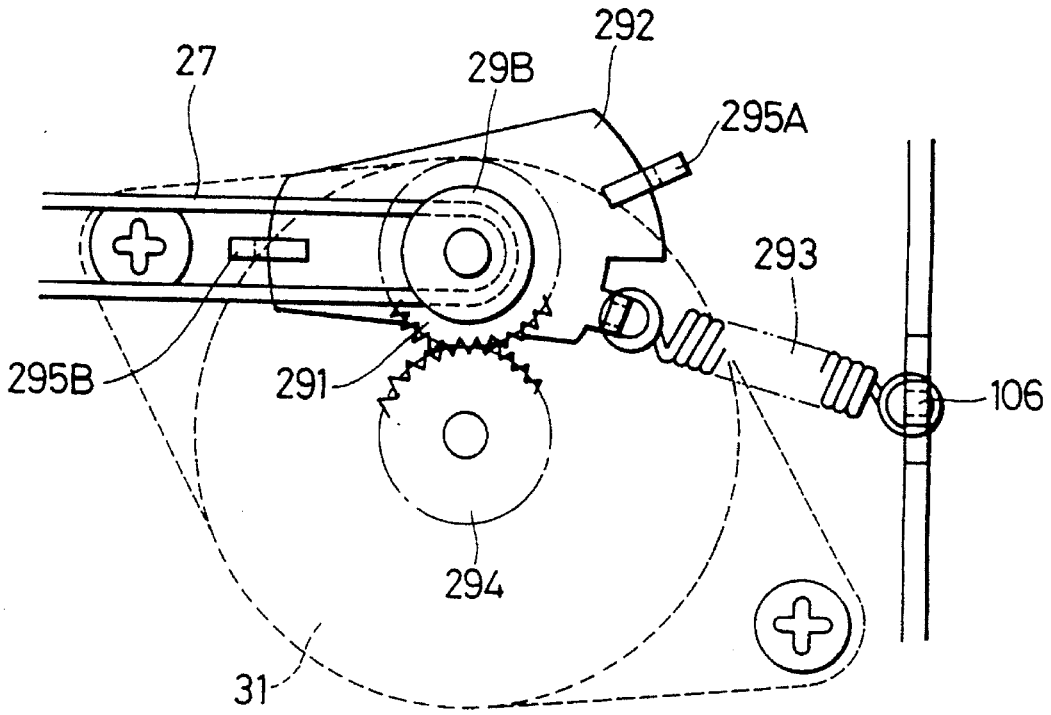
FIGS. 20A and 20B are a plan view and a front view showing the tension mechanism of the belt for driving the carriage shown in FIG. 2.
Figure 20B:
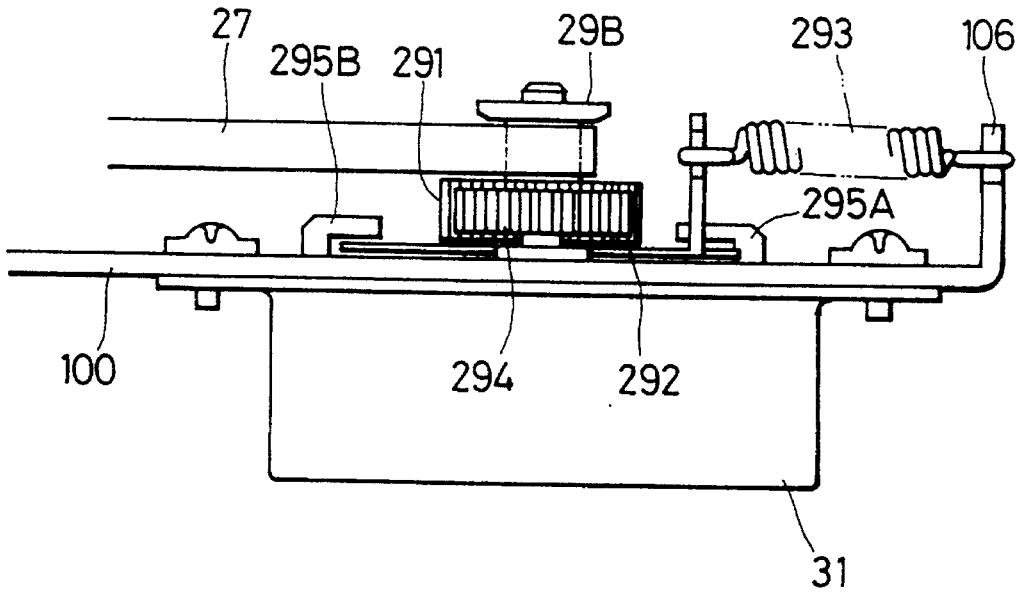

FIGS. 20A and 20B are a plan view and an elevational view, respectively, showing the details of the pulley 29B and its neighborhood shown in FIG. 2.

On the shaft of the pulley 29B, is mounted a driven gear 291 which engages a drive gear 294 mounted on the shaft of the carriage motor 31. The shaft on which the pulley 29B and the gear 291 are mounted is rotatably supported by a bracket 292.

To the bracket 292, is connected one end of a spring 293, the other end of which is connected to a projection 106 uprighted on the bottom plate 100. Thus, the bracket 292 is drawn in the direction that makes a predetermined angle with the direction in which the timing belt 27 extends. With this arrangement, the motion of the bracket 292 is restricted by the following: the up and down movement (the movement normal to the paper of FIG. 20A) is restricted by the bottom plate 100 and L-shaped members 295A and 295B uprighted thereon: and the horizontal movement, which is regulated by the bottom plate 100 and the L-shaped members 295A and 295B, is restricted except for movement in the direction of force of the spring 293 and the direction in which the driven gear 291 engages the driving gear 294. Accordingly, the tension of the timing belt 27 and the force for engaging the gear 291 with the gear 294 are produced in accordance with components of the force by the spring 293.

RECORD POSITION DESIGNATION

Figure 21:
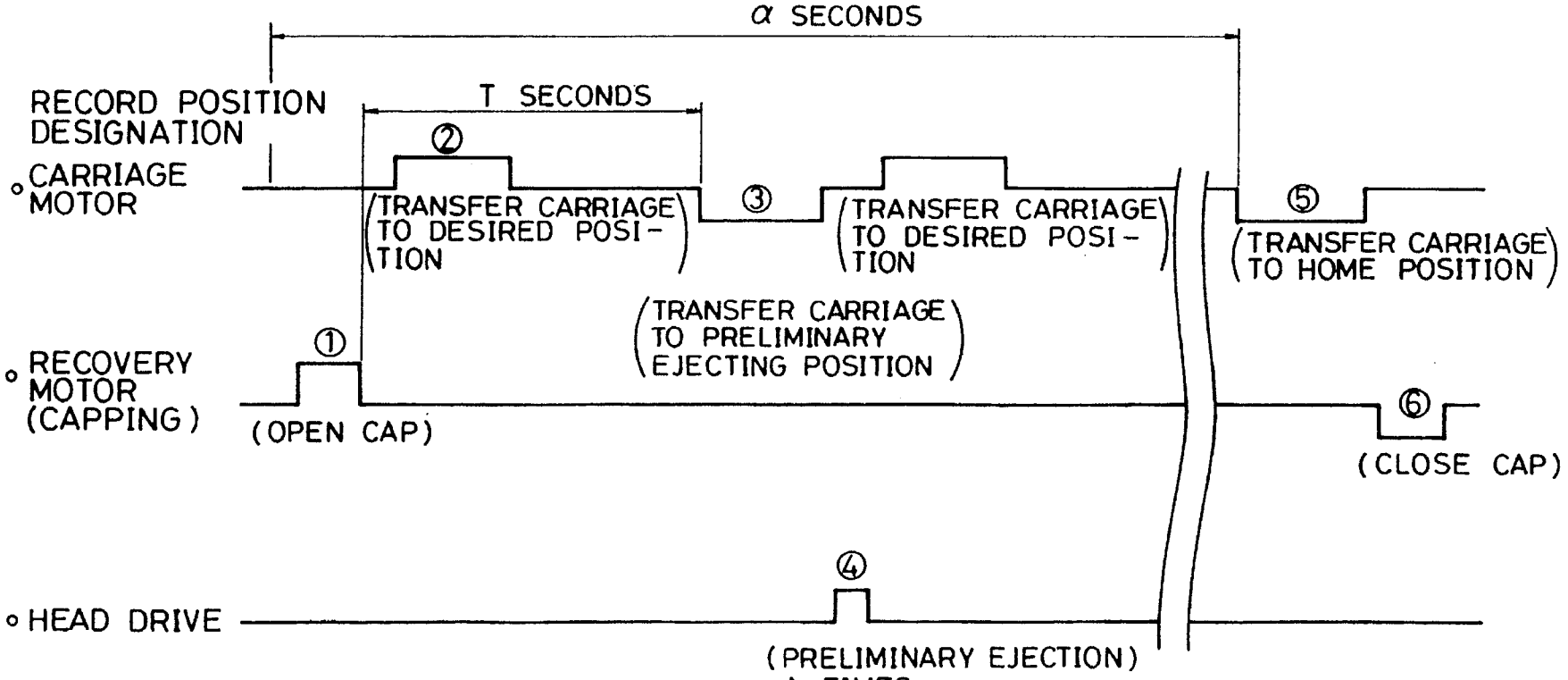
FIG. 21 is a timing chart illustrating the operation of the record position designation mode in the recording apparatus shown in FIG. 2.

FIGS. 21 and 22 are a timing chart and a flowchart showing the control procedure of a record position designating mode in the ink jet recording apparatus according to the embodiment.

Here, the record position designating mode is a control procedure which is used when recording is performed on formatted paper or record paper on which some recording has already been performed, as in an electronic typewriter. In this mode, the carriage 11 or the recording head may be moved so as to confirm or set the record position, or to set the record range. During this process, the recording head does not perform capping or recording by ejecting the ink. Hence, to prevent the increase in viscosity of the ink or impeding factors of ejection, the carriage 11 is shifted to the predetermined position for the preliminary ejection or the capping at predetermined time intervals by interrupting the record position setting processing or the like of the carriage 11.

Figure 22A:
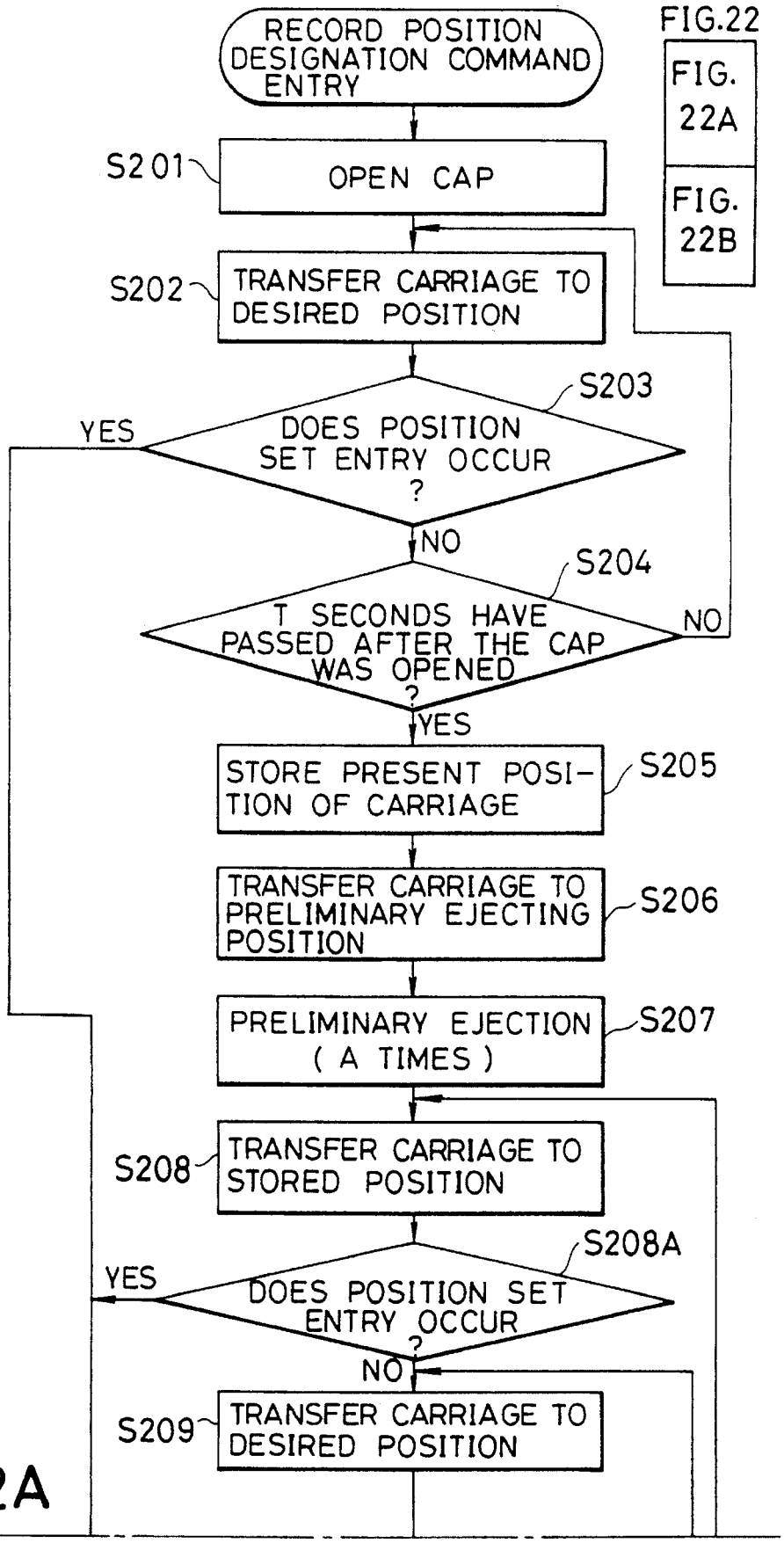
FIGS. 22A and 22B are flowcharts illustrating the operation of the record position designation mode in the record apparatus shown in FIG. 2.
Figure 22B:
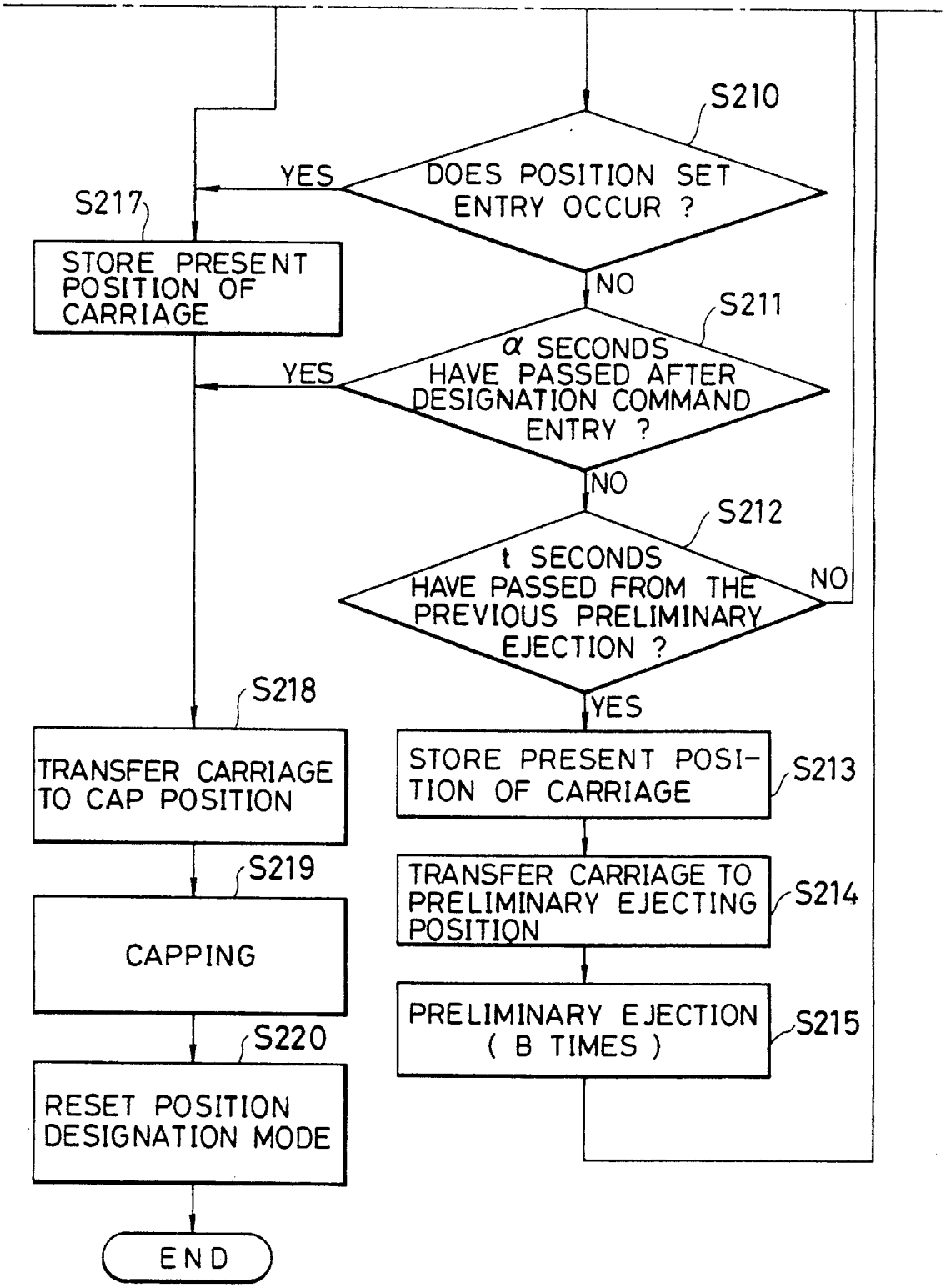

Referring to the timing chart of FIG. 21 and on the basis of the flowchart of FIGS. 22A and 22B, the control procedure of the record position designation mode will be described below.

When the record position designation command is entered by a specified key operation, the control procedure is activated: At step S201 the cap 51 is opened (time [1] in FIG. 21), and at step S202 the carriage 11 is shifted towards a desired position when the space key, for example, is pressed (time [2]). During this process, at step S203, the control process judges whether the specified key entry (designated position set or designation entry) which informs that the carriage 11 has been placed at a desired record position or the like, occurs or not: if the result of the judgement is negative, the process proceeds to step S204 to further judge if it has passed T seconds after the cap 51 was opened.

If T seconds has passed, the present position of the carriage 11 is stored at step S205, and then the carriage 11 is moved to the preliminary ejection position at step S206 (time [3]). Then, preliminary ejections are carried out predetermined times (A times) at step S207 (time [4]). After that, at step S208, the carriage 11 is shifted to the position previously stored at step S208. At step S208A, considering a case where the stored position coincides with the desired position, the control process judges whether the specified key entry occurs or not. If the result of the judgement is negative, the carriage is further moved to the desired position at step S209 in a manner similar to that mentioned above. In the course of this, the control process judges at step S210 whether the entry which informs that the cartridge 11 has been set at the desired position occurs or not. If the result of the judgement is negative, the control process judges at step S211 whether a predetermined time α seconds has passed after the entry of the position designation command, or the initiation of the control process. The time period of α seconds is a due time in which the setting of the designated position is ordinarily completed. The time period of α seconds also defines the time limit of separation of the recording head from the cap 51: detaching the recording head from the cap 51 beyond the time period of α seconds will hinder a smooth ink discharge.

If the judgement at step S211 is negative, the control process judges at step S212 whether a predetermined time t has passed from the previous preliminary ejection or not. If the time period of t has passed, preliminary ejections of B times are carried out at step S215 after the preceding steps S213 and S214 are performed in a manner similar to those from step S205 to step S207. After that, the procedure returns to step S208.

If the designation position set entry occurs at step S203 or S210, the designation position is stored at step S217, and the control procedure proceeds to step S218. Likewise, if the control procedure judges that the time period of α seconds has passed at step S211, it proceeds to step S218.

At step S218, the carriage 11 is shifted to the cap position (time [5]). Then, at the step S219 the recording head is capped (time [6]), and at step S220 the control procedure of the position designation mode is reset, thus terminating the procedure.

Incidentally, the time periods T, t and α can be determined in accordance with the temperature or humidity of environment. Alternatively, the time periods can be automatically set by detecting these environmental factors by sensors of temperature or humidity.

In the control procedure, the cartridge 11 is shifted to the desired position by the depression of the space key or the like. During this process, the position of the cartridge 11, or that of the ejection outlets of the recording head on the recording paper can be confirmed by using the marker 49 on the carriage 11 or the lever 15 and the scale 47 or 17 on the paper pressure plate 45 as shown in FIG. 2. Incidentally, although the positions of the marker 49 and the ejection outlets are not aligned, the offset amount between the two is prestored so that it is automatically corrected in the recording operation or the like. The scale 47 can be provided in the closest vicinity of the recording paper because the scale 47 is marked on the paper pressure plate 45, a member which is peculiar to the ink jet record apparatus.

Figure 17:
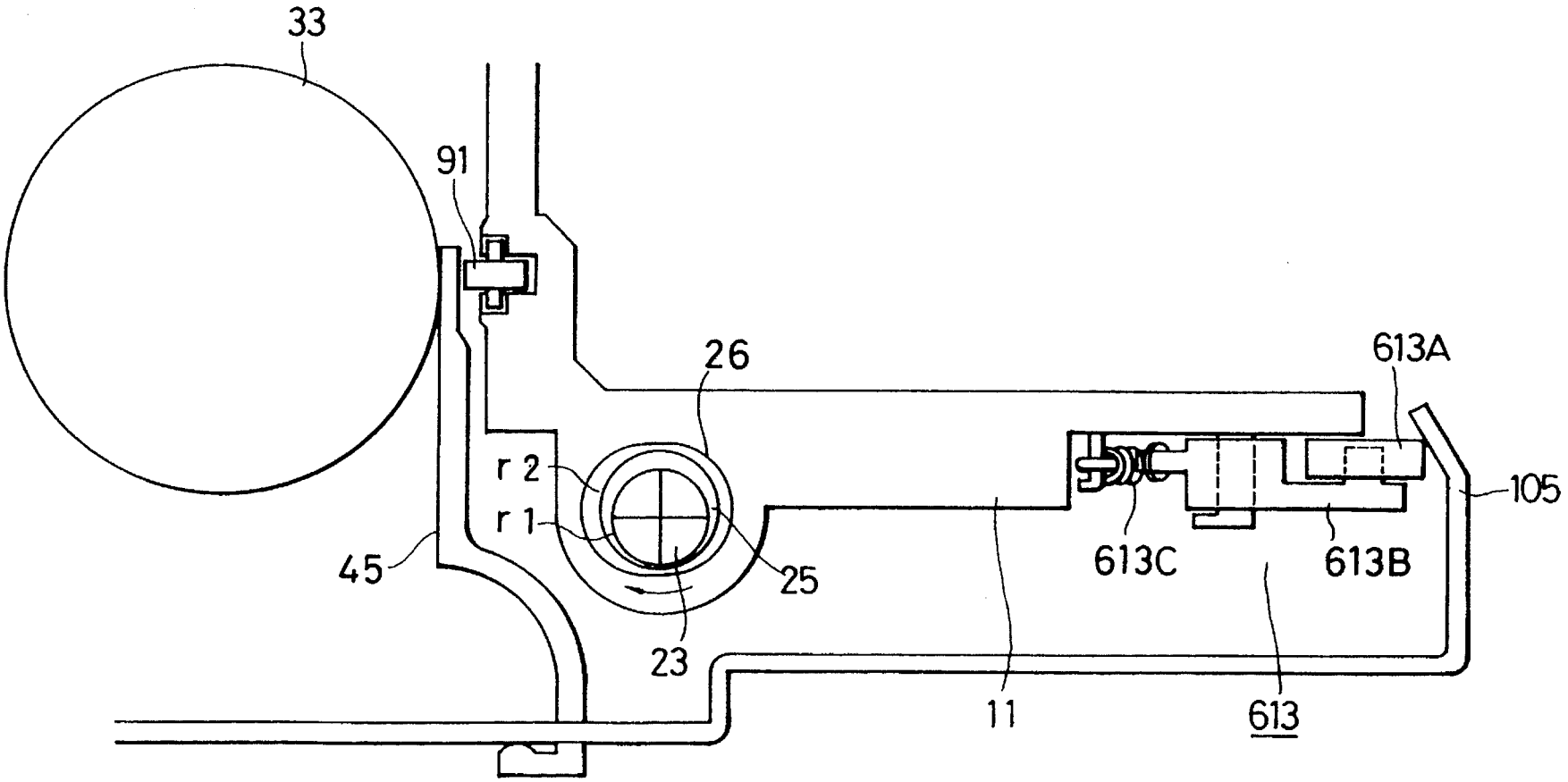
FIG. 17 is a schematic side view illustrating the change of the guide bearings 25 involved in the change above.

Likewise, during the shift operation of the carriage 11 to the desired position, the displacement of the carriage 11 can be read by using the marker 17 on the lever 15 shown in FIGS. 2 and 17 and the scale (not shown) on the window 8 in the cover of the apparatus.

The arrangement for reading the position of the cartridge 11 which uses the markers 49 and 17 is particularly effective when the position designating operation is interrupted for the preliminary ejection or the like, and the carriage is returned to the interrupted position again, in the ink jet recording apparatus of the present embodiment.

Figure 23:
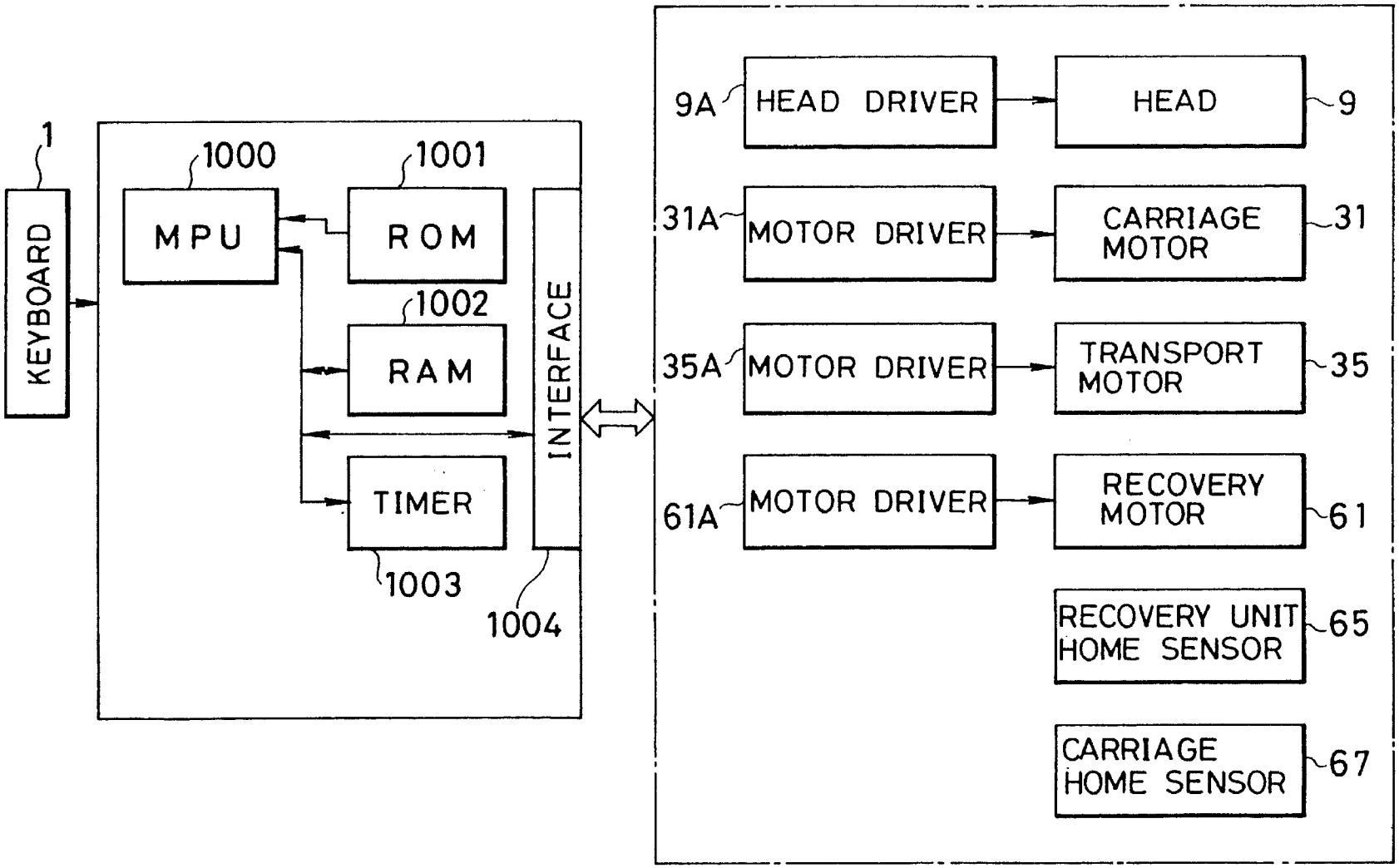
FIG. 23 is a block diagram showing an arrangement for controlling the record position designation mode.

FIG. 23 is a block diagram showing the control arrangement for carrying out the control shown in FIGS. 21 and 22.

The capping position and the shift position of the carriage 11 can be determined on the basis of the detection of a recovery unit home sensor 65 and a carriage home sensor 67. The shift command for shifting the cartridge 11 to the desired position, or the position set or designation entry can be entered from the space key or other specified keys. The control procedure describe above is executed by an MPU (Microprocessor Unit) 1000, and the program of the control procedure is stored in an ROM 1001. The MPU 1000 is also connected to an RAM 1002 used for storing the current position of the carriage 11, or used as work areas of the control procedure. The time periods T, t and α can be measured by a timer 1003.

RECOVERY UNIT

Figure 24:
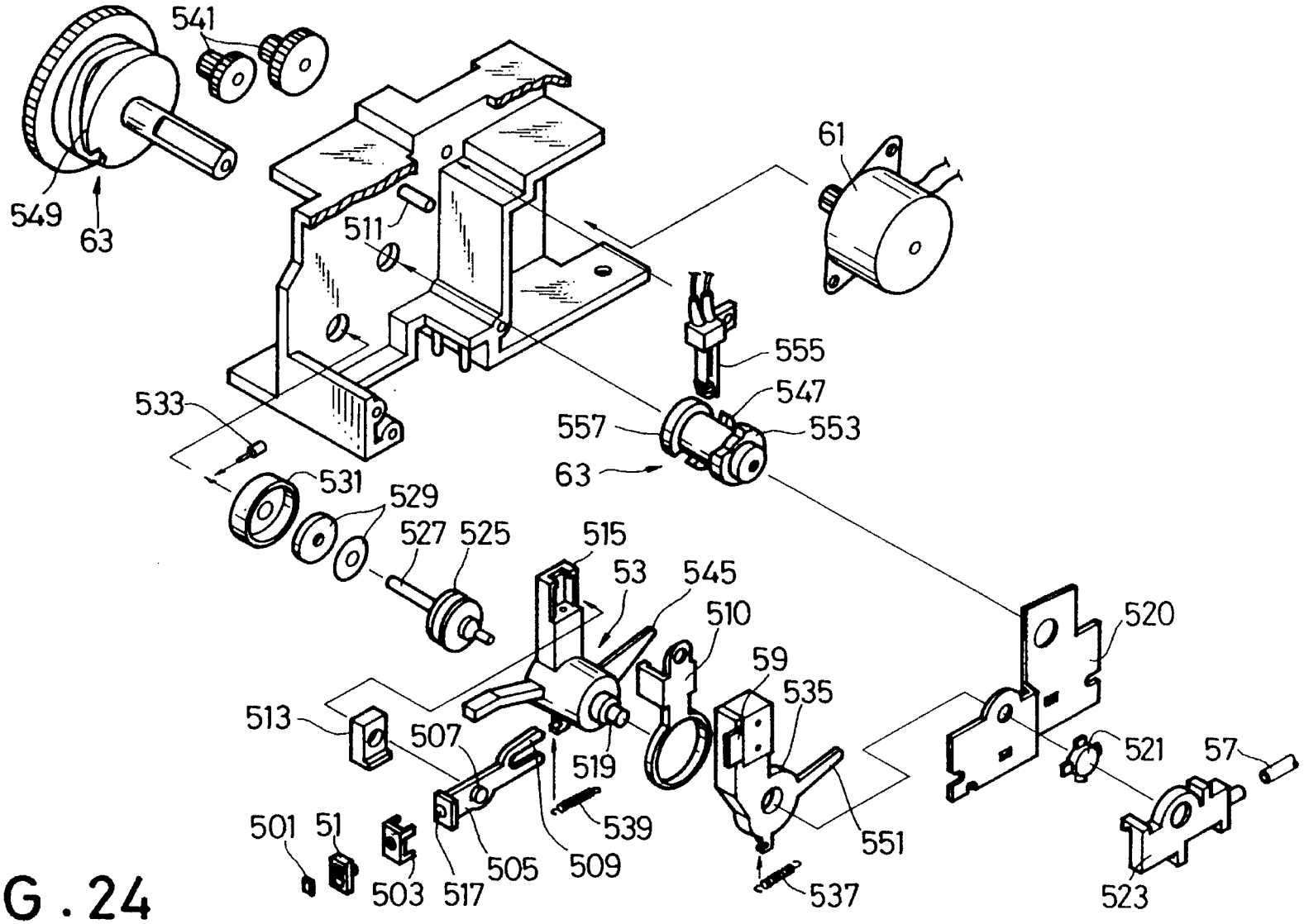
FIG. 24 is an exploded perspective illustration of the discharge recovery mechanism shown in FIG. 2.

FIG. 24 is an exploded perspective view showing the major portion of a recovery unit including the cap 51, pump 53, blade 59, motor 61 and cam device 63 in FIG. 2.

The cap 51, which is supported by a support member 503, includes an ink absorbent 501. Furthermore, the cap 51 is attached to a cap lever 505 which is pivoted about a pin 507 so that the cap 51 can be contacted to or detached from the ejection-outlet-disposed surface 1400*a* of the discharge unit 9*a* by the rotational force applied to the pin 507. At the end of the cap lever 505, a pin 511 is fitted so that the range of rotation of the cap lever 505 is restricted.

Figure 25:
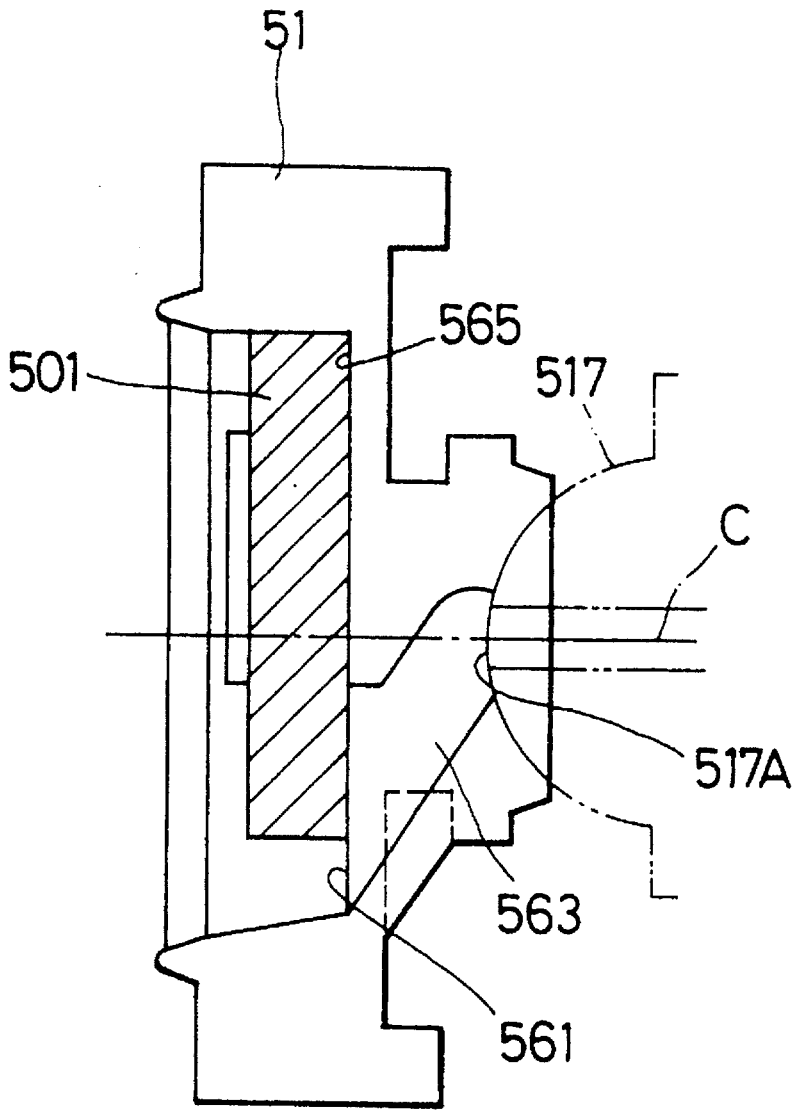
FIG. 25 is a side view showing the cap portion of the discharge recovery mechanism.

The pin 507 of the cap lever 505 is fitted into a hole of a jig 513 which is used for mounting the cap lever 505 on a support portion 515 provided on the pump 53. The mounting state of the cap lever 505 is maintained by an attachment member 510. On the vicinity of the center of the back of the cap 51, acts a force from an acting portion 517 for contacting the cap 51 to the ejection-outlet-disposed surface 1400*a*. The acting portion 517 has an inlet 517A as shown in FIG. 25 for guiding the absorbed ink to an ink passage which is provided inside the cap lever 505, the pin 507, the jig 513 and the support portion 515. With this arrangement, when the suction force produced by the pump 53 acts on the passage, the ink is introduced into the inside of the pump 53 as indicated by an arrow in FIG. 24.

At the end of the pump 53 is provided a shaft 519 inside of which an ink passage is formed, and which is rotatably attached to the side wall portion 520. Thus, the rotation force of the pump 53 itself is applied to the cap lever 505 via the support portion 515 so that the cap 51 is moved back and forth. To the shaft 519, a passage forming member 521 is attached, and the tube 57 is mounted by means of a mounting member 523. More specifically, inside the shaft 519, the passage forming member 521 and the mounting member 523, the ink passage is formed so that the ink sucked in the pump 53 is further conveyed into the waste ink reservoir 55 via the passage and the tube 57 as shown by an arrow in FIG. 24.

The pump 53 has a piston 525, a piston rod 527, packing 529 and a cap 531 of the pump. To the piston rod 527 is attached a pin 533 for accepting the transmission of a force that drives the piston 525.

The blade 59 is attached to a blade lever 535 which is pivoted by a shaft projecting on an end of the pump 53, and has the blade 59 move back and forth with regard to the recording head with the rotation of the shaft. The blade 59 is pressed toward the recording head by a rotation force which is produced by a spring 537 and acts on the blade lever 535. The cap 51 is also pressed toward the recording head by a spring 539 which exerts a rotational force on the pump 53.

The rotation of the motor 61 is transmitted to the cam device 63 by a gear train 541. The cam device has four cams: a cam 547 that engages with an engagement portion 545 on the pump 53 so as to rotate the pump 53; a cam 549 that engages with the pin 533 which is attached to the piston rod 527 of the pump 53 so as to drive the pump 53; a cam 553 that engages with an engagement portion 551 which is provided on the blade lever 535 so as to rotate the blade lever 535; and a cam 557 that engages with a switch 555 to detect the home position of the cam device 63. The operation of the cams will be described later.

FIG. 25 is a sectional view showing an example of the arrangement of the cap 51 and its neighbors.

In the arrangement, an ink passage 563 is formed between an ink sucking aperture 561 which opens at the bottom portion of the cap 51 and the ink inlet 517A which is provided in the acting portion 517 of the cap lever 505. The ink sucking aperture 561 is partially covered by the ink absorbent 501.

In conventional arrangement, an ink absorbent covers the entire surface 565 of the cap 51, an ink passage is provided normally to the acting portion 517 along the center line C, and an ink sucking aperture opens at the center of the back of the ink absorbent 501. This conventional arrangement has a disadvantage that the absorbing capacity or the sucking ability of the ink absorbent suffers degradation because the ink accepted by the ink absorbent flows downward in the ink absorbent by the action of the gravity during the ejection recovery processing, and the ink which has not been sucked solidifies at that portion.

In contrast with this, the present embodiment can greatly retard the degradation by the solidification, and lengthen the life of the ink absorbent 501 and the cap 51 to which the absorbent is attached because the ink flowing downward by the action of the gravity is sucked through the ink sucking aperture 561 provided at the bottom, and so the remaining amount of the ink in the absorbent 501 sharply decreases.

Incidentally, in the embodiment, the ink passage is provided in the cap lever 505, and hence, the passage 563 in the cap 51 is configured as shown in FIG. 25. It is unnecessary, however, to arrange the ink passage 563 in the cap 51 as shown in FIG. 25 if an alternative ink sucking passage is provided: the ink passage can take any shape as long as the ink sucking aperture 561 is provided at the bottom of the cap 51.

Figure 26:
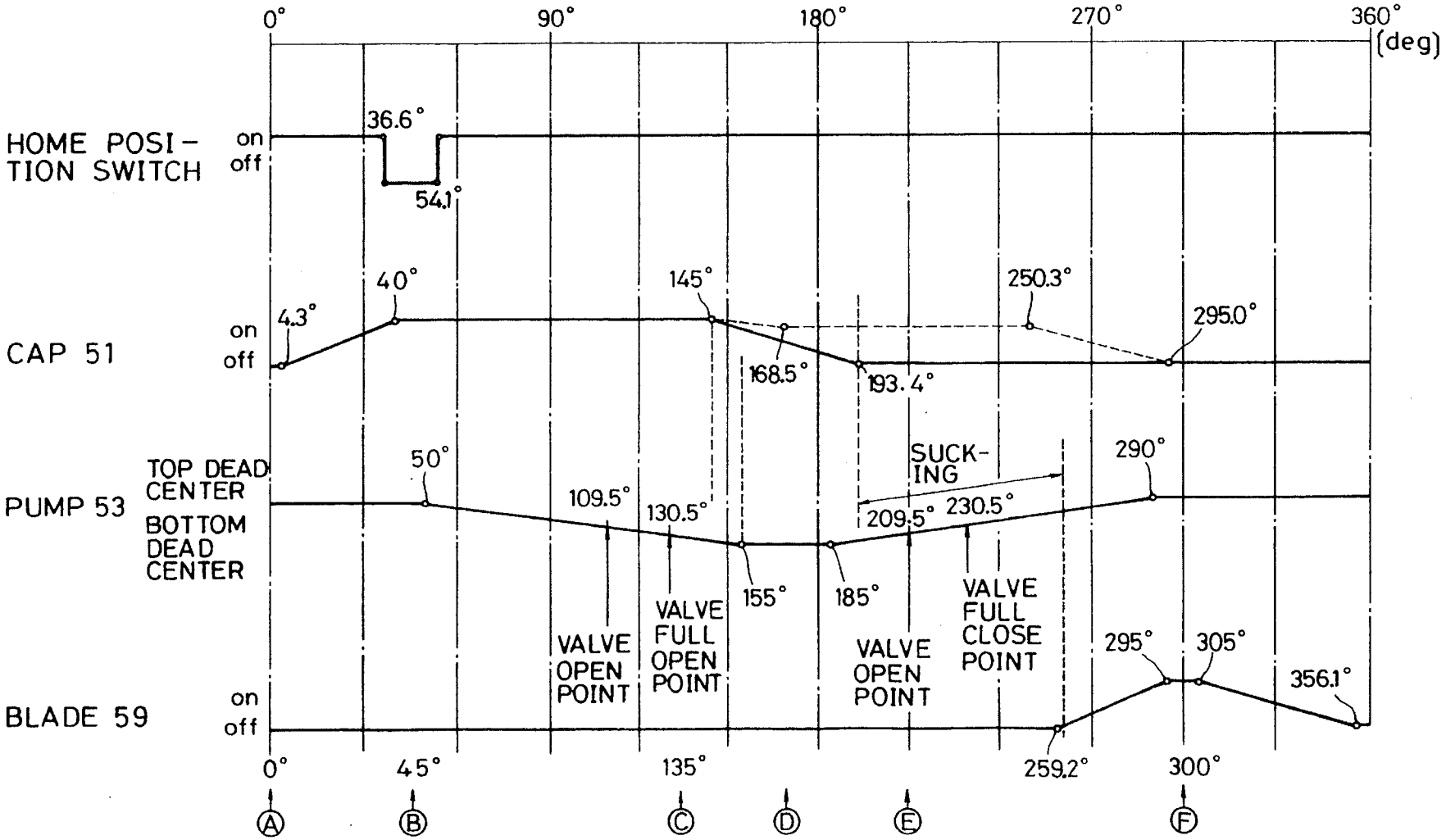
FIG. 26 is a timing chart illustrating a series of recovery actions of the discharge recovery mechanism.
Figure 27:
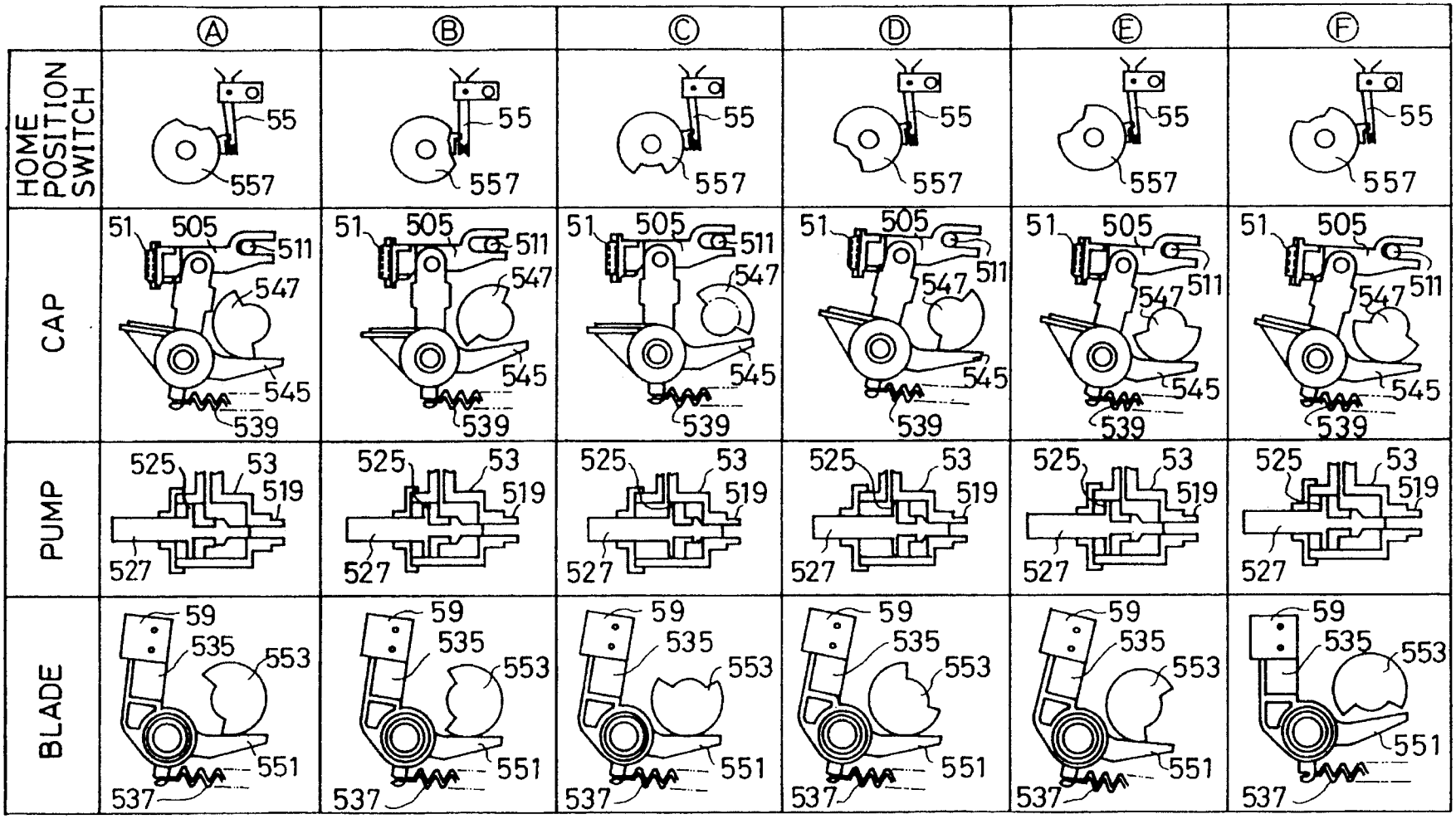
FIG. 27 is a view showing operations of the major portions of the discharge recovery mechanism.

FIG. 26 is a cam diagram corresponding to the profile of respective cams of the cam device 63, and FIG. 27 is a view showing operational positions of each cam. The numerical values in FIG. 26 indicate rotational degrees of the cams.

In these figures, a position [A] indicates the cam positions in the recording operation and the state of various portions involved in the operation: the cap 51 and the blade 59 are separated from the ejection-outlet-disposed surface of the recording head, and the piston 525 of the pump 53 is at the top dead center. A position [B] indicates the position at which the home position switch 55 turns off: this position is defined as the home position of the cam device 63, and is used as the standby position of recording. At this position, the cap 51 covers the ejection-outlet-disposed surface, the blade 59 is drawn backward, and the piston 525 is at the top dead center.

During the rotation of the cams from the position [B], the piston 525 moves toward the bottom dead center with the cap 51 keeping contact with the ejection-outlet-disposed surface 1400*a* (cap on). Thus, the negative pressure of the sucking system communicating to the cap 51 is gradually increased. Then, the piston 525 reaches the ink inlet of the pump 53, and closes the ink inlet for a time period. After the time period (during which the valve of the pump 53 is closed), the valve begins to open (at the point of 109.5 degrees), completely opens (at the point of 130.5 degrees), and the piston 525 reaches the position [C] near the bottom dead center. At the position [C], the rotation of the cams is stopped for a predetermined period of time which is determined considering the fluid resistance of the ink sucking system, and a sufficient suction of the ink is performed during this period. Subsequently, the cams are rotated again until the piston 525 reaches the bottom dead center at which the cap 51 begins to separate from the ejection-outlet-disposed surface. The piston 525 is stationed at this position [D] for a predetermined period.

After that, the cams begin to rotate again, and the piston 525 moves toward the top dead center. During this process, the valve begins to close (at 209.5 degrees), and reaches the point at which the valve is completely closed (230.5 degrees). In the course of this, the cap 51 is completely separated from the ejection-outlet-disposed surface at a position [E]. By driving the piston 525 several times in the vicinity of the position [E], the remaining ink in the ink sucking system is sucked (air sucking) to the pump 53. Incidentally, spaces at both sides of the piston 525 are communicated by a passage (not shown in figures) which is closed when the piston 525 moves from the top dead center to the bottom dead center, and which is opened when the piston 525 moves from the bottom dead center to the top dead center. The right hand space of the piston 525 communicates with the passage provided in the pump shaft 519. Consequently, during the piston 525 moves from the bottom dead center to the top dead center in the air sucking process, the waste ink which has been introduced into the left hand space of the piston 525 is transferred to the right hand space. On the other hand, while the piston 525 moves from the top dead center to the bottom dead center, the waste ink is introduced into the left hand space from the ink sucking system, and at the same time, the waste ink in the right hand space is delivered to the waste ink reservoir 55 (see FIG. 2).

After that, when the cams are further rotated in the forward direction, the blade 59 protrudes forward so that the wiping of the recording head becomes possible at the position [F]. In this state, when the carriage 11 is shifted toward the recording region, the ejection-outlet-disposed surface of the recording head makes contact with the blade 59 so that ink attached to the ejection-outlet-disposed surface is wiped away. Then, the cams are further rotated until the cams reach the position [A] and the blade 55 is drawn backward. In this state, the carriage 11 is moved toward the cap 51 so that the ejection-outlet-disposed surface faces the cap 51. Subsequently, the cams are rotated to the position [B], and are stopped after covering of the ejection-outlet-disposed surface by the cap 51.

To initiate recording, the cams are rotated in the forward or reverse direction from the position [B] to move the blade 59 forward so that the ejection-outlet-disposed surface is wiped before the recording.

WASTE INK RESERVOIR

Figure 28:
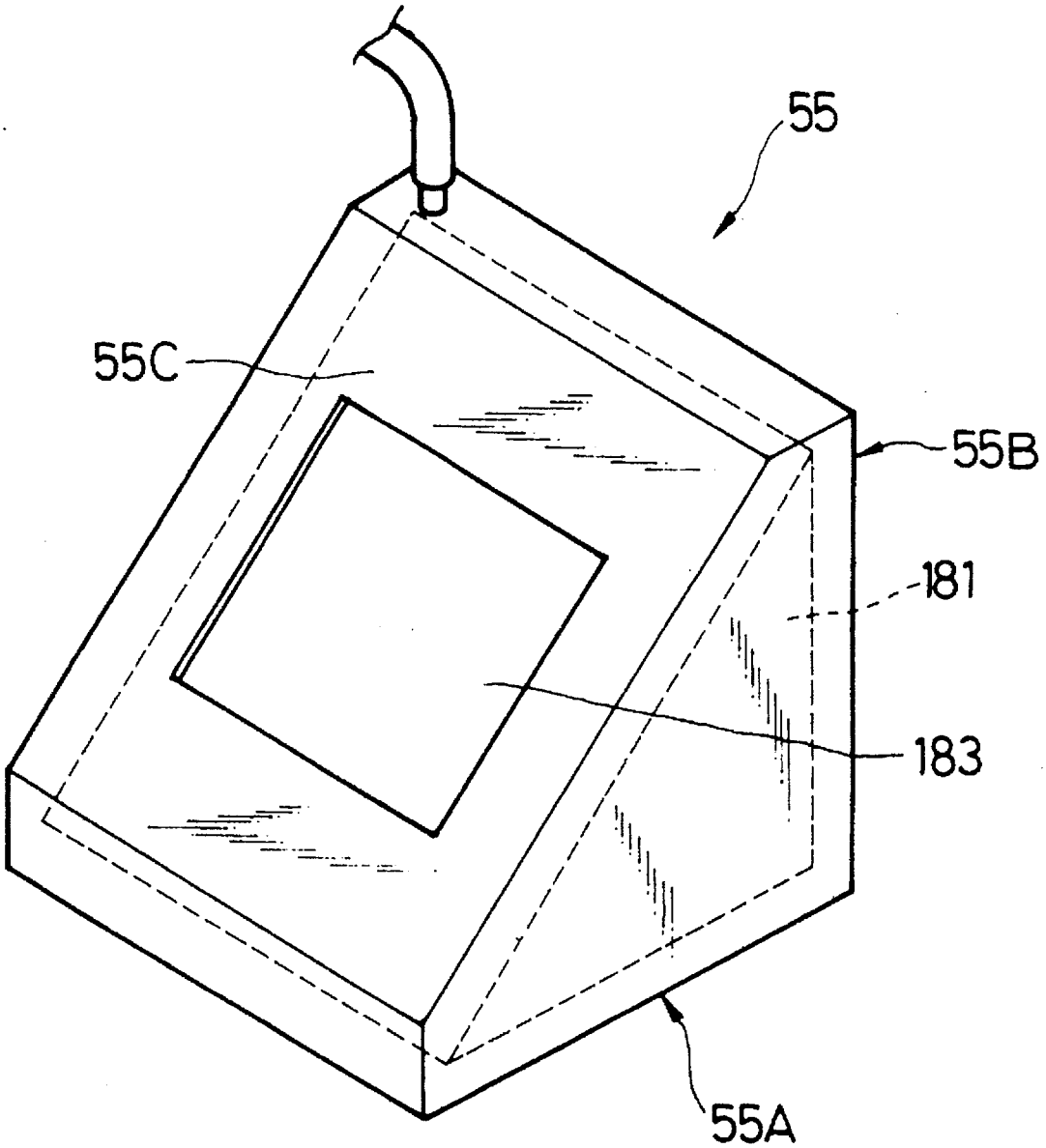
FIG. 28 is a schematic perspective view of the waste ink reservoir for storing the discharged ink by the recovery operation.

FIG. 28 is a perspective view showing an example of the arrangement of the waste ink reservoir 55 of the present embodiment with a posture which the reservoir takes when the apparatus is practically used.

The waste ink reservoir 55 has an ink absorbent 181 for holding the waste ink, a first bottom 55A that forms the bottom of the reservoir when the apparatus is used (in the state shown in FIG. 1A), a second bottom 55B that forms the bottom of the reservoir when the apparatus is closed as shown in FIG. 1B and is carried by holding the handle 6, and a sloping surface 55C that does not become a bottom in either case. In the sloping surface 55C, is provided an opening to which a ventilation cloth is attached. The ventilation cloth 183 allows the ink solvent vapor to pass but does not allow the liquid ink to pass and is made of, for example, VAPOR ROAD (of Teijin cooperation).

The ventilation cloth 183 can almost perfectly prevent the ink leakage from the waste ink reservoir 55. In addition, the ventilation cloth 183 is provided on the sloping surface which does not become a bottom, thus perfectly preventing the ink leakage.

Figure 29B:
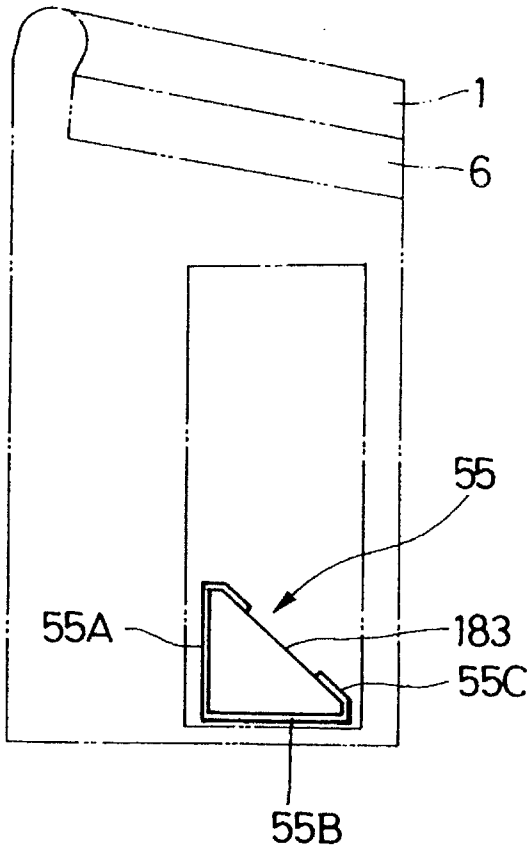
FIGS. 29A and 29B are side views showing the location of the waste ink reservoir when the printer is in use, and when it is put in the case, respectively.
Figure 29A:
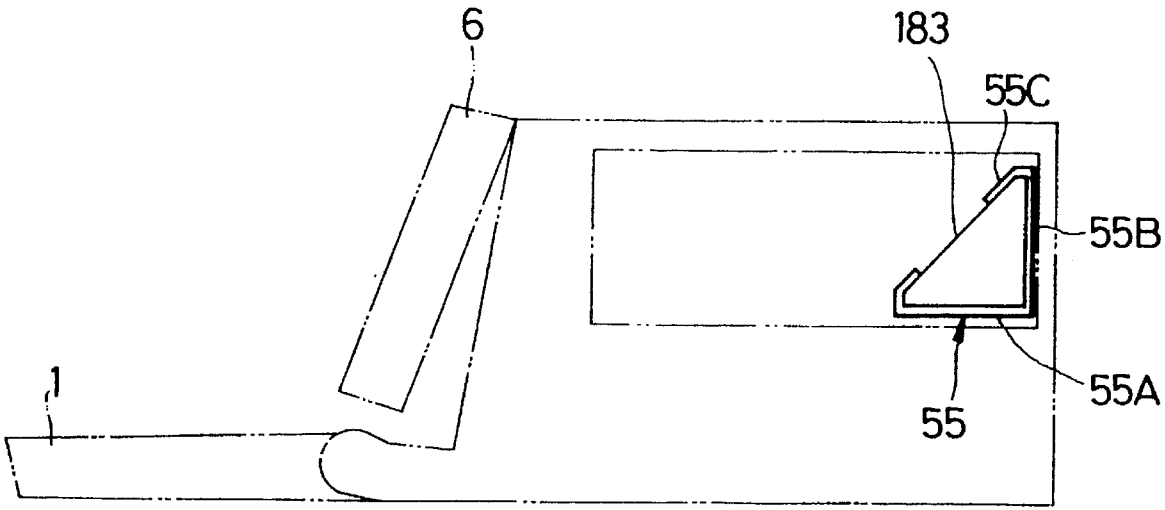

More specifically, when the apparatus is in use as shown in FIG. 29A, the first bottom 55A makes the bottom of the reservoir 55, and the sloping surface 55C faces upward; and when the apparatus is carried as shown in FIG. 29B, the second bottom 55B makes the bottom of the reservoir 55 so that the sloping surface 55C also faces upward. This prevents the waste ink from leaking out of the reservoir 55 through the ventilation cloth 183.

ADDITIONAL DESCRIPTION

The present invention is particularly suitably useable in an ink jet recording head having heating elements that produce thermal energy as energy used for ink ejection and recording apparatus using the head. This is because, the high density of the picture element, and the high resolution of the recording are possible.

The typical structure and the operational principle are preferably those disclosed in U.S. Pat. Nos. 4,723,129 and 4,740,796. The principle is applicable to a so-called on-demand type recording system and a continuous type recording system particularly however, it is suitable for the on-demand type because the principle is such that at least one driving signal is applied to an electrothermal transducer disposed on liquid (ink) retaining sheet or liquid passage, the driving signal being enough to provide such a quick temperature rise beyond a departure from nucleation boiling point, by which the thermal energy is provide by the electrothermal transducer to produce film boiling on the heating portion of the recording head, whereby a bubble can be formed in the liquid (ink) corresponding to each of the driving signals. By the development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Patent Application Publication No. 123670/1984 wherein a common slit is used as the ejection outlet for plural electrothermal transducers, and to the structure disclosed in Japanese Patent Application Laid-Open No. 138461/1984 wherein an opening for absorbing pressure wave of the thermal energy is formed corresponding to the ejecting portion. This is because, the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head or plural recording heads combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or suction means, preliminary heating means utilizing the ejection electrothermal transducer or a combination of the ejection electrothermal transducers and an additional heating element and means for preliminary ejection not for the recording operation, which can stabilize the recording operation.

As regards the kinds of the recording head mountable, it may be a single head corresponding to a single color ink, or may be plural heads corresponding to a plurality of ink materials having different recording colors or densities. The present invention is effectively applicable to an apparatus having at least one of a monochromatic mode recording mainly with black and multi-color recording with different color ink materials and full-color mode by the utilizing mixture of the colors which may be an integrally formed recording unit or a combination of plural recording units.

Furthermore, in the foregoing embodiment, the ink has been liquid. It may be, however, an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in usual recording apparatus of this type, the ink is such that it is liquid within the temperature range when the recording signal is applied. In addition, the temperature rise due to the thermal energy is positively prevented by consuming it for the state change of the ink from the solid state to the liquid state, or the ink material is solidified when it is left is used to prevent the evaporation of the ink. In either of the cases, the application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material on through holes or recesses formed in a porous sheet as disclosed in Japanese Patent Application Laid-Open No. 56847/1979 and Japanese Patent Application Laid-Open No. 71260/1985. The sheet is faced to the electrothermal transducers. The most effective one for the ink materials described above is the film boiling system.

The ink jet recording apparatus may be used as an output terminal of an information processing apparatus such as computer or the like, a copying apparatus combined with an image reader or the like, or a facsimile machine having information sending and receiving functions.

Although specific embodiments of a record apparatus constructed in accordance with the present invention have been disclosed, it is not intended that the invention be restricted to either the specific configurations or the uses disclosed herein. Modifications may be made in manners obvious to those skilled in the art. For example, although the embodiments are described with regard to a serial printer, the present invention can also be applied to line printers. Here, the serial printer is defined as a printer that has a moving member on which the record head is mounted, the moving member being moved to and fro in the direction perpendicular to the transporting direction of the recording paper. Accordingly, it is intended that the invention be limited only by the scope of the appended claims.

What is claimed is:

1. A recording apparatus having a mechanism for adjusting a gap between a recording medium disposed on a platen and a recording head, said recording apparatus comprising:

a recording medium pressure member;

a biasing member engaged with said recording medium pressure member and biasing the recording medium against said platen;

a guide member extending along said recording medium pressure member;

a guide shaft extending parallel to said recording medium pressure member;

a carriage for moving said recording head along said recording medium pressure member, said carriage being guided by said guide shaft;

a first pressing member provided on said carriage and engaging with said guide member, said first pressing member pressing against said guide member to bias said carriage in a direction from said guide member toward said recording medium pressure member;

a second pressing member provided on said carriage, said second pressing member being in contact with and acting on said recording medium pressure member;

a first support portion which is provided on said carriage and supports said carriage on said guide shaft; and a second support portion which is provided on said carriage and supports said carriage on said guide shaft, said second support portion being a pivot portion, said carriage pivoting with a pivot motion about said second support portion, wherein said carriage pivots with the pivot motion in a plane including said first support portion and said second support portion about said second support portion in accordance with a change in thickness of the recording medium so that the gap between said recording head and the recording medium is kept to a predetermined amount.

2. A recording apparatus as claimed in claim 1, wherein said second pressing member comprises a rotating member which is in rotatable contact with said recording medium pressure member.

3. A recording apparatus as claimed in claim 1, further comprising an arm member, which is rotatably supported by said carriage, said arm member having a first end and a second end, which is biased by an elastic member, wherein said first pressing member comprises a rotating member, which is provided on the first end of said arm member.

4. A recording apparatus as claimed in claim 1, wherein the recording medium has the thickness and said recording medium pressure member varies a position of said second pressing member in a direction toward said guide member in accordance with a change in the thickness of the recording medium due to contact of said second pressing member with said recording medium pressure member.

5. A recording apparatus as claimed in claims 1, wherein said first support portion comprises an eccentric bearing.

6. A recording apparatus as claimed in claim 1, wherein said carriage is rotated by forces which are respectively exerted on said second pressing member by said recording medium pressure member and on said first pressing member by said guide member due to the thickness of the recording medium moving said recording medium pressure member.

7. A recording apparatus as claimed in claim 1, further comprising means for moving said carriage to move the recording head in a direction parallel to the platen.

8. A recording apparatus as claimed in claim 1, wherein the recording head comprises means for ejecting fluid ink for recording.

9. A recording apparatus as claimed in claim 1, wherein the recording head comprises means for ejecting the fluid ink for recording by generating thermal energy to create a bubble to displace the ink.

10. A recording apparatus having a mechanism for adjusting a gap between a recording medium disposed on a platen and a recording head, said recording apparatus comprising:

a recording medium pressure member;

a biasing member engaged with said recording medium pressure member and biasing the recording medium against said platen, a position of said recording medium pressure member biased by said biasing member varying in a direction from and toward said platen in accordance with a change in thickness of the recording medium;

a guide member extending along said recording medium pressure member;

a guide shaft extending parallel to said recording medium pressure member;

a carriage for moving said recording head along said recording medium pressure member, said carriage being guided by said guide shaft;

a first pressing member provided on said carriage and engaging with said guide member, said first pressing member pressing against said guide member to bias said carriage in a direction from said guide member toward said platen;

a second pressing member provided on said carriage, said second pressing member being in contact with and acting on said recording medium pressure member, said second pressing member pressing said carriage in a direction from said platen due to a variation of the position of said recording medium pressure member in accordance with the change in thickness of the recording medium;

a first support portion which is provided on said carriage and supports said carriage on said guide shaft; and a second support portion which is provided on said carriage and supports said carriage on said guide shaft, said second support portion being a pivot portion, said carriage pivoting with a pivot motion about said second support portion in a plane including said first support portion and said second support portion by a force exerted by said second pressing member in a direction from said platen and by a force exerted by said first pressing member in a direction toward said platen, wherein said carriage pivots with the pivot motion in accordance with the change in thickness of the recording medium so that the gap between said recording head and said recording medium is kept to a predetermined amount.

11. A recording apparatus as claimed in claim 10, wherein said second pressing member comprises a rotating member which is in rotatable contact with said recording medium pressure member.

12. A recording apparatus as claimed in claim 10, further comprising an arm member, which is rotatably supported by said carriage, said arm member having a first end and a second end, which is biased by an elastic member, wherein said first pressing member comprises a rotating member, which is provided on the first end of said arm member.

13. A recording apparatus as claimed in claim 10, wherein said first support portion comprises an eccentric bearing.

14. A recording apparatus as claimed in claim 10, further comprising means for moving said carriage to move the recording head in a direction parallel to the platen.

15. A recording apparatus as claimed in claim 10, wherein the recording head comprises means for ejecting fluid ink for recording.

16. A recording apparatus as claimed in claim 10, wherein the recording head comprises means for ejecting the fluid ink for recording by generating thermal energy to create a bubble to displace the ink.

17. A gap adjusting method for adjusting a gap between a recording face of a recording medium and a recording head mounted on a carriage in accordance with a thickness of the recording medium transported to a platen of a recording apparatus, said method comprising the steps of:

providing a recording medium pressure member which presses the recording medium to the platen and varies a position thereof in a direction from and toward the platen in accordance with a change in thickness of the recording medium;

supporting the carriage on a guide shaft extending along the platen through two supporting portions; and varying the gap between the recording head and the recording face of the recording medium by pivoting the carriage, the carriage pivoting in a plane including the two supporting portions about one of the two supporting portions as a pivot portion.

18. A gap adjusting method for adjusting a gap between a recording medium disposed on a platen and a recording head, said method comprising the steps of:

arranging a recording medium pressure member, a biasing member engaged with the recording medium pressure member and biasing the recording medium against the platen, a guide member extending along the recording medium pressure member, a guide shaft extending parallel to the recording medium pressure member, a carriage for moving the recording head along the recording medium pressure member, the carriage being guided by the guide shaft, a first pressing member provided on the carriage and engaging with the guide member, the first pressing member pressing against the guide member to bias the carriage in a direction from the guide member toward the recording medium pressure member, a second pressing member provided on the carriage, the second pressing member being in contact with and acting on the recording medium pressure member, a first support portion which is provided on the carriage and supports the carriage on the guide shaft, and a second support portion which is provided on the carriage and supports the carriage on the guide shaft, the second support portion being a pivot portion, the carriage pivoting with a pivot motion about the second support portion; and rotating the carriage with the pivot motion in a plane including the first support portion and the second support portion about the second support portion in accordance with a change in thickness of the recording medium so that the gap between the recording head and the recording medium is kept to a predetermined amount.

19. A gap adjusting method for adjusting a gap between a recording medium disposed on a platen and a recording head, said method comprising the steps of:

arranging a recording medium pressure member, a biasing member engaged with the recording medium pressure member and biasing the recording medium against the platen, a position of the recording medium pressure member biased by the biasing member varying in a direction from and toward the platen in accordance with a change in thickness of the recording medium, a guide member extending along the recording medium pressure member, a guide shaft extending parallel to the recording medium pressure member, a carriage for moving the recording head along the recording medium pressure member, the carriage being guided by the guide shaft, a first pressing member provided on the carriage and engaging with the guide member, the first pressing member pressing against the guide member to bias the carriage in a direction from the guide member toward the platen, a second pressing member provided on the carriage, the second pressing member being in contact with and acting on the recording medium pressure member, the second pressing member pressing the carriage in a direction from the platen due to a variation of the position of the recording medium pressure member in accordance with the change in thickness of the recording medium, a first support portion which is provided on the carriage and supports the carriage on the guide shaft, and a second support portion which is provided on the carriage and supports the carriage on the guide shaft, the second support portion being a pivot portion, the carriage pivoting with a pivot motion about the second support portion in a plane including the first support portion and the second support portion by a force exerted by the second pressing member in a direction from the platen and by a force exerted by the first pressing member in a direction toward the platen; and rotating the carriage with the pivot motion in accordance with the change in thickness of the recording medium so that the gap between the recording head and the recording medium is kept to a predetermined amount.

20. A recording apparatus having means for adjusting a gap between a recording face of a recording medium and a recording head mounted on a carriage in accordance with a thickness of the recording medium transported to a platen, said recording apparatus comprising:

recording medium pressing means for pressing the recording medium to the platen and varying a position thereof in a direction from and toward the platen in accordance with a change in thickness of the recording medium;

supporting means for supporting the carriage on a guide shaft extending along the platen through two supporting portions; and varying means for varying the gap between the recording head and the recording face of the recording medium by pivoting the carriage in response to varying the position of said pressing means, the carriage pivoting in a plane including the two supporting portions about one of said two supporting portions as a pivot portion.

* * * * *

UNITED STATES PATENT AND TRADEMARK OFFICE

CERTIFICATE OF CORRECTION

PATENT NO. : 5,610,636 Page 1 of 3

DATED : March 11, 1997

INVENTOR(S) : TADASHI HANABUSA, ET AL.

It is certified that error appears in the above-indentified patent and that said Letters Patent is hereby corrected as shown below:

On the title page, Item [56],
REFERENCES CITED

U.S. PATENT DOCUMENTS

Insert --3,960,256 6/1976 Bickoff, et al.--.

COLUMN 1

Line 16, "over" should read --overhead--.

Line 17, "head" should be deleted.

Line 29, "are" should read --is--.

Line 60, "is" should read --there is--.

COLUMN 2

Line 59, "is" should read --there is--.

COLUMN 4

Line 40, "each" should read --to each--.

COLUMN 7

Line 3, "over head" should read --overhead--.

UNITED STATES PATENT AND TRADEMARK OFFICE

CERTIFICATE OF CORRECTION

PATENT NO. : 5,610,636

DATED : March 11, 1997

INVENTOR(S) : TADASHI HANABUSA, ET AL.

It is certified that error appears in the above-indentified patent and that said Letters Patent is hereby corrected as shown below:

COLUMN 17

Line 11, "46s" should read --46S--

Line 50, "46s." should read --46S.--.

Line 53, "46s'" should read --46S'--.

COLUMN 18

Line 3, "46s" should read --46S--.

Line 24, "the-apparatus" should read --the apparatus--.

COLUMN 20

Line 25, "changes," should read --change,--.

COLUMN 23

Line 5, "uprighted" should read --formed upright--.

UNITED STATES PATENT AND TRADEMARK OFFICE

CERTIFICATE OF CORRECTION

PATENT NO. : 5,610,636 Page 3 of 3

DATED : March 11, 1997

INVENTOR(S) : TADASHI HANABUSA, ET AL.

It is certified that error appears in the above-indentified patent and that said Letters Patent is hereby corrected as shown below:

COLUMN 28

Line 9, "cooperation)." should read --Corporation).--.

Signed and Sealed this

Thirtieth Day of December, 1997

Bruce Lehman

*Attest:*

BRUCE LEHMAN

*Attesting Officer*

*Commissioner of Patents and Trademarks*